US008602784B2

(12) United States Patent
Dvorak

(10) Patent No.: US 8,602,784 B2
(45) Date of Patent: Dec. 10, 2013

(54) APPARATUS FOR CONVERTING A PISTOL INTO A WEAPON SIMULATOR

(76) Inventor: Vojtech Dvorak, Tulsa, OK (US)

( * ) Notice: Subject to any disclaimer, the term of this patent is extended or adjusted under 35 U.S.C. 154(b) by 132 days.

(21) Appl. No.: 13/132,965

(22) PCT Filed: Dec. 4, 2009

(86) PCT No.: PCT/US2009/006379

§ 371 (c)(1),
(2), (4) Date: Aug. 19, 2011

(87) PCT Pub. No.: WO2010/065124

PCT Pub. Date: Jun. 10, 2010

(65) Prior Publication Data

US 2012/0129136 A1 May 24, 2012

Related U.S. Application Data

(60) Provisional application No. 61/200,979, filed on Dec. 5, 2008.

(51) Int. Cl.
*F41A 33/00* (2006.01)

(52) U.S. Cl.
USPC ..... 434/18; 434/11

(58) Field of Classification Search
USPC ..... 434/11–27; 42/27; 446/406; 463/2, 18, 463/36, 49, 51; 124/56
See application file for complete search history.

(56) References Cited

U.S. PATENT DOCUMENTS

| | | | | |
|---|---|---|---|---|
| 6,146,141 | A * | 11/2000 | Schumann | 434/11 |
| 6,682,350 | B2 | 1/2004 | Kehl | |
| 7,306,462 | B2 | 12/2007 | Metcalf et al. | |
| 2005/0074726 | A1 * | 4/2005 | Metcalfe et al. | 434/18 |
| 2006/0265929 | A1 * | 11/2006 | Haney | 42/116 |
| 2008/0168972 | A1 | 7/2008 | Wei | |

* cited by examiner

*Primary Examiner* — Timothy A Musselman
(74) *Attorney, Agent, or Firm* — James R Bell

(57) ABSTRACT

An apparatus for non-permanent conversion of a semiautomatic pistol into a compressed gas powered weapon simulator. The apparatus replaces the pistol's barrel, recoil spring and magazine with no modification of the pistol, which allows retaining the operational functions of the pistol's remaining components. Compressed gas, from the simulation magazine unit, is used in the compressed gas valve means, in the barrel unit, to operate the slide mechanism, to compress the simulation recoil spring, and to emit a laser pulse beam on a target when activated by the firing mechanism; and battery power, from the simulation magazine unit, is used to count the number of shots, lock the slide after a predetermined number of shots and transmit information from the weapon simulator to a remote data system. The compressed simulation recoil spring returns the slide mechanism back to its original position, unless locked open by the apparatus.

13 Claims, 12 Drawing Sheets

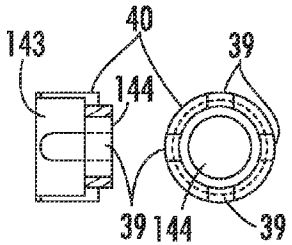
FIG. 3
FIG. 4
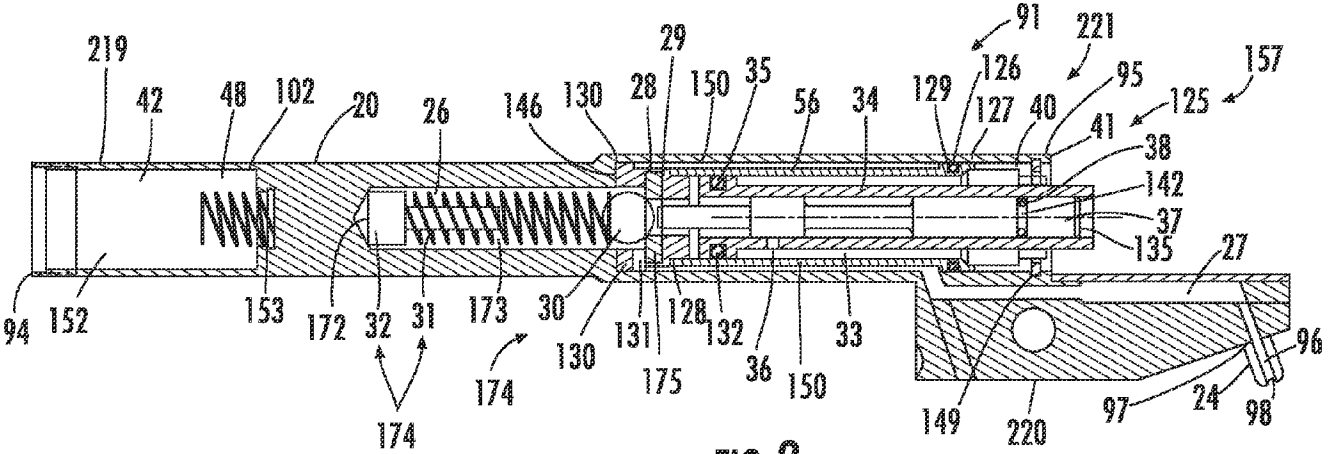
FIG. 2
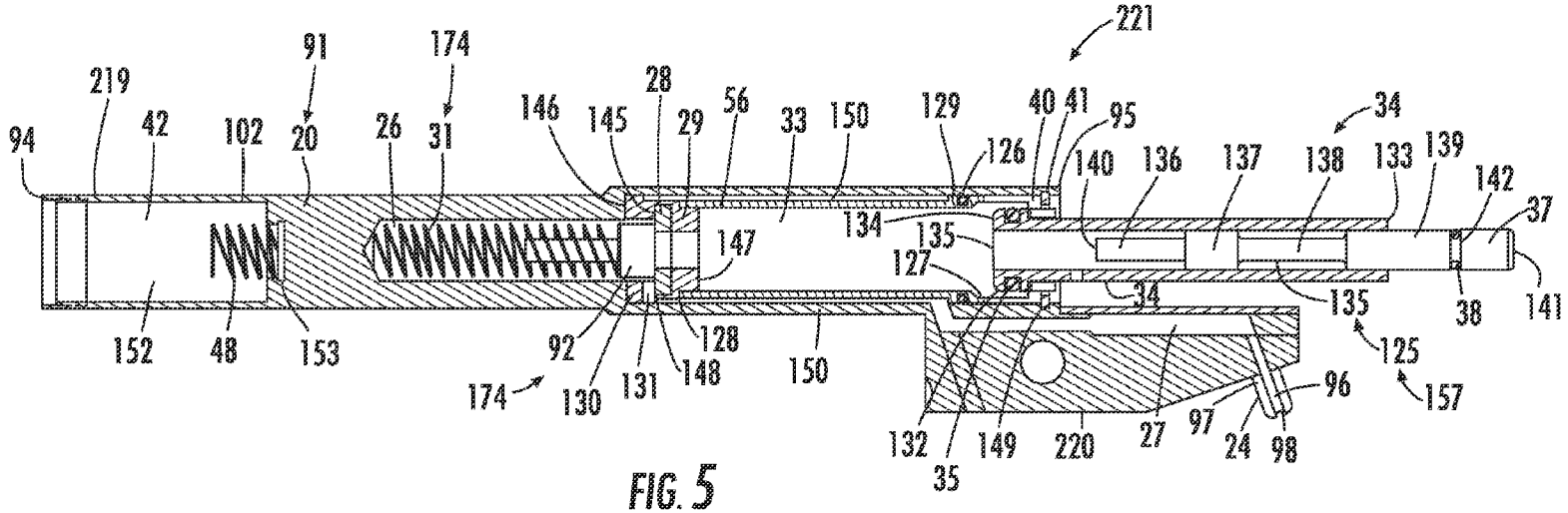
FIG. 5

APPARATUS FOR CONVERTING A PISTOL INTO A WEAPON SIMULATOR

CROSS REFERENCE TO RELATED APPLICATIONS

The present application is a 371 application of PCT/US2009/006379, filed Dec. 4, 2009, which claims priority to Provisional Application U.S. Ser. No. 61/200,979 filed Dec. 5, 2008.

BACKGROUND OF THE INVENTION

1. Field of the Invention

The present invention relates to a novel apparatus for converting a semiautomatic pistol (hereinafter referred to as a "pistol") into a simulator so that the pistol converted into a simulator (hereinafter referred to as a "weapon simulator") can be used for training individuals in the use of a semiautomatic pistol without having to fire live ammunition. More particularly, the weapon simulator provides a realistic firing sensation by providing the proper feel and balance, the proper trigger response, the proper action of the slide mechanism, the proper recoil and the locking of the slide mechanism in the proper position after the specific number of shots have been fired by the weapon simulator, while marking the point of aim with a laser, which makes the weapon simulator a safe, realistic and cost effective training tool.

2. Prior Art

Various attempts have been made to develop a realistic weapon simulator or to retrofit a working pistol into a simulator with limited success. From U.S. Pat. No. 4,380,437, a laser beam weapon is known that is connected to a source of compressed air via a hose-pipe to push back the carriage. The disclosed weapon is a special replica with a modified trigger mechanism. The combination of the features of this weapon prevents it from providing a realistic feel of a real weapon. The firearm recoil simulator disclosed in U.S. Pat. No. 4,480,999 provides a recoil system via an air line coming in through the nuzzle, which does not leave room for a laser pointer in the barrel and the simulator has a bulky air valve that hangs from the handle of the simulator that prevents the simulator from duplicating the feel of a real weapon. The retrofittable laser and recoil system for a firearm described in U.S. Pat. No. 5,842,300 does retrofit an actual firearm, however, the recoiling element is placed in the magazine. The recoiling element does not push back the slide and does not cycle the semiautomatic weapon's mechanism, thus only offering limited realism. The simulated weapon described in U.S. Pat. No. 5,947,738 uses a special gas cartridge in the barrel of the weapon to activate a pressure switch within the barrel to activate a light emitter and does not provide a realistic feel of a real weapon. The laser pistol described in U.S. Pat. No. 6,146,141 is a replica of a weapon that has an electronic trigger mechanism that does not offer the realistic feel of a real weapon. The laser pistol described in U.S. Pat. No. 6,682,350 has several shortcomings as a simulator. The simulator uses a magazine connection piece, which takes up space in the magazine well, therefore a reduced size magazine must be used to maintain the original gun's shape. This reduced size magazine does not leave room for a slide catch mechanism. The simulator uses a hose coupling between the magazine connection piece and the compressed gas cylinder that is difficult to connect and keep connected. The simulator has a connection valve with a protruding pin on top of the magazine, which can hang up when received into the simulator. The simulator has a separate fill valve at the bottom of the magazine that is used to either fill the magazine or attach a hose to provide compressed gas to the simulator. The simulator also uses a switchover valve to activate the valve tappet that complicates the firing mechanism and the compressed gas vents through a slip fit around the striker that reduces the efficiency of the simulator. The above-discussed attributes of the simulator provide for a very complicated and inefficient retrofit to a real weapon. The training firearm discussed in U.S. Pat. No. 6,869,285 can be a retrofitted pistol with a blow-back assembly that uses a CO2 cartridge in a modified magazine. The recoil actuator of this simulator is built into the rear portion of the original pistol slide; therefore it requires the weapon slide to be milled out and is then no longer usable for live ammunition. Also, a flexible hose connection between the magazine and barrel is problematic. In this simulator, the magazine cannot be removed easily due to the magazine being tethered to the blow-back assembly in the barrel of the gun and the design of the magazine does not provide room for a slide catch. These changes prevent the simulator from providing a realistic feel of a real weapon. The bolt locking assembly for firearm simulators described in U.S. Pat. No. 7,197,973 provides slide lock simulation by electro-pneumatic means using a pneumatic recoil valve with a pilot valve, which can only be applied to a specially built simulated firearm. This prevents the simulator from being able to provide the realistic feel of a real weapon. The simulator described in U.S. Pat. No. 7,306,462 has a low-pressure gas recoiling system controlled by an electric pilot valve. This is a more complex design that requires both electricity and gas to produce recoil in the simulator.

The disadvantage of known simulators is that they are either built as non/firing gas operated replicas or they are converted real pistols where the conversion of the pistol to a simulator is difficult to implement, the conversion often requiring a specially trained technician to install the conversion components into the pistol and often making the conversion of the pistol to a simulator irreversible.

Therefore, there is a need in the art for an apparatus for converting a pistol into a weapon simulator so that the weapon simulator provides a realistic firing sensation by providing the proper feel and balance, the proper trigger response, the proper action of the slide mechanism, and the proper recoil without the drawbacks of the present prior art.

It is therefore desirable to develop a novel apparatus for converting a pistol into a weapon simulator that does not require permanent alternation to the pistol to allow the pistol to accommodate the apparatus so that the pistol can alternate between being a weapon simulator and being a working pistol that fires live ammunition.

It is also desirable to develop a novel apparatus for converting a pistol into a weapon simulator such that the apparatus does not require special tools to convert the pistol into a weapon simulator.

It is also desirable to develop a new apparatus that converts a real pistol, that fires live ammunition, to a weapon simulator, that fires a laser pulse beam, so that training to use the pistol can be accomplished in a safe environment.

It is also desirable to develop a new apparatus for converting a pistol to a weapon simulator that uses a standard source of compressed gas that can easily obtained in the marketplace and can be easily replaced in the simulator when the compressed gas has been expended.

It is also desirable to develop a new apparatus for converting a pistol to a weapon simulator that uses only a pneumatic source of energy to operate the weapon simulator.

It is also desirable to develop a new apparatus for converting a pistol that allows the use of a means for providing a remote source of compressed gas that does not require a permanent modification to the pistol.

It is also desirable to develop a new apparatus for converting a pistol that count shots and locks the slide of the weapon in the open position after the correct number of shots are fired by the weapon simulator to replicate a pistol's response to the last bullet being fired by the pistol.

It is also desirable to provide a new apparatus for converting a pistol to a weapon simulator that has a transmitter means that provides a signal to a remote supervisory system to monitor the shots fired by the simulator during training.

SUMMARY OF THE INVENTION

The embodiments of the present invention are directed to an apparatus for converting a pistol into a weapon simulator (hereinafter referred to as "apparatus") without the use of any special tools or requiring any alterations to the pistol so that the user is given a realistic firing sensation when they fire the weapon simulator and so that the weapon simulator can be converted back to a pistol that is capable of firing live ammunition. Most modern small arms are designed in such a way that major parts can be easily removed for cleaning and maintenance. Standard takedown procedures for cleaning and maintenance of a pistol are provided to the user by the pistol manufacturer and are also part of standard drill in armed forces. The removal and reinstallation of the barrel and recoil spring in a pistol or replacement of an empty magazine with a full magazine are skills entirely within the capabilities of an average shooter and are typically required for qualification in organized weapon training. The installation of the apparatus for converting a pistol into a weapon simulator has been simplified so that the installation of this novel apparatus to convert a pistol into a weapon simulator does not require more than these basic skills.

Embodiments of the invention may include one or more of the following features. The apparatus includes a barrel unit, a simulation recoil spring and a simulation magazine unit that replaces the original components in the pistol to convert the pistol to a weapon simulator. The weapon simulator utilizes the frame, the locking block, the slide mechanism, the disassembly latch, the magazine catch and the firing mechanism that are the original components of the pistol where the slide mechanism has a slide and a slide latch. The slide having a rest position and an open position such that the rest position is where the slide is found on the weapon frame before firing the weapon simulator or the pistol and such that the open position is where the slide is found on the weapon frame after the weapon simulator or pistol is fired or where the slide is locked on the weapon frame after all ammunition has been fired from the magazine of the pistol. The simulation magazine unit contains a compressed gas source to provide the energy to operate the weapon simulator. The barrel unit is connected to the simulation magazine unit so that the compressed gas flows from the compressed gas source to the barrel unit. The barrel unit contains a compressed gas valve means that interacts with the firing mechanism so that compressed gas is released in the compressed gas valve means such that the compressed gas valve means forces the slide to move from its rest position to its open position, thereby compressing the simulation recoil spring. Once the compressed gas flows through the compressed gas valve means and is vented to the outside of the weapon frame, the energy from the compressed simulation recoil spring causes the slide to move from its open position to its rest position, which moves the compressed gas valve means so that the compressed gas valve means seals off the compressed gas flow path. The barrel unit may include a laser beam pulse means that is actuated by a laser beam actuation means that is responsive to when the weapon simulator is fired whereby the laser beam actuation means signals the laser beam pulse means to emit a laser beam onto a target. The barrel unit may consist of two or more components to allow the conversion of a pistol that has a weapon frame that will not accommodate a one-piece barrel unit. The compressed gas valve means may contain a step piston to provide for a gradual recoil instead of an abrupt recoil, as an abrupt recoil causes violent muzzle movement in the vertical direction and therefore the laser beam creates a streak on the target instead of a point. The simulation magazine unit may also contain a slide catch means that counts shots fired by the weapon simulator and locks the slide in the open position after the appropriate number of shots are fired by the weapon simulator to replicate a pistol's response to the last bullet being fired by the pistol where the slide is locked in the open position when the magazine is empty of live ammunition. The simulation magazine unit may also contain a transmitter means that provides a wireless connection for sending data from the weapon simulator and a remote supervisory system to provide information from the weapon simulator such as the number of shots fired by the weapon simulator during training. The present invention is directed to an apparatus to convert a pistol to a weapon simulator that replaces only the original barrel, recoil spring and magazine in the pistol with a uniquely designed barrel unit, simulation recoil spring and simulation magazine unit that drops neatly in place in the weapon frame and does not interfere with any of the other components of the unmodified pistol. In fact, the present invention takes advantage of the remaining major components of the original pistol with the philosophy that since the pistol already has these other components, why not make use of them in the weapon simulator. In particular, the present invention utilizes an unaltered trigger, where the trigger is part of the firing mechanism, in the weapon simulator. This means that the shooter's feel of pressing the trigger is exactly the same in the weapon simulator as it is in the pistol when firing live ammunition. This attribute of the weapon simulator is very important for proper training and for the shooter to become use to their own pistol for the simple reason that trigger characteristics greatly affect the practical accuracy of shooting the pistol. In the present invention, the weapon cycle is triggered directly by the blow or impact of the unmodified firing pin as if it were igniting the cartridge primer of live ammunition, except in the case of the present invention, the impact of the firing pin actuates the compressed gas valve means. The benefit of the using the entire original firing mechanism, without any alternations, is that all safety elements built into the original weapon like the safety lever or safe hammer drop lever, remain fully functional and can be practiced during training or instruction on the use of the pistol. In comparison, most of the simulators of prior art have had their triggers specially designed as pneumatic or electrical switches or are surrounded with sensors that change the trigger's characteristics from the trigger's normal characteristics found in the pistol and they do not duplicate the pistol's safety elements.

Other exemplary embodiments and advantages of the present invention may be ascertained by reviewing the present disclosure and the accompanying drawings.

BRIEF DESCRIPTION OF THE DRAWINGS

FIG. 2 is a sectional side view of the first embodiment of the barrel unit shown in FIG. 1 wherein the slide would be in the rest position.

FIG. 3 is a sectional side view of one embodiment of the bore cap shown in FIG. 2.

FIG. 4 is a rear perspective view of the bore cap shown in FIG. 3.

FIG. 5 is a sectional side view of the second embodiment of the barrel unit shown in FIG. 1 wherein the slide would be in the open position.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
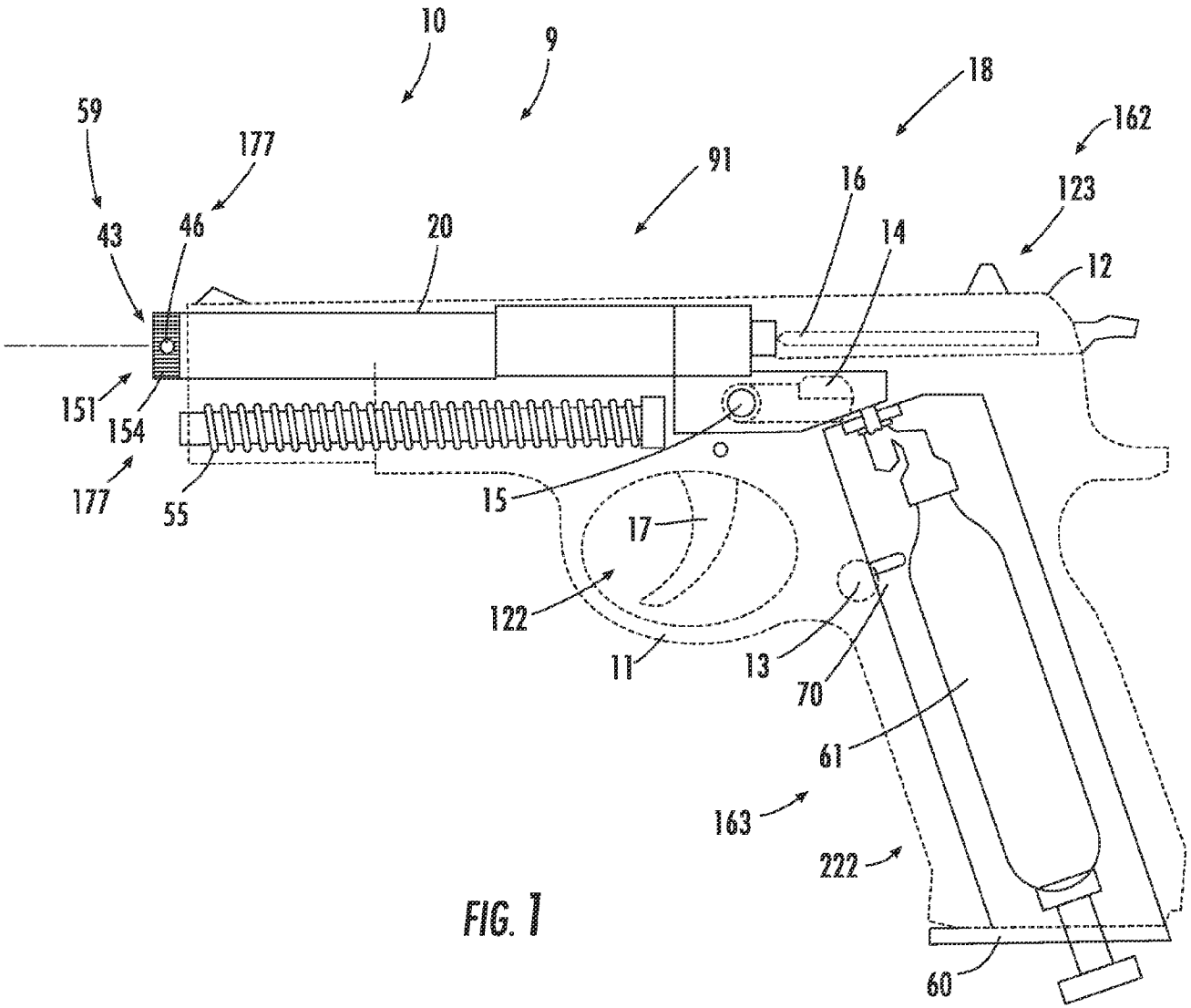
FIG. 1 is a schematic side elevational view of one embodiment of the present invention wherein the apparatus for converting a pistol into a weapon simulator is received into the pistol when the slide is in the rest position to create the weapon simulator.
Figure 24:
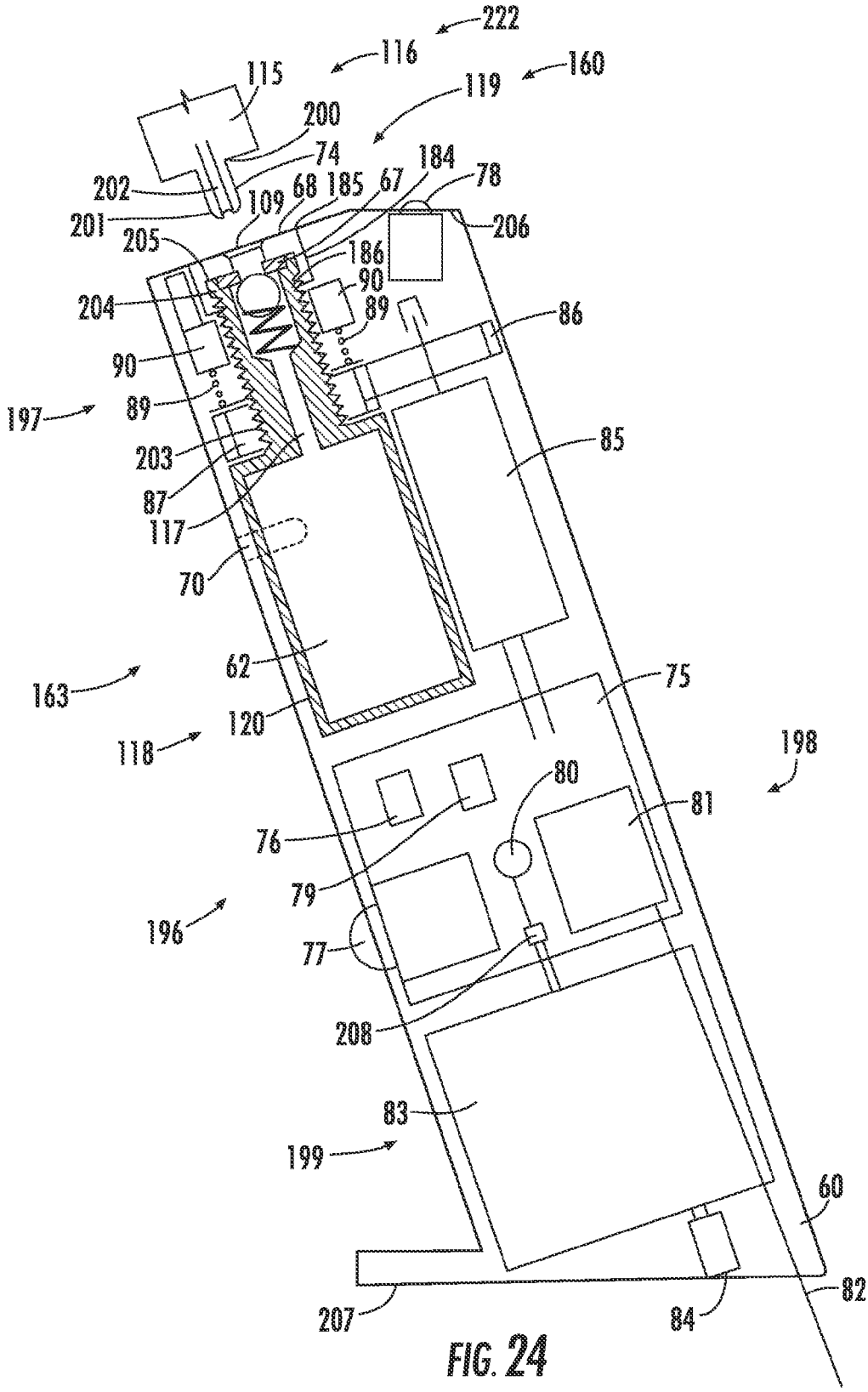
FIG. 24 is a schematic side elevation view of a fourth embodiment of the simulation magazine unit wherein the simulation magazine unit contains a highly compressed gas storage means that is refillable, a slide catch means, a remote communication means and a simulation magazine unit power means that is rechargeable wherein the slide catch means contains a motor, a transmission, a drive nut, a slide catch riser spring and a slide catch riser.

Referring to the figures of the drawings, wherein like numerals of reference designate like elements throughout the several views, particularly to FIG. 1, there is shown a schematic side elevational view of the preferred embodiment of the present invention wherein an apparatus for converting a pistol into a weapon simulator 9 (hereinafter referred to as "apparatus 9") is received into a pistol to create a weapon simulator 10. The apparatus 9 comprises a barrel unit 91, a simulation recoil spring 55 and a simulation magazine unit 60. The installation of the apparatus 9 into the pistol, utilizing the firearm manufacturer's normal disassembly and assembly procedures without the need for any special tools or modification of any part of the original pistol, allows converting a pistol to a compressed gas powered weapon simulator 10 and then allows the weapon simulator 10 to be converted back into a pistol by removing the apparatus 9 and reinstalling the original barrel, recoil spring and magazine utilizing the same disassembly and assembly procedures. The weapon simulator 10 uses a compressed gas source means 163 to provide a compressed gas such that the pressure of the compressed gas provides an energy source to actuate the weapon simulator 10 to accomplish simulated shooting. While various methods may be used to provide the compressed gas source means 163 used in the simulation magazine unit 60, FIG. 1 shows the weapon simulator 10 using a standard off-the-shelf CO2 compressed cartridge, which is ample for up to one hundred (100) shots from the weapon simulator 10, that can be easily replaced once pressure in the cartridge becomes so low that the weapon simulator 10 will no longer function as the cartridge 61 in the preferred embodiment. The CO2 cartridges are readily available and are inexpensive to purchase which makes using the weapon simulator 10 of the present invention convenient, safe and cost effective. Special cartridges having pressures higher than a standard off-the-shelf CO2 cartridge could be used as the cartridge 61 to provide more shots between replacement of the cartridge 61. In another embodiment of the present invention as shown in FIG. 24, a refillable high pressure gas storage means 118 is provided in the simulation magazine unit 60 of the apparatus 9 to provide the source of compressed gas to power the weapon simulator 10 which could use a variety of gases as the source of compressed gas.

As shown in FIG. 1, the weapon simulator 10 utilizes the pistol's frame 11, slide mechanism 123, magazine catch 13, disassembly latch 15 and firing mechanism 122 with no modifications to the pistol. The firing mechanism 122 comprises a firing pin 16, a trigger 17, a trigger safety lever 161 and a means for striking firing pin 18. The pistol's frame 11, slide mechanism 123, magazine catch 13, disassembly latch 15 and firing mechanism 122 perform the same functionality as part of the weapon simulator 10 as they did as part of the pistol. In fact, the present invention takes advantage of these remaining major components by utilizing them in the weapon simulator 10 in order to provide a realistic shooting experience. In particular, the present invention utilizes an unaltered trigger 17 in the weapon simulator 10. This means, that the shooter's feel of pressing the trigger 17 is exactly the same in the weapon simulator 10 as it is in the pistol when firing live ammunition. This attribute of the weapon simulator 10 is very important for proper training and for the shooter to get used to their own pistol due to trigger characteristics greatly affecting the accuracy of shooting the pistol or weapon simulator 10. In the present invention, the weapon cycle is triggered directly by the blow or impact of the unmodified firing pin 16 as if it were igniting the cartridge primer of live ammunition. The benefit of using the entire original firing mechanism 122, without any alternations to the firing mechanism 122, means that all safety elements built into the original weapon, like the trigger safety lever 161, remain fully functional and can be practiced during training or instruction on the use of the pistol. The slide mechanism 123 has a slide 12, a means for actuating slide 162 and a slide catch 14. The slide 12 having a rest position and an open position such that the means for actuating slide 162 moves the slide 12 between these two positions. The rest position is where the slide 12 is found on the frame 11 before firing the pistol or the weapon simulator 10. The open position is where the slide 12 is found on the frame 11 after the weapon simulator 10 or pistol is fired to allow a fired cartridge to be ejected from the pistol, to allow live ammunition to move up from the magazine of the pistol, so that the live ammunition is ready to be pushed into the chamber of the pistol and to cock the firing mechanism 122 for the next shot and where the slide 12 is locked on the frame 11 after all ammunition has been fired from the magazine of the pistol.

Figures 20, 21:
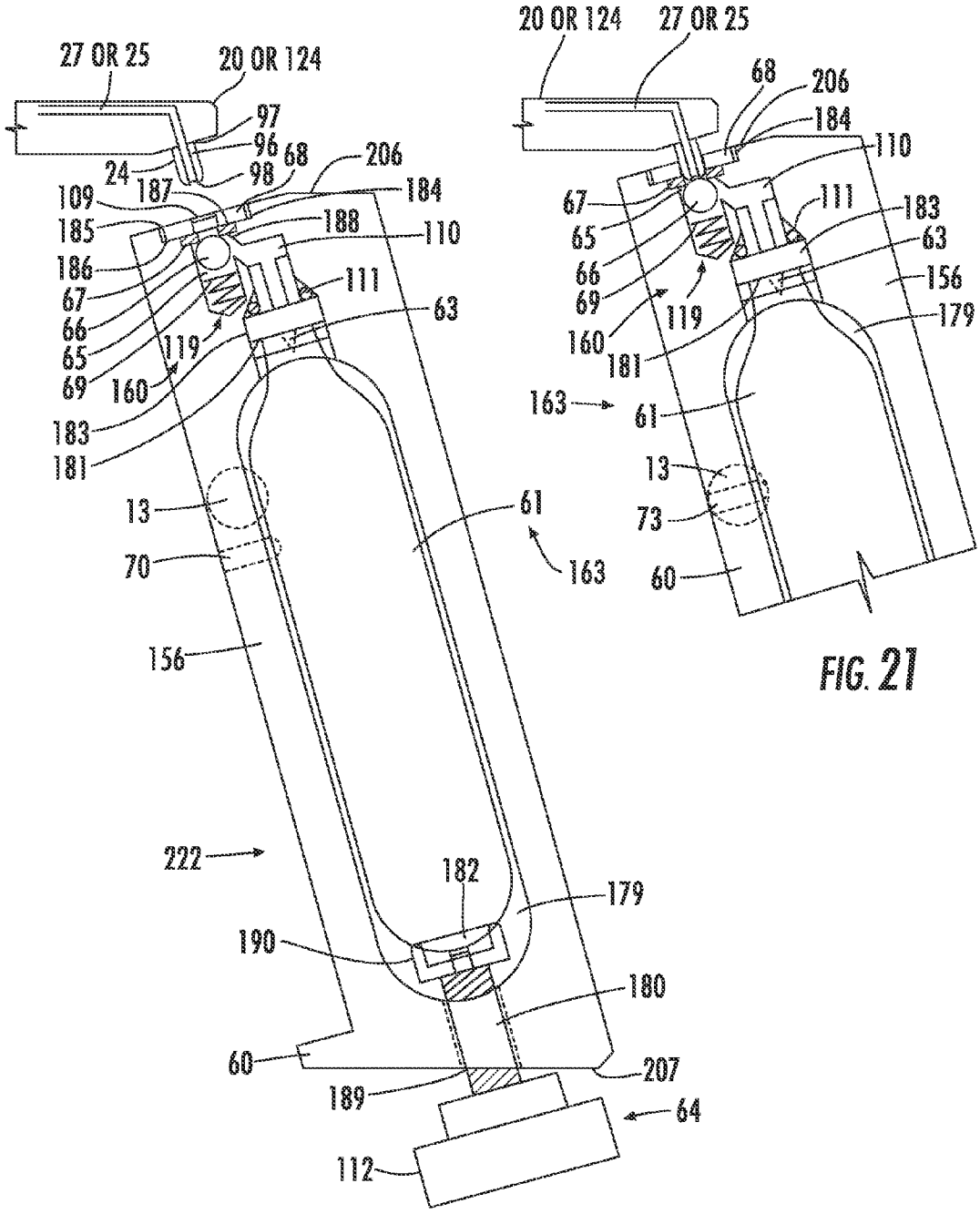
FIG. 20 is an exploded partial schematic side elevation view of the first embodiment of the barrel unit and the first embodiment of the simulation magazine unit shown in FIG. 1 wherein the simulation magazine unit contains a high pressure cartridge as a source of gas supply with a magazine gas sealing means that provides for connecting and disconnecting the simulation magazine unit when the high pressure cartridge is under pressure.
FIG. 21 is a partial schematic side elevation view of a first embodiment of the barrel unit and the first embodiment of the simulation magazine unit shown in FIG. 1 and FIG. 20 where the simulation magazine unit is mated with the barrel unit.

In all of the embodiments of the present invention the pistol's original barrel, recoil spring and magazine are removed and replaced with the apparatus 9 to convert the pistol from firing live ammunition to a weapon simulator 10. In the preferred embodiment of the present invention, FIG. 1 shows an apparatus 9 being received in the frame 11 where the apparatus 9 comprises a barrel unit 91, a simulation recoil spring 55 and a simulation magazine unit 60 such that the barrel unit 91, the simulation recoil spring 55 and the simulation magazine unit 60 cooperate with the remaining components of the pistol to convert the pistol into a weapon simulator 10. As shown in FIGS. 1, 2, 3 and 4, the barrel unit 91 comprises a barrel 20, a compressed gas valve means 157, a compressed gas valve retaining means 221 and a firing mechanism actuated laser beam pulse emitting means 59. As shown in FIG. 1 and FIG. 20, the simulation magazine unit 60 comprises a magazine frame 156, a magazine gas sealing means 160 and a means for receiving the compressed gas from source 222. As shown in FIG. 20, the preferred embodiment for the compressed gas source means 163 comprises a cartridge 61 as the source for compressed gas for the weapon simulator such that the cartridge 61 is received into the means for receiving compressed gas source means 222 where the means for receiving compressed gas source means 222 comprises a cartridge engagement means 64. The magazine gas sealing means 160 comprises a magazine valve assembly 119. The magazine valve assembly 119 and the cartridge engagement means 64 are received in the magazine frame 156 so that the combination of the magazine frame 156, magazine valve assembly 119 and the cartridge engagement means 64 can be inserted and removed from the frame 11 as a single unit as a replacement for the original magazine. A cartridge 61 is received in the cartridge engagement means 64 prior to the magazine frame 156 being inserted into the frame 11 whereby the cartridge 61 provides the source of compressed gas to power the weapon simulator 10. The cartridge engagement means 64 retains and mates the cartridge 61 with the magazine valve assembly 119 so that compressed gas is allowed to flow into the magazine valve assembly 119 where the pressure of the compressed gas it is contained by the magazine valve assembly 119. When the magazine frame 156 with the cartridge 61 is received in the cartridge engagement means 64 and is inserted into the frame 11, the magazine valve assembly 119 sealably mates with the barrel 20 of the barrel unit 91 and allows the compressed gas to flow from the magazine valve assembly 119 into the compressed gas valve means 157. The compressed gas valve means 157 contains the compressed gas in the barrel 20. The compressed gas valve means 157 cooperates with the firing mechanism 122 and the slide mechanism 123 to use the pressure from the source of compressed gas, which is the cartridge 61 in the preferred embodiment, to operate the weapon simulator such that it replicates the operation of the pistol, when the pistol fires live ammunition, and provides an input to activate the firing mechanism actuated laser beam pulse emitting means 59 to generate a laser beam pulse on a target. As shown in FIG. 2, the compressed gas valve means 157 is received inside of the barrel 20 and is removably retained in the barrel 20 by a compressed gas valve retaining means 221. The compressed gas valve means 157 further comprises a compressed gas valve assembly 125. The compressed gas valve assembly 125, having a first valve assembly position and a second valve assembly position, is received inside the barrel 20. The first valve assembly position is where the compressed gas valve assembly 125 is located in the barrel 20 before the firing mechanism 122 is engaged such that the compressed gas valve assembly 125 has closed off the flow path of the compressed gas. As shown in FIG. 5, the second valve assembly position is where the compressed gas valve assembly 125 is located in the barrel 20 after the compressed gas has moved the compressed gas valve assembly 125 toward the rear of the weapon simulator 10 such that the compressed gas valve assembly 125 has re-closed the flow path of the compressed gas and the compressed gas, that has entered the compressed gas valve assembly 125, has been vented from the interior of the compressed gas valve assembly 125. When the slide 12 of the slide mechanism 123 is in its rest position and the compressed gas valve assembly 125 is in its first position, the compressed gas valve assembly 125 contains the compressed gas in the barrel 20 by closing off the flow path for the compressed gas. When the shooter engages the firing mechanism 122 by pulling the trigger 17, the means for striking the firing pin 18 strikes the firing pin 16 which moves the firing pin 16 along the predetermined path so that the firing pin 16 comes in contact with the compressed gas valve assembly 125 with enough force to open the flow path for the compressed gas in the compressed gas valve assembly 125. When the flow path is opened in the compressed gas valve assembly 125, the compressed gas moves the compressed gas valve assembly 125 toward the rear of the weapon simulator 10 to its second position such that the compressed gas valve assembly 125 and means for actuating slide 162 cooperate to move the slide 12 from its rest position to its open position and to compress the simulation recoil spring 55. Once the compressed gas valve assembly 125 reaches its second position, the compressed gas valve assembly 125 has closed the flow path of the compressed gas and the compressed gas that has entered into the compressed gas valve assembly 125 is vented from the interior of the compressed gas valve assembly 125. Once venting has occurred, the compressed simulation recoil spring 55 cooperates with the means for actuating slide 162 to return the slide 12 to its rest position and the compressed gas valve assembly 125 to its first position. A more complete understanding of the new and novel features of the preferred embodiment of the present invention will be better understood from a more detailed description of the apparatus 9 shown in FIGS. 1 through 5, FIG. 13 and FIG. 20. FIG. 1 shows an apparatus 9 comprising a barrel unit 91, a simulation recoil spring 55 and a simulation magazine unit 60 received in the frame 11 of the weapon simulator 10. FIGS. 2 thru 5 and FIG. 13 show the barrel unit 91 comprising a barrel 20, compressed gas valve means 157, a compressed gas valve retaining means 221, and the firing mechanism actuated laser beam pulse emitting means 59. FIG. 20 shows the simulation magazine unit 60 comprising a magazine frame 156, a magazine valve assembly 119 and a cartridge engagement means 64 containing a cartridge 61.

As shown in FIGS. 2 thru 5, the barrel 20 being made from metal or metal alloy material having a predetermined shape to allow the barrel 20 to be received in the frame 11 and having a first barrel end 94, a second barrel end 95, a barrel top 219 and a barrel bottom 220. Also as shown in FIG. 2 and FIG. 5, the preferred embodiment of the barrel 20 having a laser module cavity 42, a first gas chamber 26, a compressed gas valve cavity 33, a barrel channel 27 and a mating pin 24 as a one-piece component. As shown in FIG. 2 and FIG. 5, the laser module cavity 42 is situated at the first barrel end 94 to receive the firing mechanism actuated laser beam pulse emitting means 59 and comprises a first laser module cavity 152 and a second laser module cavity 153. The first laser module cavity 152 is situated in the barrel 20 such that one end of the first laser module cavity 152 is located at the first barrel end 94, the first laser module cavity 152 having a cylindrical shape with a predetermined length of a predetermined inside diameter, with a remaining length of a predetermined inside diameter that is less than the predetermined inside diameter of the predetermined length and with a plurality of laser module cavity threads 102 situated along the interior surface of the inside diameter of the remaining length of the first laser module cavity 152. The second laser module cavity 153 is situated adjacent to the end of the first laser module cavity 152 that is opposite the end of the first laser module cavity 152 that is located at the first barrel end 94 and is in fluid communication with the first laser module cavity 152. The second laser module cavity 153 having a cylindrical shape with a predetermined length of a predetermined inside diameter. As shown in FIG. 2 and FIG. 5, in the preferred embodiment the length of the predetermined length of the first laser module cavity 152, with the larger inside diameter, is substantially shorter in length of the remaining length of the first laser module cavity 152, which has a smaller diameter. As shown in FIG. 2 and FIG. 5, the compressed gas valve cavity 33 is situated at the second barrel end 95 having a cylindrical shape with a predetermined inside diameter and having a bore cap retainer ring groove 149 in a predetermined location in the compressed gas valve cavity 33 that is substantially close to the second barrel end 95 with the bore cap retainer ring groove 149 having a predetermined depth and a predetermined width. As shown in FIG. 2 and FIG. 5, the first gas chamber 26 is situated in the barrel 20 between the laser module cavity 42 and the compressed gas valve cavity 33 such that the first gas chamber 26 is adjacent to and in fluid communication with the end of the compressed gas valve cavity 33 that is opposite of the end of the compressed gas valve cavity 33 that is located at the second barrel end 95, the first gas chamber 26 having a predetermined shape that is substantially cylindrical with a predetermined inside diameter. As shown in FIG. 2 and FIG. 5, the barrel channel 27 having a predetermined shape in a predetermined location in the barrel 20 such that one end of the barrel channel 27 is situated at a predetermined location in the compressed gas valve cavity 33 and the other end of the barrel channel 27 is situated at a predetermined location at the exterior of the barrel 20 at the barrel bottom 220. As shown in FIGS. 1, 2 and 5, the mating pin 24 being made from metal or metal alloy or polymer material and being substantially cylindrical in shape with a predetermined length of a predetermined outside diameter where the predetermined outside diameter in the preferred embodiment would be 3 mm, the mating pin 24 having a mating pin first end 97 where the mating pin first end 97 is attached to the barrel bottom 220 at a predetermined location where the barrel channel 27 is situated at the barrel second end 95 such that the mating pin 24 extends outward from the barrel 20 at a predetermined angle, having a mating pin second end 98 with a predetermined shape that is substantially a sine wave shaped curvature where the sine wave has a predetermined height between the top of the sine wave and the bottom of the sine wave and a predetermined distance between the top of the sine wave and the bottom of the sine wave and has a predetermined radius of the curvature of the mating pin second end 98 and having a mating pin orifice 96 located in the center of the mating pin 24 that aligns with the barrel channel 27 with a predetermined outside diameter such that the mating pin orifice 96 and the barrel channel 27 cooperate to provide fluid communication from the mating pin orifice 96 at the mating pin second end 98 to the compressed gas valve cavity 33 to allow compressed gas from the compressed gas source means 163 to flow from the mating pin orifice 96 to the compressed gas valve cavity 31

As shown in FIGS. 2 thru 5, the compressed gas valve retaining means 221 comprises a bore cap 40 and a bore cap retaining ring 41. The bore cap 40 having a first bore cap end 143 and having a second bore cap end 144. The bore cap 40 being made from metal or metal alloy material having a cylindrical shape with a predetermined exterior length, starting at the first bore cap end 143, of a predetermined outside diameter that is substantially the same as the predetermined inside diameter of the compressed gas valve cavity 33 such that the first bore cap end 143 can be received in the compressed gas valve cavity 33 at the second barrel end 95, with a remaining exterior length of the bore cap 40 of a predetermined outside diameter that is less than the predetermined outside diameter of the predetermined exterior length of the bore cap 40 to form an L-shaped ledge along the exterior of the bore cap 40 that extends from the predetermined exterior length of the bore cap 40 to the second bore cap end 144, with a circular opening situated in the center of the bore cap 40 having a predetermined diameter, with a circular cavity in the first bore cap end 143 having a predetermined depth and a predetermined diameter, and with a plurality of bore cap vents 39, the bore cap vent 39 having a predetermined shape with a predetermined depth being situated along the exterior surface of the bore cap 40 such that the bore cap vent 39 extends from the second bore cap end 144 a predetermined length that transverses the remaining exterior length and part of the predetermined exterior length of the bore cap 40. The bore cap retainer ring 41 being substantially washer shaped that is made from metal or metal alloy or polymer material with a predetermined width and a predetermined outside diameter that cooperates with the predetermined width and the predetermined depth of the bore cap retainer ring groove 149 in the compressed gas valve cavity 33 such that the bore cap retainer ring 41 is received and captured in the bore cap retainer ring groove 149 and with an opening in the center of the bore cap retainer ring 41 having a predetermined diameter of the opening in the center of the bore cap retainer ring 41 that is less than the predetermined outside diameter of the predetermined exterior length of the bore cap 40 and is more than the predetermined outside diameter of the remaining exterior length of the bore cap 40 whereby that the bore cap retainer ring groove 149 and the bore cap retainer ring 41 cooperate to captured the bore cap 40 inside of the compressed gas valve cavity 33 by situating the bore cap retainer ring 41 between the second bore cap end 144 and the second barrel end 95 while allowing the remaining exterior length of the bore cap 40 to extend through the opening in the center of the bore cap retainer ring 41.

As shown in FIG. 2, the preferred embodiment of the compressed gas valve means 157 comprises a compressed gas valve assembly 125. In FIG. 2, the compressed gas valve assembly 125 is shown in the first valve assembly position, which is the position of the compressed gas valve assembly when the slide 12 is situated at its rest position. FIG. 5 shows the preferred embodiment of the compressed gas valve assembly 125 in the second valve assembly position, which is the position of the compressed gas valve assembly 125 when the slide 12 is situated at its open position. The compressed gas valve assembly 125 comprises a compressed gas valve sealing means 174, an extender channel insert 130, a barrel seal 28, a barrel seal keeper 29, an inner cylinder 56, an inner cylinder seal 126, a piston 34, a piston seal 35, a striker 37 and a striker seal 38. The compressed gas valve sealing means 174 cooperates with the barrel seal 28 to contain the compressed gas within the first gas chamber 26 until the firing pin 16 strikes the striker 37 whereby the force from the firing pin 16 causes the striker 37 to push the compressed gas valve sealing means 174 away from the barrel seal 28 to create a path for the compressed gas to flow into the compressed gas valve assembly 125 until the pressure from the compressed gas pushes the piston 34 toward the second barrel end 95, which also pushes the striker toward the barrel second end 95, so that the compressed valve sealing means 174 moves toward the barrel seal 28 until the compressed valve sealing means 174 comes in contact with the barrel seal 28 to close the path of the compressed gas and contain the compressed gas in the first gas chamber 26 once again.

As shown in FIG. 2, the preferred embodiment for the compressed gas valve sealing means 174 comprises a spacer 32, a first barrel spring 31 and a barrel ball 30. The spacer 32 having a first spacer end 172 and a second spacer end 173. The spacer 32 being made from metal or metal alloy or polymer material having a cylindrical shape with a predetermined exterior length of a predetermined outside diameter, starting at the first spacer end 172, that is substantially the same as the predetermined inside diameter of the first gas chamber 26 such that the spacer 32 is received in the first gas chamber 26 where the first spacer end 172 is the closest to the laser module cavity 42 and with the remaining exterior length of the spacer 32 having a predetermined outside diameter that is less than the predetermined diameter of the predetermined length of the spacer 32 such that the remaining exterior length of the spacer 32 extends from the predetermined exterior length to the second spacer end 173. The first barrel spring 31 being made from metal or metal alloy material having a predetermined shape that is substantially a helix shape with a predetermined inside diameter of the first barrel spring 31 that is larger than the predetermined diameter of the remaining length of the spacer 32 and having a predetermined outside diameter of the first barrel spring 31 that is less than the predetermined inside diameter of the first gas chamber 26 such that the first barrel spring 31 is received onto remaining length of the spacer 32, beginning at the second spacer end 173, within the first gas chamber 26. The barrel ball 30 being made from metal or metal alloy or polymer material having a spherical shape with a predetermined diameter that is less than the predetermined inside diameter of the first gas chamber 26 such that the barrel ball 30 is received within the first gas chamber 26, at the end of the first gas chamber 26 adjacent to the compressed gas valve cavity 33, and is in substantial contact with one end of the first barrel spring 31 such that the combination of the end of first gas chamber 26, the spacer 32 and the first barrel spring 31 cooperate to push the barrel ball 30 in a predetermined horizontal direction where the predetermined horizontal direction is substantially toward the compressed gas valve cavity 33.

Another embodiment of the compressed gas valve sealing means 174 is shown in FIG. 5 and comprises a barrel tappet 92 and a first barrel spring 31 such that the barrel tappet 92 replaces both the spacer 32 and the barrel ball 30. The barrel tappet 92 being made from metal or metal alloy or polymer material having a cylindrical shape with a predetermined exterior length of a predetermined outside diameter that is less than the inside diameter of the first barrel spring 31 such that the predetermined exterior length is received in the first barrel spring 31 and with a remaining exterior length of a predetermined outside diameter that is substantially the same as the predetermined inside diameter of the first gas chamber 26 such that the barrel tappet 92 is received in the first gas chamber 26 where the remaining exterior length of the barrel tappet 92 is adjacent to the compressed gas valve cavity 33.

As shown in FIG. 2 and FIG. 5, the extender channel insert 130 having an extender channel insert first end 145 and an extender channel insert second end 146. The extender channel insert 130 being made from metal or metal alloy or polymer material having a cylindrical shape with a predetermined exterior length, starting at the extender channel insert second end 146, of a predetermined outside diameter that is substantially the same as the predetermined inside diameter of the compressed gas valve cavity 33, with a remaining exterior length of a predetermined outside diameter that is less than the predetermined outside diameter of the predetermined exterior length of the extender channel insert 130 to form an L-shaped ledge along the exterior of the extender channel insert 130 that extends from the predetermined exterior length of the extender channel insert 130 to the extender channel insert first end 145, with a circular opening situated in the center of the extender channel insert 130 having a predetermined diameter that is the same as the predetermined inside diameter of the first gas chamber 26 and with an extender channel insert opening 131 being situated in a predetermined location in the extender channel insert 130 such that the extender channel insert opening 131 provides fluid communication from the exterior of the extender channel insert 130 to the circular opening in the center of the extender channel insert 130. The extender channel insert 130 being received in the compressed gas valve cavity 33 such that the extender channel insert second end 146 is situated adjacent to the first gas chamber 26 whereby the circular opening in the extender channel insert 130 provides fluid communication between the first gas chamber 26 and the compressed gas valve cavity 33.

As shown in FIG. 2 and FIG. 5, the barrel seal 28 being washer shaped is made from polymer material, the barrel seal 28 having a predetermined width, a predetermined outside diameter, and a predetermined diameter of the opening in the center of the barrel seal 28 such that the predetermined diameter of the opening in the center of the barrel seal 28 is less than the predetermined diameter of the barrel ball 30 or the predetermined outside diameter of the remaining exterior length of the barrel tappet 92.

As shown in FIG. 2 and FIG. 5, the barrel seal keeper 29 having a barrel seal keeper first end 147 and a barrel seal keeper second end 148. The barrel seal keeper 29 being made from metal or metal alloy or polymer material having a cylindrical shape with a predetermined exterior length, starting at the barrel seal keeper second end 148 of a predetermined outside diameter that is substantially the same as the predetermined outside diameter of the remaining length of the extender channel insert 130, with a remaining exterior length of the barrel seal keeper 29 of a predetermined outside diameter that is less than the predetermined outside diameter of the predetermined exterior length of the barrel seal keeper 29 to form an L-shaped ledge along the exterior of the barrel seal keeper 29 that extends from the predetermined exterior length of the barrel seal keeper 29 to the barrel seal keeper first end 147, with a circular opening situated in the center of the barrel seal keeper 29 having a predetermined diameter of the circular opening in the barrel seal keeper 29 that is substantially the same diameter as the predetermined diameter of the opening in the barrel seal 28, and with a barrel seal keeper cavity 175 in the barrel seal keeper second end 148 having a cylindrical shape with a predetermined depth and a predetermined inside diameter of the barrel seal keeper cavity 175, the predetermined inside diameter of the barrel seal keeper cavity 175 is substantially the same as the predetermined outside diameter of the barrel seal 28 such that the barrel seal keeper cavity 175 receives the barrel seal 28, at the barrel seal keeper second end 148, where the barrel seal keeper 29 and the barrel seal 28 being received in the compressed gas valve cavity 33 such that the barrel seal keeper second end 148 and the barrel seal 28 are adjacent to the extender channel insert first end 145 and such that the barrel seal keeper 29 engages the barrel seal 28 with the barrel ball 30 or barrel tappet 92 and directs the barrel ball 30 or the barrel tappet 92 toward the first barrel spring 31 thereby compressing the first barrel spring 31 until the barrel seal 28 seats against the extender channel insert first end 145.

As shown in FIG. 2 and FIG. 5, the inner cylinder 56 having a first inner cylinder end 127 and a second inner cylinder end 128. The inner cylinder 56 being made from metal or metal alloy or polymer material having a substantially tubular shape with a predetermined inside diameter of the inner cylinder 56 that is substantially the same as the predetermined outside diameter of the remaining exterior length of the barrel seal keeper 29 such that the interior of the second inner cylinder end 128 is received onto the remaining exterior length of the barrel seal keeper 29 at the barrel seal keeper first end 147 inside the compressed gas valve cavity 33. The inner cylinder 56 having a predetermined exterior length of a predetermined outside diameter that is substantially the same as the predetermined outside diameter of the predetermined exterior length of the barrel seal keeper 29 that starts at the second inner cylinder end 128, having a remaining exterior length of a predetermined outside diameter that is the substantially the same as the inside diameter of the compressed gas valve cavity 33 that extends from the predetermined exterior length of the inner cylinder 56 to the first cylinder end 127 to form an L-shaped ledge along the exterior of the inner cylinder 56 that extends from the remaining exterior length of the inner cylinder 56 to the second inner cylinder end 128 such that the remaining exterior length of the inner cylinder 56 and the interior of the compressed gas valve cavity 33 are substantially close to each other, and having an inner cylinder groove 129 being situated in a predetermined location in the exterior of the remaining exterior length of the inner cylinder 56 with a predetermined depth and a predetermined width, whereby the exterior of the remaining exterior length of the extender channel insert 130, the exterior of the predetermined exterior length of the barrel seal keeper 29, the exterior of the inner cylinder 56 and the inside of the compressed gas valve cavity 33 cooperate to form a second gas chamber 150.

As shown in FIG. 2 and FIG. 5, the inner cylinder seal 126 being made from polymer material having the shape of an o-ring with a predetermined inside diameter and a predetermined outside diameter, the inner cylinder seal 126 being received in the inner cylinder groove 129 such that the predetermined diameter of the remaining exterior length of the inner cylinder 56, at the first inner cylinder end 127, places the inner cylinder seal 126 in substantial contact with the interior surface of the compressed gas valve cavity 33 to seal one end of the second gas chamber 150 such that the compressed gas is retained in the second gas chamber 150.

As shown in FIG. 2 and FIG. 5, the piston 34 has a first piston end 133 and a second piston end 134. The piston 34 being made from metal or metal alloy or polymer material having a cylindrical shape with a predetermined exterior length, at the second piston end 134, of a predetermined outside diameter of the piston 34 that is substantially the same as the predetermined inside diameter of inner cylinder 56, is smaller than the inside diameter of the circular cavity in the bore cap 40 that is situated in the first bore cap end 143 and is substantially larger than the predetermined diameter of the circular opening situated in the center of the bore cap 40 to allow the second piston end 134 to be received in the bore cap cavity in the first bore cap end 143 but is prevented from passing through the circular opening in the bore cap 40; with a remaining exterior length with a predetermined outside diameter of the piston 34 where the predetermined outside diameter of the piston 34 is substantially the same as the predetermined diameter of the circular opening situated in the center of the bore cap 40, which is less than the inside diameter of the inner cylinder 56 and is less than the predetermined outside diameter of the predetermined exterior length of the piston 34, to form an L-shaped ledge along the exterior of the piston 34 that extends from the predetermined exterior length of the piston 34 to the first piston end 133 such that the predetermined exterior length of the piston 34 and the interior of the inner cylinder 56 are substantially close to each other so that the piston 34 is received inside the inner cylinder 56; with a piston opening 135 where the piston opening 135 being a circular opening situated in the center of the piston 34 with a predetermined diameter; with a piston seal groove 132 being situated in a predetermined location, substantially close to the second piston end 134, in the predetermined exterior length of the piston 34 with a predetermined width and a predetermined depth; and with a piston vent 36 where the piston vent 36 being an opening with a predetermined shape situated in a predetermined location in the remaining exterior length of the piston 34 that is substantially closer to the second piston end 134 than to the first piston end 133 such that the piston vent 36 provides fluid communication between the piston opening 135 and the exterior of the piston 34 whereby the piston vent 36 vents the compressed gas from the inside of the piston 34 to the outside of the piston 34 into the compressed gas valve cavity 33 and whereby the remaining exterior length of the piston 34, at the first piston end 133, is slidably received in the circular opening situated in the center of the bore cap 40 where the circular opening in the bore cap 40 retains the piston 34 in the compressed gas valve cavity 33 and guides the piston 34 as it moves within the compressed gas valve cavity 33 and where the predetermined diameter of the predetermined exterior length of the piston 34 limits the piston's 34 travel toward the second barrel end 95 when the predetermined exterior length of the piston 34 is received in the circular cavity in the first bore cap end 143.

As shown in FIG. 2 and FIG. 5, the piston seal 35 being made from polymer material having the shape of an o-ring with a predetermined inside diameter and a predetermined outside diameter to allow the piston seal 35 to be received in the piston groove 132 such that the predetermined diameter of the predetermined length of the piston 34, at the second piston end 134, places the piston seal 35 in substantial contact with the interior surface of the inner cylinder 56 to seal the piston 34, at the second piston end 134, such that the compressed gas is prevented from passing between the exterior surface of the piston 34, at the second piston end 134, and the interior surface of the inner cylinder 56.

As shown in FIG. 2 and FIG. 5, the striker 37 being made from metal or metal alloy or polymer material having a cylindrical shape with a first striker end 140 and a second striker end 141. The striker 37 having a first striker section 136, a second striker section 137, a third striker section 138, a fourth striker section 139 and a striker groove 142. As shown in FIG. 2, the first striker section 136 is situated such that one end of the first striker section 136 is the first striker end 140. The second striker section 137 is situated such that the other end of the first striker section 136 is connected to one end of the second striker section 137. The third striker section 138 is situated such that the other end of the second striker section 137 is connected to one end of the third striker section 138. The fourth striker section 139 is situated such that the other end of the third striker section 138 is connected to one end of the fourth striker section 139 and the other end of the fourth striker section 139 is the second striker end 141. The striker groove 142 being situated at a predetermined location in the exterior surface of the fourth striker section 139 with a predetermined width and a predetermined depth. The first striker section 136 having a predetermined length of a predetermined diameter that is less than the predetermined diameter of the opening in the barrel seal 28 and the predetermined diameter of the circular opening in the first barrel keeper 26 such that the first striker section 136 can pass through the opening in the first barrel keeper 26 and the opening in the barrel seal 28 to allow the first striker end 140 to clime into contact with the barrel ball 30 or barrel tappet 92 whereby the first striker end 140 pushes the barrel ball 30 or barrel tappet 92 along the predetermined horizontal plane to direct the barrel ball 30 or barrel tappet 92 toward the first barrel end 94 and away from the barrel seal 28 such that the barrel ball 30 or the barrel tappet 92 compresses the first barrel spring 31 and such that fluid communication between the first gas chamber 26 and compressed gas valve cavity 33 is created to allow the compressed gas to flow from the first gas chamber 26 into the compressed gas valve cavity 33 through the opening in the barrel seal 28 and the opening in the barrel seal keeper 29. The second striker section 137 having a predetermined diameter, such that the predetermined diameter is substantially the same as the predetermined diameter of the piston opening 135 to allow the striker 37 to be received inside the piston opening 135, of a predetermined length where the predetermined length allows the second striker section to cover the piston vent 36 to prevent fluid communication between the piston opening 135 and the compressed gas valve cavity 33 when the first striker end 140 comes in contact with the barrel ball 30 or the barrel tappet 92. The third striker section 138 having a predetermined length of a predetermined diameter that is substantially less than the predetermined diameter of the piston opening 135 and that is substantially less than the predetermined diameter of the second striker section 137. The fourth striker section 139 having a predetermined length of a predetermined diameter such that the predetermined diameter is substantially the same as the predetermined diameter of the second striker section 137 and is substantially the same as the inside diameter of the piston opening 135 to allow the striker 37 to be received inside the piston opening 135. The striker groove 142 being a channel shaped opening situated in a predetermined location in the exterior surface of the fourth striker section 139 having a predetermined depth and a predetermined width.

As shown in FIG. 2 and FIG. 5, the striker seal 38 being made from polymer material having the shape of an o-ring with a predetermined inside diameter and a predetermined outside diameter with the striker seal 38 being received in the striker groove 142 such that the predetermined diameter of the fourth striker section 139 places the striker seal 38 in substantial contact with the interior surface of the piston opening 135 to seal the striker 37, at the first piston end 133 and at the second striker end 141, to prevent compressed gas from passing between the exterior surface of the striker 37 and the interior surface of the piston opening 135.

As shown in FIG. 2, the spacer 32, the first barrel spring 31 and the barrel ball 30 or, as shown in FIG. 5, the first barrel spring 31 and the barrel tappet 92 in combination with the extender channel insert 130, the barrel seal 28, the barrel seal keeper 29, the inner cylinder 56, the inner cylinder seal 126, the piston 34, the piston seal 35, the striker 37, the striker seal 38 and the bore cap 40 cooperate to retain compressed gas at a predetermined pressure in the first gas chamber 26, cooperate with the firing pin 16 to open the flow path for the compressed gas from the first gas chamber 26 to the compressed gas valve cavity so that the pressure of the compressed gas can interact with piston 34 and the striker 37 to push the piston and striker from the first valve assembly position, which corresponds to rest position of the slide 17, to the second valve assembly position, which corresponds to the open position of the slide 17, and cooperate to close the flow path of the compressed gas so that the compressed gas is once again retained in the first gas chamber 26 and to vent the compressed gas received in the compressed gas valve cavity 33 thru the plurality of bore vents 39 so that the means for actuating the slide 162 can move the piston 34 and the striker 37 from the second valve assembly position to the first valve assembly position.

Figure 13:
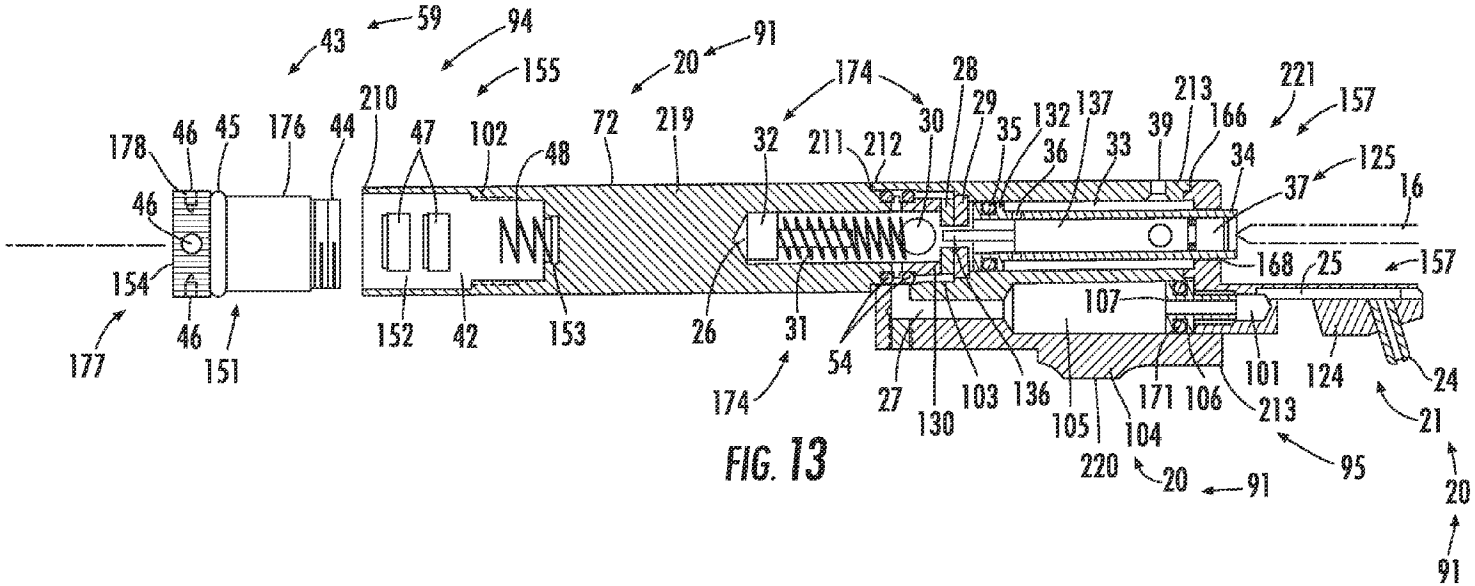
FIG. 13 is a schematic side elevation view of a sixth embodiment of the barrel unit wherein the barrel unit comprises multiple pieces.

As shown in FIG. 13, the firing mechanism actuated laser beam pulse emitting means 59 being received in the first laser module cavity 152 of the laser module cavity 42, at the first barrel end 94, so that the firing mechanism actuated laser beam pulse emitting means 59 emits a predefined laser beam pulse in response to the cooperation between the firing mechanism 122, the compressed gas valve means 157 and the slide mechanism 123 thereby producing a predefined laser beam pulse on a target to simulate the firing a of weapon in the weapon simulator 10. In the preferred embodiment, the input that triggers the firing mechanism actuated laser beam pulse emitting means 59 is the vibration in the frame 11 from the cooperation between the firing mechanism 122, the compressed gas valve means 157 and the slide mechanism 123 when the shooter engages the firing mechanism 122, whereby the firing mechanism actuated laser beam pulse emitting means 59 contains a vibration switch, with a predefined vibration response, that responds to the vibration in the weapon simulator 10 such that the firing mechanism actuated laser beam pulse emitting means 59 emits the predefined laser beam upon sensing the vibration in the frame 11 that occurs when the weapon simulator 10 is operated. Other inputs can be used to trigger the firing mechanism actuated laser beam pulse emitting means 59 such as electrical inputs, radio signal inputs, or pressure inputs. Once actuated, the predefined laser pulse from the actuated laser beam pulse emitting means 59 is used to trip a target in order to simulate live ammunition fire.

As shown from FIG. 13, the preferred embodiment of the firing mechanism actuated laser beam pulse emitting means 59 is a laser module 43 and a laser power source means 155. Other embodiments of the firing mechanism actuated laser beam pulse emitting means 59 can be used in the weapon simulator depending on the input actuation method used.

From FIG. 13, the laser module 43 comprises a laser beam module housing 176, a laser beam pulse means 151, a laser beam alignment means 177 and a laser module friction ring 45. As shown in FIG. 13, the preferred embodiment of the laser beam module housing 176 being made from metal or metal alloy or polymer material having a cylindrical shape with a predetermined exterior length of a predetermined outside diameter that will allow the laser beam module housing 176 to be received inside the first laser module cavity 152, with a remaining exterior length of a predetermined outside diameter having a plurality of laser module threads 44 being situated in a predetermined location on the exterior surface of the remaining exterior length of the laser beam module housing 176 such that the laser module threads 44 mate with a plurality of the laser module cavity threads 102 in the first laser module cavity 152 and with an opening through the center of the laser beam module housing 176 having a predetermined shape that is substantially circular in shape with a predetermined inside diameter and having a plurality of opening threads situated in a predetermined location on the interior surface of the opening at the end of the opening that is closest to the first barrel end 94. The laser beam pulse means 151 having a predetermined shape that is substantially cylindrical in shape with a predetermined diameter that is substantially the same as the predetermined diameter of the opening in the center of the laser beam module housing 176 where that the laser beam pulse means 151 is received in the opening in the center of the laser beam module housing 176 such that the one end of the laser beam pulse means 151 emits a laser beam for a predetermined time period out of the second barrel end 94 upon receiving an input which activates the laser beam pulse means 151 and such that the other end of the laser beam pulse means 151 is accessible to the laser power source means 155 to receive power from the laser power source means 155. As shown in FIG. 13, the laser beam alignment means 177 is received in one end of the laser beam module housing 176 to alien the laser beam emitted by the laser beam pulse means 151 such that the laser beam is aligned to be in the same horizontal plane as the barrel 20. As shown in FIG. 13, the preferred embodiment of the laser beam alignment means 177 comprises a laser beam alignment housing 154 and a plurality of laser beam alignment screws 46. The laser beam alignment housing 154 being made of metal or metal alloy or polymer material having a cylindrical shape with a predetermined exterior length of a predetermined outside diameter that is substantially the same as the predetermined outside diameter of the barrel 20, with a remaining exterior length of a predetermined outside diameter having a plurality of threads being situated in a predetermined location on the exterior surface of the remaining exterior length of the laser beam alignment housing 154 such that the threads on the remaining exterior length of the laser beam alignment housing 154 mate with a plurality of the opening threads in the laser beam module housing 176 so that the laser beam alignment housing 154 is received on the end of the laser beam module housing 176 closest to the first barrel end 94, with an opening through the center of the laser beam alignment housing 154 having a predetermined shape that is substantially circular in shape with a predetermined inside diameter that is substantially the same as the predetermined inside diameter of the opening in the laser beam module housing 176 and with a plurality of laser beam alignment threaded openings 178 situated in predetermined locations in the predetermined exterior length of the laser beam alignment housing 154 such that the laser beam alignment threaded opening 178 provides a path from the exterior of the laser beam alignment housing 154 to the opening in the center of the laser beam alignment housing 154. As shown in FIG. 1 and FIG. 13, the plurality of laser beam alignment screws 46 being made from metal or metal alloy having a predetermined shape that is substantially cylindrical in shape with a point at one end and a slot at the other end where the laser beam alignment screws 46 are received in the laser beam alignment threaded opening 178 with the slotted end closest to the exterior of the laser beam alignment housing 154 so that the laser beam alignment threaded openings 178 and the laser beam alignment screws 46 cooperate to align the laser beam emitted by the laser beam pulse means 151 such that the laser beam is aligned to be in the same horizontal plane as the barrel 20. As shown in FIG. 13, the laser module friction ring 45 being made from polymer material having the shape of an o-ring with a predetermined inside diameter and a predetermined outside diameter, the laser module friction ring 45 being received between the laser beam module housing 176 and the laser beam alignment housing 154 such that the laser module friction ring 45 cooperates with the exterior of the laser beam module housing 176, the laser beam alignment housing 154 and the inside of the first laser module cavity 152 to retain the laser module 46 in the barrel 20 during the recoil of the weapon simulator 10. In the preferred embodiment, the laser beam pulse means 151 is activated by the vibration, from the cooperation of the firing mechanism 122, the compressed gas valve assembly 125 and the slide mechanism 123, to produce a predefined laser pulse out of the laser beam pulse means 151 that is aligned to be in the same horizontal plane as the barrel 20 by cooperation between the laser beam alignment threaded openings 178 and the laser beam alignment screws 46 in the laser beam alignment housing 154 that is received in the laser beam module housing 176 and retained in the laser module cavity 42 by the laser module friction ring 45.

As shown in FIG. 13, the laser power source means 155 being situated in the laser module cavity 42 such that the laser power source means 155 provides power to the laser beam pulse means 151 to allow the laser beam pulse means 151 to produce a laser beam for a predefined period of time. As shown in FIG. 13, the preferred embodiment of the laser power source means 155 comprises a laser battery spring 48 and a plurality of circular shaped batteries 47. Other embodiments of the laser power source means can be used in the weapon simulator such as the combination of a single battery 47 and laser battery spring 48 or an external source of electrical power. As shown in FIG. 2, FIG. 5 and FIG. 13, the laser battery spring 48 being made from metal or metal alloy material having a predetermined shape that is substantially a helix shape with a predetermined inside diameter and with a predetermined outside diameter for developing a predetermined amount of force when laser battery spring 48 is compressed where the predetermined outside diameter of the laser battery spring 48 is substantially the same as the outside diameter of the second laser module cavity 153 such that one end of the laser battery spring is received in the second laser module cavity 153 and extends from the second laser module cavity into the first laser module cavity 152. Shown in FIG. 5 is a plurality of circular shaped batteries 47 having a predetermined outside diameter that is less than the predetermined inside diameter of the remaining length of the first laser module cavity 152 to allow the plurality of circular shaped batteries 47 to be received in the remaining length of the first laser module cavity 152 where they are adjacent to each other so that the positive end of one battery is next to the negative end of another battery. The laser beam module housing 176 and the plurality of circular shaped batteries 47 cooperate to compress the laser battery spring 48 when the laser module threads 44 of the laser beam module housing 176 are engaged with the laser module cavity threads 102 thereby placing one end of the last the plurality of circular shaped batteries 47 into contact with the laser beam pulse means 151 whereby electricity from the batteries flow to the laser beam pulse means 151 to provide a source of electrical power to the laser beam pulse means 151.

As shown in FIG. 1, the simulation recoil spring 55 being made from metal or metal alloy wire having a spiral form in the shape of a cylinder having a predetermined inside diameter and a predetermined outside diameter for developing a predetermined amount of force by the simulation recoil spring 55 where the simulation recoil spring 55 being received in the weapon frame 11 such that the simulation recoil spring 55 cooperates with the weapon frame 11 and the slide mechanism 123 to return the slide 12 to the slide's rest position on the frame (11) after the compressed gas valve means 160 has forced the slide 12 to the slide's open position in response to the shooter pulling the trigger 17 of the firing mechanism 122. In the preferred embodiment, the simulation recoil spring 55 provides approximately 53 Newtons (12 pounds) of force which allows a standard 12 gram CO2 cartridge to provide around one hundred (100) simulated rounds of operating the slide mechanism 123. In other embodiments, the simulation recoil spring 55 can be changed to provide the required amount of force to work with the pressure of the compressed gas used in the weapon simulator 10.

As shown in FIG. 1, the simulation magazine unit 60 provides the energy, in the form of compressed gas, to operate the weapon simulator 10. As shown in FIG. 1 and FIG. 20, the simulation magazine unit 60 comprises a magazine frame 156, a magazine gas sealing means 160, a means for receiving the compressed gas from source 222 and a compressed gas source means 163. In the preferred embodiment, the magazine gas sealing means 160 comprises a magazine valve assembly 119, the means for receiving the compressed gas from source 222 comprises a cartridge engagement means 64 and the compressed gas source means 163 comprises a cartridge 61 such that cartridge 61 is retained in the cartridge engagement means 64 and cartridge 61 is sealably pierced by the magazine valve assembly 119 so that compressed gas flows from the cartridge 61 into the magazine valve assembly 119. The magazine valve assembly 119 and the cartridge 61 that is retained in a cartridge engagement means 64 are received in the magazine frame 156 so that the combination of the magazine frame 156, the magazine valve assembly 119 and the cartridge 61 that is retained in a cartridge engagement means 64 can be inserted and removed from the frame 11, as a single unit, as a replacement for the original magazine. The preferred cartridge 61 is filled with liquid CO2 compressed to a pressure of 41.4 bars to 82.8 bars (600 to 1,200 psi) that converts to gas when the CO2 is released from the cartridge 61. The cartridge 61 having a cartridge first end 181 and a cartridge second end 182. The cartridge 61 being received in the cartridge engagement means 64 prior to the magazine frame 156 being inserted into the frame 11 whereby the cartridge 61 provides the source of compressed gas to power the weapon simulator 10. The cartridge engagement means 64 retains and mates the cartridge first end 181 of the cartridge 61 with the magazine valve assembly 119 so that compressed gas from the cartridge 61 is allowed to flow into the magazine valve assembly 119 where the pressure of the compressed gas it is contained by the magazine valve assembly 119. When the magazine frame 156, with the cartridge 61 received in the cartridge engagement means 64, is inserted into the frame 11, the magazine valve assembly 119 sealably mates with the barrel 20 of the barrel unit 91 at the mating pin 24 to allow the compressed gas to flow from the magazine valve assembly 119 into the compressed gas valve means 157. As shown in FIG. 1 and FIG. 20, the preferred embodiment for the magazine frame 156 being made from metal or metal alloy having a magazine frame top 206 and a magazine frame bottom 207. The magazine frame top 206 having a predetermined shape to allow the magazine frame top 206 to be inserted first into the frame 11 such that the magazine frame top 206 mates with the barrel 20. The magazine frame bottom 207 having a predetermined shape such that the magazine frame bottom 207 is flush with the frame 11 when the magazine frame 156 is fully received in the frame 11. The magazine frame 156 having a predetermined shape that is substantially rectangular so that the magazine frame 156 can be inserted into the frame 11 of the weapon simulator 10. The magazine frame 156 having a magazine catch slot 70, a magazine valve keeper cavity 184, a magazine valve cavity 65, a magazine gas chamber 110, a gas supply opening 179 and a gas cartridge engagement opening 180. As shown in FIG. 1 and FIG. 20, the magazine slot 70 having a predetermined shape that is situated in a predetermined location in the magazine frame 156 such that the magazine slot 70 cooperates with the magazine catch 13 to removably retain the simulation magazine unit 60 in the frame 11. The magazine valve seal keeper cavity 184 having a predetermined shape and is situated in a predetermined location in the magazine frame top 206. As shown in FIG. 20, in the preferred embodiment the magazine valve seal keeper cavity 184 being cylindrical in shape with a predetermined inside diameter and a predetermined depth such that one end of the magazine valve seal keeper cavity 184 is situated at the exterior of the magazine frame 156 in the magazine frame top 206. The magazine valve cavity 65 having a predetermined shape and is situated in a predetermined location in the magazine frame 156 such that one end of the magazine valve cavity 65 is adjacent to and in fluid communication with the magazine valve seal keeper cavity 184. In the preferred embodiment, the magazine valve cavity 65 being substantially cylindrical in shape with a predetermined interior length of a predetermined inside diameter and with a remaining interior length of a predetermined inside diameter that is less than the predetermined diameter of the predetermined interior length of the magazine valve cavity 65. The magazine gas chamber 110 having a predetermined shape with a predetermined inside dimension that is situated in a predetermined location in the magazine frame 156 such that one end of the magazine gas chamber 110 is in fluid communication with the magazine valve cavity 65 and the other end is in fluid communication with the compressed gas source means 163. In the preferred embodiment of the magazine gas chamber 110 as shown in FIG. 20, the magazine gas chamber 110 receives the cartridge first end 181 at one end and enters the side of the magazine valve cavity 65 with a predetermined opening of a predetermined dimension at the end that is opposite from the end that received the cartridge first end 181. As shown in FIG. 1 and FIG. 20, the gas supply opening 179 having a predetermined shape that is situated in a predetermined location in the magazine frame 156 that is substantially in the center of the magazine frame 156 and is in fluid communication with the magazine gas chamber 110 such that the gas supply opening 179 and magazine gas chamber 110 cooperate to receive the cartridge 61 within the magazine frame 156 where the cartridge first end 181 is received in the magazine gas chamber 110 and the remainder of the cartridge 61 is received in the gas supply opening 179. As shown in FIG. 1 and FIG. 20, the gas cartridge engagement opening 180 having a predetermined shape that is situated in a predetermined location in the magazine frame bottom 207 having a plurality of threads along the interior of the cartridge engagement opening 180 such that the cartridge engagement means 64 is adjustably received in the magazine frame 156 through the cartridge engagement opening 180. As shown in FIG. 20, the magazine valve seal keeper cavity 184, the magazine valve cavity 65 and the magazine gas chamber 110 in the magazine frame 156 cooperate to receive the magazine valve assembly 119.

In the preferred embodiment shown in FIG. 20, the magazine valve assembly 119 comprises a magazine valve seal keeper 68, a magazine valve seal 67, a magazine valve ball 66, a magazine valve spring 69, a puncture pin assembly 63, a puncture pin seal 111 and a cartridge receptacle 183. The magazine valve spring 69 is optional and not required in all cases. The magazine valve seal keeper 68 being made from metal or metal alloy having a magazine valve seal keeper first side 185 and a magazine valve seal keeper second side 186 with a predetermined shape that is substantially the shape of a disk with a predetermined outside diameter where the magazine valve seal keeper 68 is received in the magazine valve seal keeper cavity 184 such that the magazine valve seal keeper first side 185 is flush with the magazine frame 156 and having a magazine valve mating receptacle 109 with a predetermined shape situated in a predetermined location in the magazine valve seal keeper 68 such that the magazine valve mating receptacle 109 receives the mating pin 24 when the simulation magazine unit 60 is received in the frame 11 where the predetermined shape of the magazine valve mating receptacle 109 in the preferred embodiment is a countersink shape with the largest diameter of the magazine valve mating receptacle 109 being situated at the magazine valve seal keeper first side 185 and where the smallest diameter of the magazine valve mating receptacle 109 being situated at the magazine valve seal keeper second side 186 and where the predetermined location in the preferred embodiment is such that the center of the magazine valve mating receptacle 109 is aligned with the center of the magazine valve seal keeper 68 where the smallest diameter of the magazine valve mating receptacle 109 is substantially the same as the predetermined outside diameter of the mating pin 24 such that the mating pin 24, as shown in FIG. 21, is received the magazine valve mating receptacle 109 when the magazine frame 156 is received in the frame 11 of the weapon simulator 10. The magazine valve seal keeper 68 is retained in the magazine frame 156 by an interference fit between the exterior of the magazine valve seal keeper 68 and the inside of the magazine valve seal keeper cavity 184 such that the magazine valve seal keeper 68 is pressed into the magazine valve seal keeper cavity 184, by a plurality of counter-sink screws received both in the magazine valve seal keeper 68 and in the magazine frame 156 or by set of mating threads on both the exterior of the magazine valve seal keeper 68 and the inside of the magazine valve seal keeper cavity 184. As shown if FIG. 20, the magazine valve seal 67 being made from polymer material having a magazine valve seal first side 187 and a magazine valve seal second side 188 with a predetermined shape that is substantially the shape of a washer with a predetermined outside diameter that is substantially the same as the predetermined inside diameter of the predetermined length of the magazine valve cavity 65 where the magazine valve seal 67 being received in the predetermined exterior length of the magazine valve cavity 65 such that the magazine valve seal first side 187 is adjacent to the magazine valve seal keeper second side 186 so that the magazine valve seal keeper 68 retains the magazine valve seal 67 within the magazine valve cavity 65 and with an opening in the center of the magazine valve seal 67 with a predetermined inside diameter that is less than the predetermined outside diameter of the mating pin 24 where the mating pin 24, as shown in FIG. 21, is received in the opening in the center of the magazine valve seal 67 such that the magazine valve seal 67 seals around the outside of the mating pin 24 to prevent compressed gas from escaping around the outside of the mating pin 24 when the mating pin 24 is received in the magazine valve mating receptacle 109. The magazine valve ball 66 being made from metal or metal alloy or polymer material having a spherical shape with a predetermined diameter that is less than the predetermined inside dimensions of the magazine valve cavity 65 where the magazine valve ball 66 being received within the magazine valve cavity 65 and that is more than the predetermined inside diameter of the opening in the center of the magazine valve seal 67 such that the magazine valve ball 66 is adjacent to and in contact with the magazine valve seal second side 188. The magazine valve spring 69 being made from metal or metal alloy material having a predetermined shape that is substantially a helix shape with a predetermined inside diameter that is less than the predetermined diameter of the magazine valve ball 66 and having a predetermined outside diameter of the magazine valve spring 69 that is less than the predetermined inside diameter of the magazine valve cavity 65 such that the magazine valve spring 69 being received in the remaining length of the magazine valve cavity 65 and is in substantial contact with one end of the magazine valve spring 69 such that the combination of the end of magazine valve cavity 65 and the magazine valve spring 69 cooperates to push on the magazine valve ball 66 in a predetermined direction where the predetermined direction is substantially toward the magazine valve seal 67. The use of the magazine valve spring 69 is not required in all embodiments of the apparatus 9.

As shown in FIG. 20, the puncture pin assembly 63 being made, from metal or metal alloy material having a predetermined shape that is substantially that of a hollow needle with a predetermined outside diameter that is substantially the same as the predetermined dimension of the magazine gas chamber 110 and with an opening in the center of the puncture pin assembly 63. The puncture pin assembly 63 being received in the magazine gas chamber 110 such that the when the cartridge engagement means 64 engages the cartridge 61 in the magazine frame 156 the puncture pin assembly 63 comes in contact with and punctures the cartridge first end 181 to allow compressed gas to flow from the cartridge 61 into the opening in the puncture pin assembly 63. The opening in the puncture pin assembly 63 having a predetermined inside diameter such that the opening provides for a predetermined flow rate of the compressed gas from the cartridge 61.

As shown in FIG. 20, the magazine gas chamber seal 111 is made from polymer material having the shape of an wring with a predetermined outside diameter that is more than the predetermined dimension of the magazine gas chamber 110 and an opening with a predetermined inside diameter that is less than the predetermined outside diameter of the puncture pin assembly 63 where the puncture pin assembly 63 is received in the opening in the magazine gas chamber seal 111. The cartridge receptacle 183 is made from metal or metal alloy material having a predetermined shape with a predetermined inside dimension that allows the cartridge receptacle 183 to receive and mate with the cartridge first end 181 and with a predetermined outside dimension that is substantially the same as the predetermined dimension of the end of the magazine gas chamber 110 adjacent to the gas supply opening 179 that allows the cartridge receptacle 183 to be received in the magazine gas chamber 110 and having an opening with a predetermined diameter that allows the sharp end of the puncture pin assembly 63 to be received in the opening and extended toward the gas supply opening 179 such that the combination of the cartridge receptacle 183, the puncture pin assembly 63 and the magazine gas chamber seal 111 cooperate to receive the cartridge first end 181, to puncture the cartridge first end 181 to allow compressed gas to flow from the cartridge 61 into the magazine gas chamber 110 and to prevent compressed gas from leaking from the puncture pin assembly 63, the cartridge receptacle 183 or the magazine gas chamber 110. The combination of the magazine valve cavity 184, the magazine valve seal keeper 68, the magazine valve cavity 65, the magazine valve seal 67, the magazine valve ball 66, the magazine valve spring 69, the magazine gas chamber 110, the puncture pin assembly 63, the magazine gas chamber seal 111, and the cartridge receptacle 183 cooperate to receive the gas cartridge first end 181, to puncture the cartridge first end 181, to provide a path for the flow of compressed gas from the cartridge 61 to the magazine valve mating receptacle 109 that is retained when the simulation magazine unit 60 is outside of the frame 11 of the weapon simulator 10 and is allowed to enter the mating pin 24 when the simulation magazine unit 60 is received in the frame 11 of the weapon simulator 10.

The cartridge engagement means 64 receives and retains the cartridge second end 182 and moves the cartridge 61 along a predetermined plane in the magazine frame 156 so that the cartridge first end 181 engages the puncture pin assembly 63 whereby the cartridge first end 182 is punctured and sealed by the combination of the cartridge receptacle 183, the puncture pin assembly 63 and the magazine gas chamber seal 111. As shown in FIG. 1 and FIG. 20, the preferred embodiment of the cartridge engagement means 64 comprises a cartridge engagement knob 112, a cartridge engagement rod 189 and a cartridge retainer 190. The cartridge engagement knob 112 is made from metal, metal alloy or polymer material having a predetermined shape that is substantially cylindrical with a predetermined length of a predetermined outside diameter, with a remaining length with a predetermined diameter that is less than the predetermined diameter of the predetermined length of the cartridge engagement knob 112 and with a threaded opening in the center of the remaining length of the cartridge engagement knob 112 of a predetermined diameter. The cartridge engagement knob 112 is used by the shooter to tighten and loosen the cartridge 61 in the magazine frame 156. The cartridge engagement rod 189 is made from metal, metal alloy or polymer material being substantially a threaded shaft with a predetermined outside diameter that is substantially the same as the predetermined inside diameter of the cartridge engagement opening 180 and the threaded opening in the center of the remaining length of the cartridge engagement knob 112 where one end of the cartridge engagement rod 189 is received in the remaining length of the cartridge engagement knob 112 so that the cartridge engagement rod 189 can be turned by the cartridge engagement knob 112 and where the cartridge engagement rod 189 mates with the threads on the interior of the cartridge engagement opening 180 to allow the gas cartridge engagement rod to be moved along a predetermined plane. The cartridge retainer 190 is made from metal, metal alloy or polymer having a predetermined shape to receive and retain the cartridge second end 182 where the cartridge retainer 190 being received on the end of the cartridge engagement rod 189 that is opposite of the end that is received in the cartridge engagement knob 112 such that the cartridge retainer 190 remains stationary while the cartridge engagement rod 189 rotates. The combination of the cartridge engagement knob 112, the cartridge engagement rod 189 and the cartridge retainer 190 cooperate to receive and retain the cartridge second end 182 and to move the cartridge 61 along a predetermined plane in the magazine frame 156 so that the cartridge first end 181 engages the puncture pin assembly 63 whereby the cartridge first end 182 is punctured and sealed by the combination of the gas cartridge receptacle 183, the puncture pin assembly 63 and the magazine gas chamber seal 111.

FIG. 21 shows the simulation magazine unit 60 received in the frame 11 and mated to the mating pin 24 of the barrel 20. As can be seen, the mating pin 24 extends through the magazine valve mating receptacle 109 and the magazine valve seal 67 so that the mating pin second end 98 pushes the magazine valve ball 66 away from the magazine valve seal 67 and toward the magazine valve spring 69. The mating pin second end 98 has a sine wave curvature shape where the end has the shape of a sine wave combined with a rounded edge. This sine wave curvature shape of the mating pin second end 98 allows a uniform quantity of compressed gas to enter the mating pin orifice 96 while the mating pin second end 98 is in contact with the magazine valve ball 66 which leads to predictable performance by the weapon simulator 10. If the mating pin second end 98 did not have this shape, the magazine valve ball 66 would substantially close off the mating pin second end 98 which would severely restrict or totally prevent the compressed gas from entering the mating pin orifice 96 and lead to the malfunction or failure of the weapon simulator 10.

Figure 6:
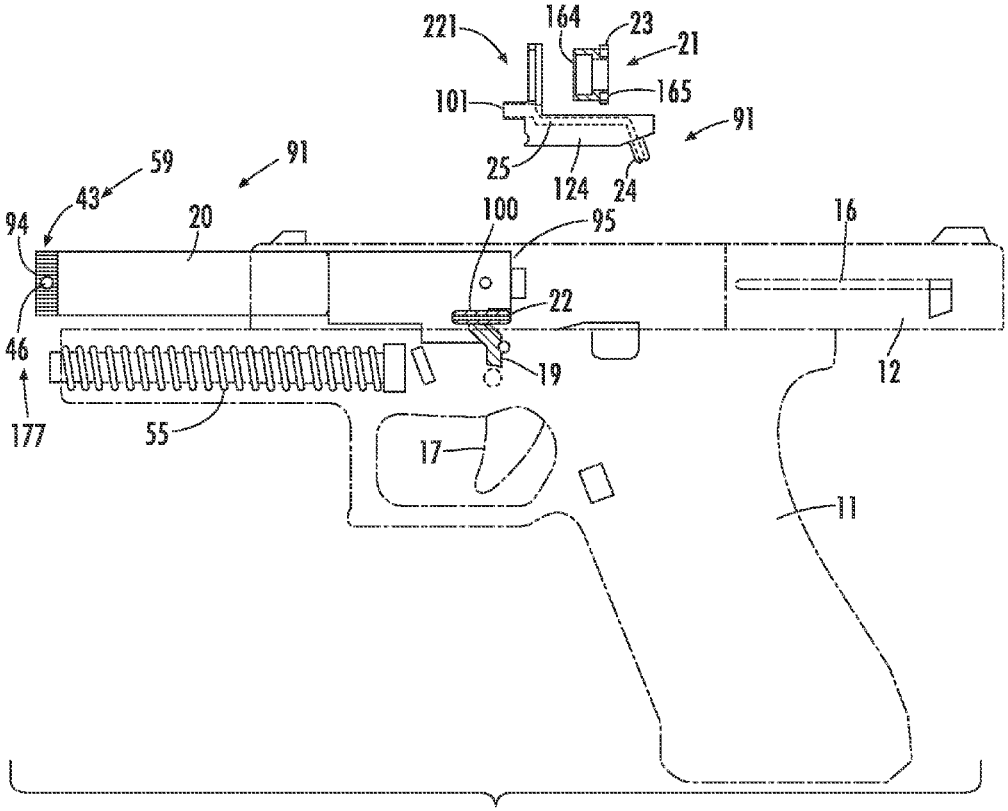
FIG. 6 is an exploded schematic side elevation view of a third embodiment of the barrel unit wherein the apparatus for converting a pistol into a weapon simulator utilizes a multiple piece barrel unit in order to allow the apparatus to be received in the pistol, which requires the slide to be in the open position to receive the barrel unit.
Figure 7:
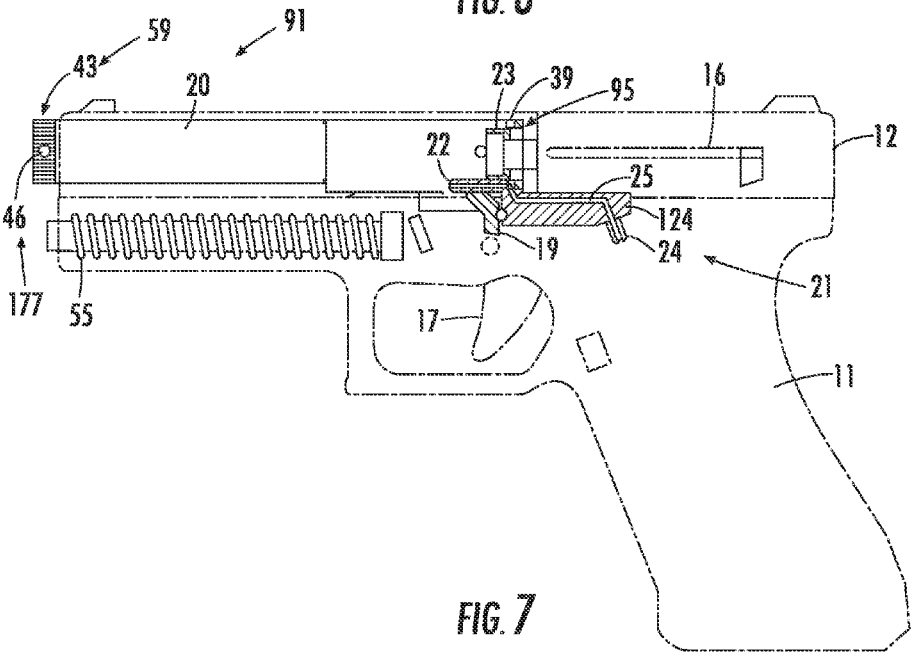
FIG. 7 is a schematic side elevation view of the third embodiment of the barrel unit shown in FIG. 6 wherein the multiple piece barrel unit of the apparatus for converting a pistol into a weapon simulator is received into the pistol and the slide is in the rest position to create the weapon simulator.

Another embodiment of the barrel unit 91 is shown in FIG. 6 and FIG. 7 where the barrel unit 91 is has a multiple-piece design to allow the barrel unit 91 to be received in a frame 11 that will not accommodate a one-piece barrel unit 91. In this embodiment of the present invention, the barrel unit 91 comprises a barrel 20, a compressed gas valve means 157, a compressed gas valve retaining means 221 and the firing mechanism actuated laser beam pulse emitting means 59. The compressed gas valve means 157 further comprises a compressed valve assembly 125. The compressed gas valve retaining means 221 further comprises a barrel extender seal 22, a barrel extender 21 and an extender mounting screw 23.

The barrel 20 having a laser module cavity 42, a first gas chamber 26, a compressed gas valve cavity 33, a barrel channel 27, and a first barrel extender seal chamber 100. The laser module cavity 42 is the same as previously described above. The compressed gas valve cavity 33 is situated at the second barrel end 95 having a cylindrical shape with a predetermined inside diameter, a bore vent 39 and a plurality of compressed gas valve cavity threads. The bore vent 39 is an opening in the compressed gas valve cavity 33 having a predetermined diameter in a predetermined location within the compressed gas valve cavity 33 such that the bore vent 29 provides a path to vent compressed gas from the compressed gas valve cavity 33 to the exterior of the barrel 20. The plurality of compressed gas valve cavity threads having a predetermined length of a predetermined outside diameter that are in a predetermined location in compressed gas valve cavity 33 such that the compressed gas valve cavity threads are substantially close to the second barrel end 95. The first gas chamber 26 is situated in the barrel 20 between the laser module cavity 42 and the compressed gas valve cavity 33 such that the first gas chamber 26 is in fluid communication with the compressed gas valve cavity 33, the first gas chamber 26 having a predetermined shape that is substantially cylindrical with a predetermined inside diameter. The barrel channel 27 having a predetermined shape in a predetermined location in the barrel 20 such that one end of the barrel channel 27 is situated at a predetermined location in the first gas chamber 26 and the other end of the barrel channel 27 is situated at one end of the first barrel extender seal chamber 100. The first barrel extender seal chamber 100 having a cylindrical shape with a predetermined length of a predetermined outside diameter in a predetermined location in the barrel bottom 220 where one end of the first barrel extender seal chamber 100 is in fluid communication with the barrel channel 27 and the other end of the first barrel extender seal chamber 100 is situated at the exterior of the barrel 20 at the barrel bottom 220.

The barrel extender seal 22 being made from a polymer material having a cylindrical shape of a predetermined length with a predetermined outside diameter that is substantially the same as the predetermined outside diameter of the first barrel extender seal chamber 100 such that one end of the barrel extender seal 22 is received in the first barrel extender seal chamber 100 to seal the first extender seal chamber 100 to retain the compressed gas and having an opening in the barrel extender seal 22 situated in the center of the barrel extender seal 22 with a predetermined inside diameter of the opening such that the predetermined inside diameter of the barrel extender seal 22 is substantially the same size as the barrel channel 27.

As shown in FIG. 6 and FIG. 7, the barrel extender 21 comprises a barrel extender base 124, a barrel extender channel 25, a second barrel extender seal chamber 101 and a mating pin 24. The barrel extender base 124 being made from metal or metal alloy material having a predetermined shape to allow the barrel extender 21 of the barrel 20 to be received in the frame 11, the barrel extender base 124 being situated in a predetermined location which is substantially at the second barrel end 95 and beneath the compressed gas valve cavity 33 such that the barrel extender 21 extends longitudinally beyond the second barrel end 95. The barrel extender channel 25 having a predetermined location in the barrel extender base 124 with a predetermined shape to provide fluid communication between a predetermined location on the exterior of the barrel extender base 124 to one end of the second barrel extender seal chamber 101. The mating pin 24 being made from metal or metal alloy or polymer material and being substantially cylindrical in shape with a predetermined length of a predetermined outside diameter, the mating pin 24 having a mating pin first end 97 where the mating pin first end 97 is attached to the barrel extender base 124 such that the mating pin 24 extends outward from the barrel extender base 124 at a predetermined angle, having a mating pin second end 98 with a predetermined shape that is substantially a sine wave shaped curvature where the sine wave has a predetermined height between the top of the sine wave and the bottom of the sine wave and a predetermined distance between the top of the sine wave and the bottom of the sine wave and has a predetermined radius of the curvature of the mating pin second end 98 and having a mating pin orifice 96 located in the center of the mating pin 24 with a predetermined outside diameter such that the mating pin orifice 96 and the barrel extender channel 25 cooperate to provide fluid communication from the mating pin second end 98 to the second barrel extender seal chamber 101 to allow compressed gas to flow from the mating pin orifice 95 to the second barrel extender seal chamber 101. The second barrel extender seal chamber 101 having a cylindrical shape with a predetermined length of a predetermined outside diameter in a predetermined location in the barrel extender 21 where one end of the second barrel extender seal chamber 101 is in fluid communication with the barrel extender channel 25 and the other end of the second barrel extender seal chamber 101 is situated at the exterior of be barrel extender 21 such that the other end of the barrel extender seal 22 is received in the second barrel extender seal chamber 101 to seal the second extender seal chamber 101 to retain the compressed gas, whereby the mating pin 24, the barrel extender channel 25, the second barrel extender seal chamber 101, the barrel extender seal 22, the first barrel extender seal chamber 100, and the barrel channel 27 cooperate to provide fluid communication between the mating pin second end 98 to the first gas chamber 26 to allow compressed gas to flow from the mating pin orifice 95 to the first gas chamber 26.

The extender mounting screw 23 having a first extender mounting screw end 164 and a second extender mounting screw end 165. The extender mounting screw 23 being made from metal or metal alloy material having a cylindrical shape with a plurality of threads being situated along a predetermined exterior length of the cylindrical shape, starting at the first extender mounting screw end 164, of a predetermined outside diameter that is substantially the same as the plurality of compressed gas valve cavity threads such that the plurality of threads on the first extender mounting screw end 164 are received in the plurality of compressed gas valve cavity threads to removably connect the barrel extender to the second barrel end 95, with a remaining exterior length of the extender mounting screw 23 of a predetermined outside diameter that is more than the predetermined outside diameter of the predetermined exterior length of the extender mounting screw 23 to form an L-shaped ledge along the exterior of the extender mounting screw 23 that extends from the remaining exterior length of the extender mounting screw 23 to the second extender mounting screw end 165, with a circular opening situated in the center of the extender mounting screw 23 having a predetermined diameter of the circular opening in the extender mounting screw 23 where the predetermined diameter of the circular opening is substantially the same as the predetermined outside diameter of the remaining exterior length of the piston 34 such that the remaining exterior length of the piston 34 is received in the circular opening of the extender mounting screw 23, and with a circular cavity in the first extender mounting screw end 164 having a predetermined depth and a predetermined diameter where the predetermined diameter of the circular cavity is larger than the predetermined outside diameter of the predetermined exterior length of the piston 34 such that the predetermined exterior length of the piston 34 can be received in the circular cavity of the extender mounting screw 23. The extender mounting screw 23 performs the same function in this embodiment of the invention as the bore cap 40 performed in the first embodiment, which is to retain the piston 34 in the compressed gas valve cavity 33 and to guide the piston 34 as it moves within the compressed gas valve cavity 33.

Figure 8:
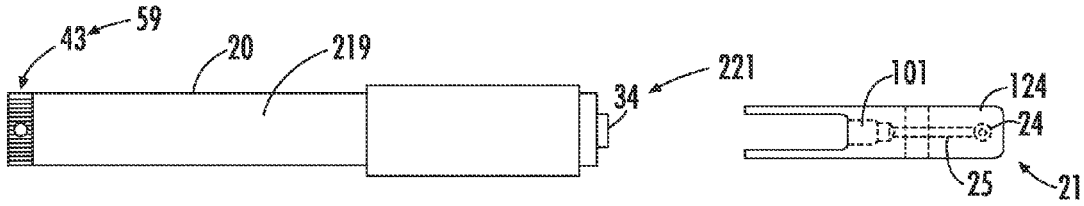
FIG. 8 is an exploded top perspective view of a fourth embodiment of the barrel unit wherein the barrel unit comprises multiple pieces.
Figure 9:
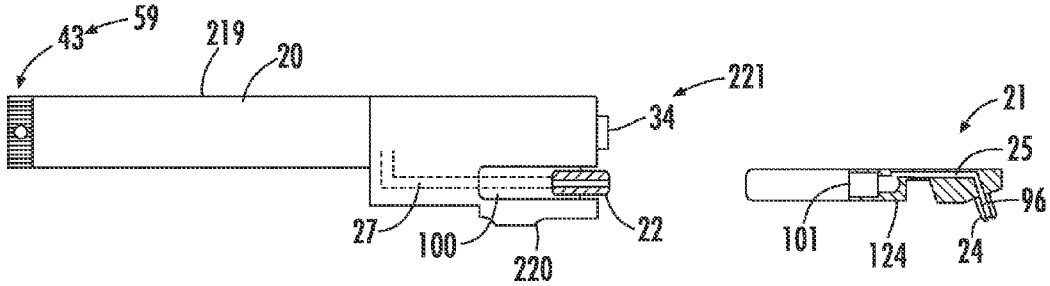
FIG. 9 is an exploded schematic side elevation view of the fourth embodiment of the barrel unit shown in FIG. 8.
Figure 10:
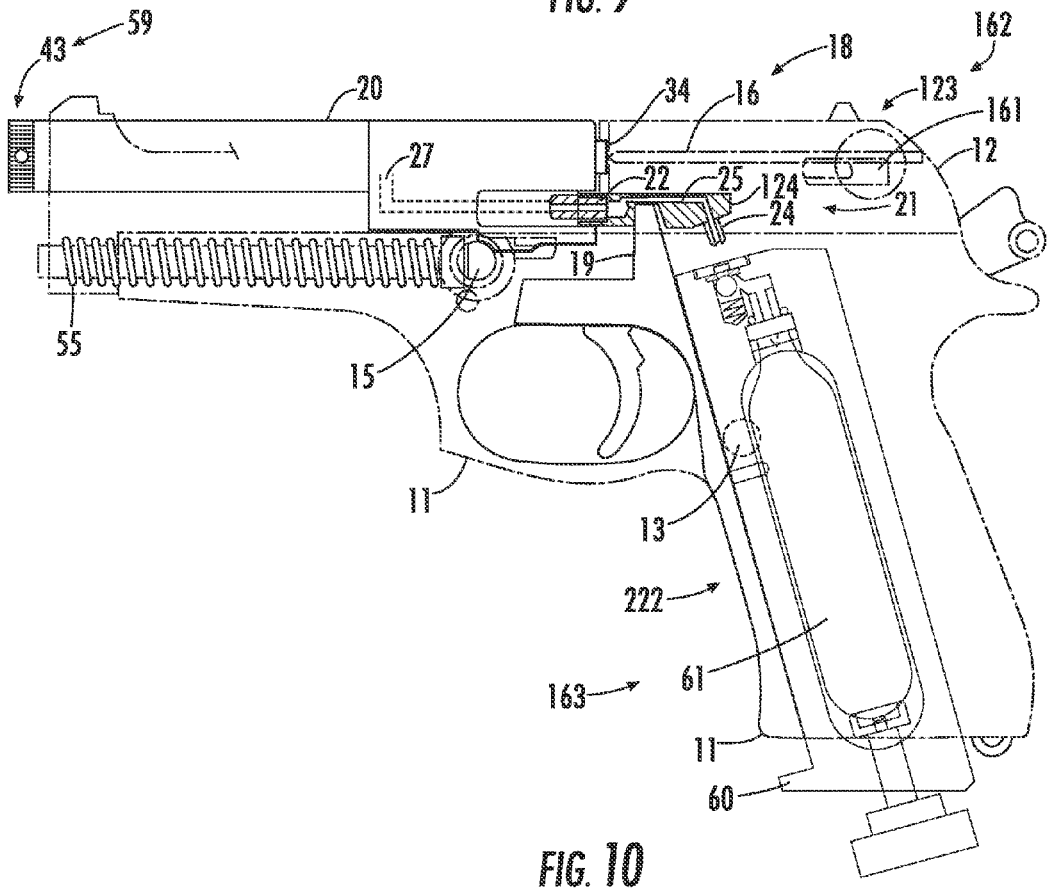
FIG. 10 is a schematic side elevation view of the fourth embodiment of the present invention wherein the apparatus for converting a pistol into a weapon simulator is received into the pistol using the multiple piece barrel unit shown in FIG. 8 and FIG. 9 to allow the barrel unit to be received in the pistol; and the slide is in the rest position to create the weapon simulator.

A third embodiment of the barrel unit 91 is shown in FIG. 8, FIG. 9 and FIG. 10 where the barrel 20 is has a two-piece design to allow the barrel unit 91 to be received in a frame 11 that will not accommodate a one-piece barrel unit 91. In this embodiment of the present invention, the barrel unit 91 comprises a barrel 20, a compressed gas valve means 157, a compressed gas valve retaining means 221 and the firing mechanism actuated laser beam pulse emitting means 59. The compressed gas valve means 157 further comprises a compressed valve assembly 125. The compressed gas valve retaining means 221 further comprises a barrel extender seal 22, a bore cap 40, a bore cap retainer ring 41 and a barrel extender 21.

The barrel 20 having a laser module cavity 42, a first gas chamber 26, a compressed gas valve cavity 33, a barrel channel 27, and a first barrel extender seal chamber 100. The laser module cavity 42 is the same as previously described above. The compressed gas valve cavity 33 is situated at the second barrel end 95 having a cylindrical shape with a predetermined inside diameter and having a bore cap retainer ring groove 149 in a predetermined location in compressed gas valve cavity 33 substantially close to the second barrel end 95 with a predetermined depth and a predetermined width. As shown in FIG. 8 thru FIG. 10, the barrel channel 27 having a predetermined shape in a predetermined location in the barrel 20 such that one end of the barrel channel 27 is situated at a predetermined location in the first gas chamber 26 and the other end of the barrel channel 27 is situated at one end of the first barrel extender seal chamber 100. The first barrel extender seal chamber 100 having a cylindrical shape with a predetermined length of a predetermined outside diameter in a predetermined location in the barrel 20 where one end of the first barrel extender seal chamber 100 is in fluid communication with the barrel channel 27 and the other end of the first barrel extender seal chamber 100 is situated at the exterior of the barrel 20. The barrel extender seal 22 being made from a polymer material having a cylindrical shape of a predetermined length with a predetermined outside diameter that is substantially the same as the predetermined outside diameter of the first barrel extender seal chamber 100 such that one end of the barrel extender seal 22 is received in the first barrel extender seal chamber 100 to seal the first extender seal chamber 100 to retain the compressed gas and having an opening in the barrel extender seal 22 situated in the center of the barrel extender seal 22 with a predetermined inside diameter of the opening such that the predetermined inside diameter of the barrel extender seal 22 is substantially the same size as the barrel channel 27.

As shown in FIG. 8 and FIG. 9, the barrel extender 21 comprising a barrel extender base 124, a barrel extender channel 25, a second barrel extender seal chamber 101 and a mating pin 24. The barrel extender base 124 being made from metal or metal alloy material having a predetermined shape to allow the barrel extender 21 of the barrel 20 to be received in the frame 11, the barrel extender base 124 being situated in a predetermined location which is substantially at the second barrel end 95 and beneath the compressed gas valve cavity 33 such that the barrel extender 21 extends longitudinally beyond the second barrel end 95. The barrel extender base 124 cooperates with the locking block 19 of the frame to removably connect the second barrel extender seal chamber 101, the barrel extender seal 22, and the first barrel extender seal chamber 100 together. The barrel extender channel 25 having a predetermined location in the barrel extender base 124 with a predetermined shape to provide fluid communication between a predetermined location on the exterior of the barrel extender base 124 to one end of the second barrel extender seal chamber 101. The mating pin 24 being made from metal or metal alloy or polymer material and being substantially cylindrical in shape with a predetermined length of a predetermined outside diameter, the mating pin 24 having a mating pin first end 97 where the mating pin first end 97 is attached to the barrel extender base 124 such that the mating pin 24 extends outward from the barrel extender base 124 at a predetermined angle, having a mating pin second end 98 with a predetermined shape that is substantially a sine wave shaped curvature where the sine wave has a predetermined height between the top of the sine wave and the bottom of the sine wave and a predetermined distance between the top of the sine wave and the bottom of the sine wave and has a predetermined radius of the curvature of the mating pin second end 98 and having a mating pin orifice 96 located in the center of the mating pin 24 with a predetermined outside diameter such that the mating pin orifice 96 and the barrel extender channel 25 cooperate to provide fluid communication from the mating pin second end 98 to the second barrel extender seal chamber 101 to allow compressed gas to flow from the mating pin orifice 95 to the second barrel extender seal chamber 101. The second barrel extender seal chamber 101 having a cylindrical shape with a predetermined length of a predetermined outside diameter in a predetermined location in the barrel extender 21 where one end of the second barrel extender seal chamber 101 is in fluid communication with the barrel extender channel 25 and the other end of the second barrel extender seal chamber 101 is situated at the exterior of he barrel extender 21 such that the other end of the barrel extender seal 22 is received in the second barrel extender seal chamber 101 to seal the second extender seal chamber 101 to retain the compressed gas, whereby the mating pin 24, the barrel extender channel 25, the second barrel extender seal chamber 101, the barrel extender seal 22, the first barrel extender seal chamber 100, and the barrel channel 27 cooperate to provide fluid communication between the mating pin second end 98 to the first gas chamber 26 to allow compressed gas to flow from the mating pin orifice 95 to the first gas chamber 26. The bore cap 40 and the bore cap retainer ring 41 are the same as previously described above in the first embodiment of the barrel unit 91.

Figure 11:
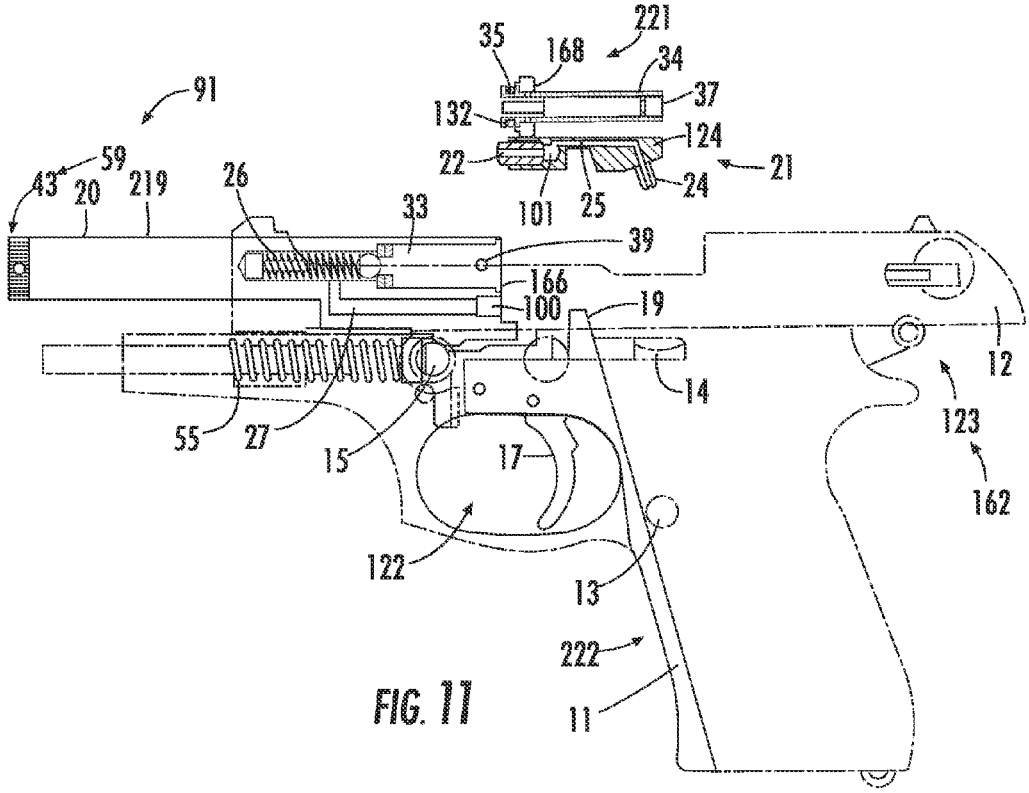
FIG. 11 is an exploded schematic side elevation view of a fifth embodiment of the present invention wherein the apparatus for converting a pistol into a weapon simulator utilizes a fifth embodiment of a multiple piece barrel unit in order to allow the barrel unit to be received in the pistol, which requires the slide to be in the open position to receive the barrel unit.
Figure 12:
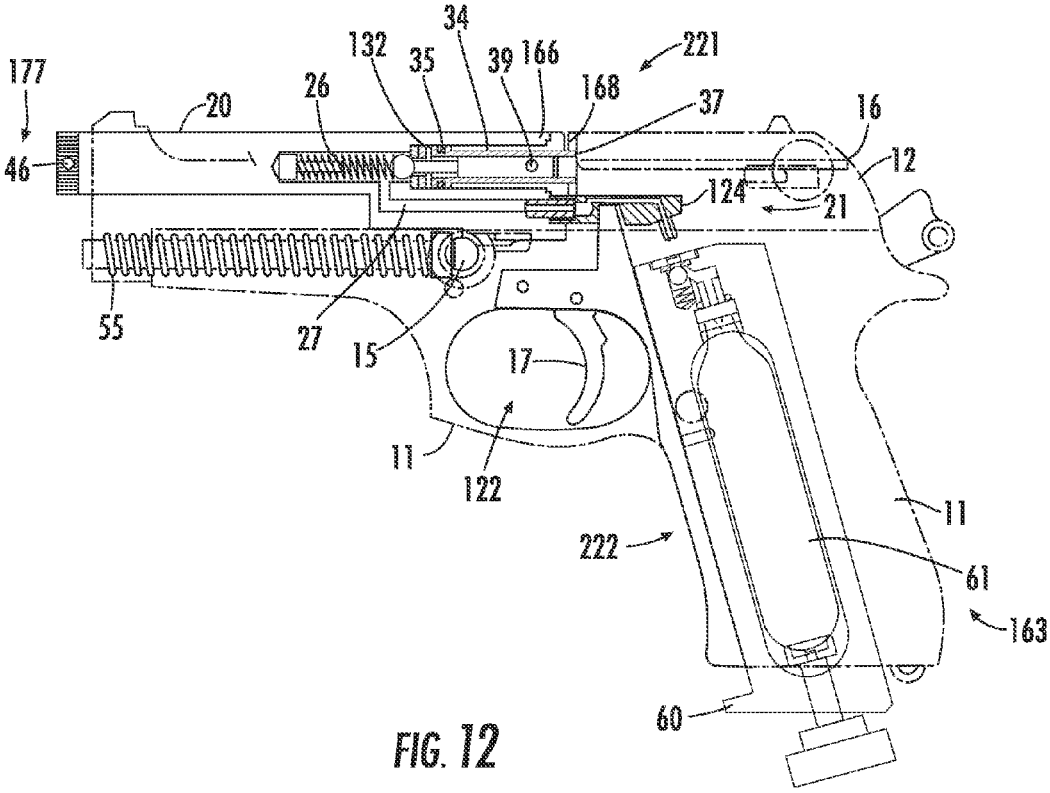
FIG. 12 is a schematic side elevation view of the fifth embodiment of the present invention shown in FIG. 11 wherein the fifth embodiment of the multiple piece barrel unit of the apparatus for converting a pistol into a weapon simulator is received into the pistol and the slide is in the rest position to create the weapon simulator.

A fourth embodiment of the barrel unit 91 is shown in FIG. 11 and FIG. 12 where the barrel unit 91 has a two-piece design to allow the barrel unit 91 to be received in a frame 11 that will not accommodate a one-piece barrel unit 91 and where the striker 37 has a two section design. In this embodiment of the present invention, the barrel unit 91 comprises a barrel 20, a compressed gas valve means 157, a compressed gas valve retaining means 221 and the firing mechanism actuated laser beam pulse emitting means 59. The compressed gas valve means 157 further comprises a compressed valve assembly 125. The compressed gas valve retaining means 221 further comprises a barrel extender seal 22 and a barrel extender 21.

The barrel 20 having a laser module cavity 42, a first gas chamber 26, a compressed gas valve cavity 33, a barrel channel 27 and a first barrel extender seal chamber 100. The laser module cavity 42 is the same as previously described above. The compressed gas valve cavity 33 is situated at the second barrel end 95 having a cylindrical shape with a predetermined inside diameter and having a bore vent 39 and a compressed gas valve cavity notch 166. The bore vent 39 is an opening in the compressed gas valve cavity 33 having a predetermined diameter in a predetermined location of the compressed gas valve cavity 33 such that the bore vent 29 provides a path to vent compressed gas from the compressed gas valve cavity 33 to the exterior of the barrel 20. The compressed gas valve cavity notch 166 is situated at the second barrel end 95 having a circular shape in a predetermined location with a predetermined depth and a predetermined width. The barrel channel 27 having a predetermined shape in a predetermined location in the barrel 20 such that one end of the barrel channel 27 is situated at a predetermined location in the first gas chamber 26 and the other end of the barrel channel 27 is situated at one end of the first barrel extender seal chamber 100. The first barrel extender seal chamber 100 having a cylindrical shape with a predetermined length of a predetermined outside diameter in a predetermined location in the barrel 20 where one end of the first barrel extender seal chamber 100 is in fluid communication with the barrel channel 27 and the other end of the first barrel extender seal chamber 100 is situated at the exterior of the barrel 20.

The barrel extender seal 22 being made from a polymer material having a cylindrical shape of a predetermined length with a predetermined outside diameter that is substantially the same as the predetermined outside diameter of the first barrel extender seal chamber 100 such that one end of the barrel extender seal 22 is received in the first barrel extender seal chamber 100 to seal the first extender seal chamber 100 to retain the compressed gas and having an opening in the barrel extender seal 22 situated in the center of the barrel extender seal 22 with a predetermined inside diameter of the opening such that the predetermined inside diameter of the barrel extender seal 22 is substantially the same size as the barrel channel 27.

As shown in FIG. 11 and FIG. 12, the barrel extender 21 comprising a barrel extender base 124, a barrel extender piston opening 168, a barrel extender channel 25, a second barrel extender seal chamber 101 and a mating pin 24. The barrel extender base 124 being made from metal or metal alloy material having a predetermined shape to allow the barrel extender base 124 to be received in the frame 11 and to allow the barrel extender base 124 to be received in the compressed gas valve cavity notch 166 to connect the barrel extender base 124 at the second barrel end 95, the barrel extender base 124 being situated in a predetermined location which is substantially against the second barrel end 95 and beneath the compressed gas valve cavity 33 such that the barrel extender 21 extends longitudinally beyond the second barrel end 95. The barrel extender base 124 cooperates with the locking block 19 of the frame 11 to removably connect the second barrel extender seal chamber 101, the barrel extender seal 22, and the first barrel extender seal chamber 100 together. The barrel extender piston opening 168 being a circular opening with a predetermined diameter situated in the barrel extender base 124 that is located at the second barrel end 95 such that the barrel extender piston opening 168 is substantially in the center of the predetermined diameter of the compressed gas valve cavity 33 such that the barrel extender piston opening 168 receives the remaining exterior length of the piston 34 within the barrel extender piston opening 168 where the barrel extender piston opening 168 in the barrel extender 21 performs the same function in this embodiment of the invention as the bore cap 40 performed in the preferred embodiment, which is to retain the piston 34 in the compressed gas valve cavity 33 and to guide the piston 34 as it moves within the compressed gas valve cavity 33.

As shown in FIG. 12, the striker 37 being made from metal or metal alloy or polymer material having a cylindrical shape with a first striker end 140 and a second striker end 141. The striker 37 having a first striker section 136, a second striker section 137 and a striker groove 142. As shown if FIG. 12, the first striker section 136 is situated such that one end of the first striker section 136 is the first striker end 140. The second striker section 137 is situated such that the other end of the first striker section 136 is connected to one end of the second striker section 137 and such that the other end of the second striker section 137 is the second striker end 141. The striker groove 142 being situated at a predetermined location in the exterior surface of the second striker section 137 with a predetermined width and a predetermined depth. The first striker section 136 having a predetermined length of a predetermined diameter that is less than the predetermined diameter of the opening in the barrel seal 28 and the predetermined diameter of the circular opening in the first barrel keeper 26 such that the first striker section 136 can pass through the opening in the first barrel keeper 26 and the opening in the barrel seal 28 to allow the first striker end 140 to come into contact with the barrel ball 30 or barrel tappet 92 whereby the first striker end 140 pushes the barrel ball 30 or barrel tappet 92 along the predetermined horizontal plane to direct the barrel ball 30 or barrel tappet 92 toward the first barrel end 94 and away from the barrel seal 28 such that the barrel ball 30 or the barrel tappet 92 compresses the first barrel spring 31 and such that fluid communication between the first gas chamber 26 and the compressed gas valve cavity 33 is created to allow the compressed gas to flow from the first gas chamber 26 into the compressed gas valve cavity 33 through the opening in the barrel seal 28 and the opening in the barrel seal keeper 29. The second striker section 137 having a predetermined diameter, such that the predetermined diameter is substantially the same as the predetermined diameter of the piston opening 135 to allow the striker 37 to be received inside the piston opening 135, of a predetermined length where the predetermined length allows the second striker section to be flush with the first piston end 133. The striker groove 142 being a channel shaped opening situated in a predetermined location in the exterior surface of the fourth striker section 139 having a predetermined depth and a predetermined width.

As shown in FIG. 12, the striker seal 38 being made from polymer material having the shape of an o-ring with a predetermined inside diameter and a predetermined outside diameter with the striker seal 38 being received in the striker groove 142 such that the predetermined diameter of the second striker section 137 places the striker seal 38 in substantial contact with the interior surface of the piston opening 135 to seal the striker 37, at the first piston end 133 and at the second striker end 141, to prevent compressed gas from passing between the exterior surface of the striker 37 and the interior surface of the piston opening 135.

A fifth embodiment of the barrel unit 91 is shown in FIG. 13 where the barrel unit 91 is has a multiple piece design to allow the barrel 20 to be received in a frame 11 that will not accommodate a one-piece barrel unit 91 and where the striker 37 has a two section design as presented in the fourth embodiment of the present invention. In this embodiment of the present invention, the barrel unit 91 comprises a barrel 20, a compressed gas valve means 157, a compressed gas valve retaining means 221 and the firing mechanism actuated laser beam pulse emitting means 59. The compressed gas valve means 157 further comprises a compressed valve assembly 125. The compressed gas valve retaining means 221 further comprises a barrel extender seal 21, a barrel extender seal retainer 107 and a barrel extender retainer seal 171.

The barrel 20 having a barrel first section 72, and a barrel second section 104 where the barrel 20 is made from metal or metal alloy having a first barrel end 94, a second barrel end 95, a barrel top 219 and a barrel bottom 220. The barrel first section 72 having a predetermined shape that is substantially cylindrical in shape with a barrel first section first end 210 and a barrel first section second end 211 such that the barrel first section first end 210 is located at the first barrel end 94. The barrel first section 72 having a laser module cavity 42 situated at the barrel first section first end 210, a first gas chamber 26 situated at the barrel first section second end 211 and a plurality of threads along the exterior of the barrel first section second end 211. The laser module cavity 42 and the first gas chamber 26 are the same as previously described above. The barrel second section 104 having a predetermined shape that is substantially rectangular in shape with a barrel second section first end 212 and a barrel second section second end 213 such that the barrel second section second end 213 is located at the second barrel end 95. The barrel second section 104 having a compressed gas valve cavity 33, a barrel channel 27, a valve housing chamber 105, and a plurality of barrel o-rings 54. The compressed gas valve cavity 33 having a cylindrical shape with a predetermined length with a predetermined inside diameter and with a plurality of threads situated along the interior surface of the inside diameter of the predetermined length of the compressed gas valve cavity 33 such that the predetermined length, with the plurality of threads, is adjacent to and in fluid communication with the first gas chamber 26 at the barrel second section first end 212 and with a remaining length with a predetermined inside diameter such that the predetermined inside diameter of the remaining length is less than the predetermined inside diameter of the predetermined length where the remaining length extends from the predetermined length of the compressed gas valve cavity 33 to the barrel second section second end 213 and having a bore vent 39 and having a compressed gas valve cavity notch 166. The plurality of threads on the exterior of the barrel first section 72 at the barrel first section second end 211 mate with the plurality of threads in the interior surface of the compressed gas valve cavity 33 predetermined length of the barrel second section 104 at the barrel second section first end 212 to joint the barrel first section 72 to the barrel second section 104. The plurality of barrel o-rings 54 having the shape of an o-ring made from polymer material with a predetermined outside diameter and a predetermined inside diameter where the plurality of barrel o-rings 54 are received on the plurality of threads along the exterior of the barrel first section second end 211 such that the plurality of barrel o-rings 54 are the situated between the joint of the barrel first section 72 and the barrel second section 104, that exists when the barrel first section 72 and the barrel second section 104 are mated together, to prevent compressed gas from escaping. The bore vent 39 is an opening in the compressed gas valve cavity 33 having a predetermined diameter in a predetermined location of the compressed gas valve cavity 33 such that the bore vent 39 provides a path to vent the compressed gas from the compressed gas valve cavity 33 to the exterior of the barrel 20. The compressed gas valve cavity notch 166 is situated at the second barrel end 95 having a circular shape in a predetermined location with a predetermined depth and a predetermined width. As shown in FIG. 13, the laser module cavity 42 is situated at the barrel first section first end 210 of the barrel first section 72 at the first barrel end 94 and comprises a first laser module cavity 152 and a second laser module cavity 153 where the first laser module cavity 152 is situated in the barrel 20 such that one end of the first laser module cavity 152 is located at the barrel first section first end 210 of the barrel first section 72 at the first barrel end 94, the first laser module cavity 152 having a cylindrical shape with a predetermined length of a predetermined inside diameter, with a remaining length of a predetermined inside diameter that is less than the predetermined inside diameter of the predetermined length and with a plurality of laser module cavity threads 102 situated along the inside diameter of the remaining length of the first laser module cavity 152 and where the second laser module cavity 153 is situated next to the end of the first laser module cavity 152 that is opposite the end of the first laser module cavity 152 that is located at the first barrel end 94 and in fluid communication with the first laser module cavity 152, the second laser module cavity 153 having a cylindrical shape with a predetermined length of a predetermined inside diameter. As shown in FIG. 13, the predetermined length of the first laser module cavity 152 is substantially equal to the remaining length of the first laser module cavity 152. As shown in FIG. 13, the barrel channel 27 having a predetermined shape in a predetermined location in the barrel second section 104 such that one end of the barrel channel 27 is situated at a predetermined location in the predetermined length of the compressed gas valve cavity 33 and the other end of the barrel channel 27 is situated at one end of the valve housing chamber 105. As shown in FIG. 13, the valve housing chamber 105 having a predetermined shape that is substantially cylindrical with a predetermined inside diameter in a predetermined location in the barrel second section 104 such that one end of the valve housing chamber 105 is situated at one end of the barrel channel 27 to provide a path for compressed gas to flow from the valve housing chamber 105 through the barrel channel 27 to the compressed gas valve cavity 33 and the other end is situated at the exterior of the barrel second section 104.

As shown in FIG. 13, the barrel extender 21 comprising a barrel extender base 124, a barrel extender piston opening 168, a barrel extender channel 25, a second barrel extender seal chamber 101, and a mating pin 24. The barrel extender base 124 being made from metal or metal alloy material having a predetermined shape to allow the barrel extender base 124 to be received in the frame 11 and to allow the barrel extender base 124 to be received in the compressed gas valve cavity notch 166 to connect the barrel extender base 124 to the barrel second section second end 213 at the second barrel end 95, the barrel extender base 124 being situated in a predetermined location which is substantially against the barrel second section second end 213 and beneath the compressed gas valve cavity 33 such that the barrel extender 21 extends longitudinally beyond the barrel second section end 213. The barrel extender base 124 cooperates with the locking block 19 of the frame to removably connect the second barrel extender seal chamber 101, the barrel extender retainer seal 171, the barrel extender seal retainer 107 and the valve housing chamber 105 together. The barrel extender piston opening 168 being a circular opening with a predetermined diameter situated in the barrel extender base 124 that is located at the second barrel end 95 such that the barrel extender piston opening 168 is substantially in the center of the predetermined diameter of the compressed gas valve cavity 33 such that the barrel extender piston opening 168 receives the remaining exterior length of the piston 34 within the barrel extender piston opening 168 where the barrel extender piston opening 168 in the barrel extender 21 performs the same function in this embodiment of the invention as the bore cap 40 performed in the preferred embodiment, which is to retain the piston 34 in the compressed gas valve cavity 33 and to guide the piston 34 as is moves within the compressed gas valve cavity 33. The mating pin 24 is the same as previously described above.

The barrel extender seal retainer 107 being made from metal or metal alloy material having a cylindrical shape with a predetermined exterior length of a predetermined outside diameter of the barrel extender seal retainer 107 that is substantially the same as the predetermined inside diameter of the valve housing chamber 105 such that the barrel extender seal retainer 107 is received inside the valve housing chamber 105, with a remaining exterior length with a predetermined outside diameter of the barrel extender seal retainer 107 that is less than the inside diameter of the predetermined exterior length of the barrel extender seal retainer 107, with an opening such that the opening is a circular hole situated in the center of the barrel extender seal retainer 107 with a predetermined diameter, and with a barrel extender seal groove 106 such that the barrel extender seal groove 106 being situated in a predetermined location in the exterior surface of the predetermined length of the barrel extender seal retainer 107 with a predetermined depth and a predetermined width.

As shown in FIG. 13, the barrel extender retainer seal 171 being made from polymer material having the shape of an o-ring with a predetermined inside diameter and a predetermined outside diameter, the barrel extender retainer seal 171 being received in the barrel extender seal groove 106 such that the predetermined diameter of the predetermined length of the barrel extender seal retainer 107 places the barrel extender retainer seal 171 in substantial contact with the interior surface of the valve housing chamber 105 to seal the barrel extender seal retainer 107 such that the compressed gas is prevented from passing between the exterior surface of the barrel extender seal retainer 107 and the interior surface of the valve housing chamber 105. The second barrel extender seal chamber 101 having a substantially cylindrical shape, with a predetermined length of a predetermined outside diameter in a predetermined location in the barrel extender base 124 where the predetermined outside diameter is substantially the same as the outside diameter of the remaining length of the barrel extender seal retainer 107 where one end of the second barrel extender seal chamber 101 is in fluid communication with the barrel extender channel 25 and the other end of the second barrel extender seal chamber 101 is situated at the exterior of the barrel extender base 124 such that the remaining length of the barrel extender seal retainer 107 is received in the second barrel extender seal chamber 101, whereby the mating pin 24, the barrel extender channel 25, the second barrel extender seal chamber 101, the barrel extender seal retainer 107, the barrel extender retainer seal 171, the valve housing chamber 105 and the barrel channel 27 cooperate to provide fluid communication between the mating pin second end 98 to the compressed gas valve cavity 33 to allow compressed gas to flow from the mating pin orifice 95 to the first gas chamber 26.

Figure 14:
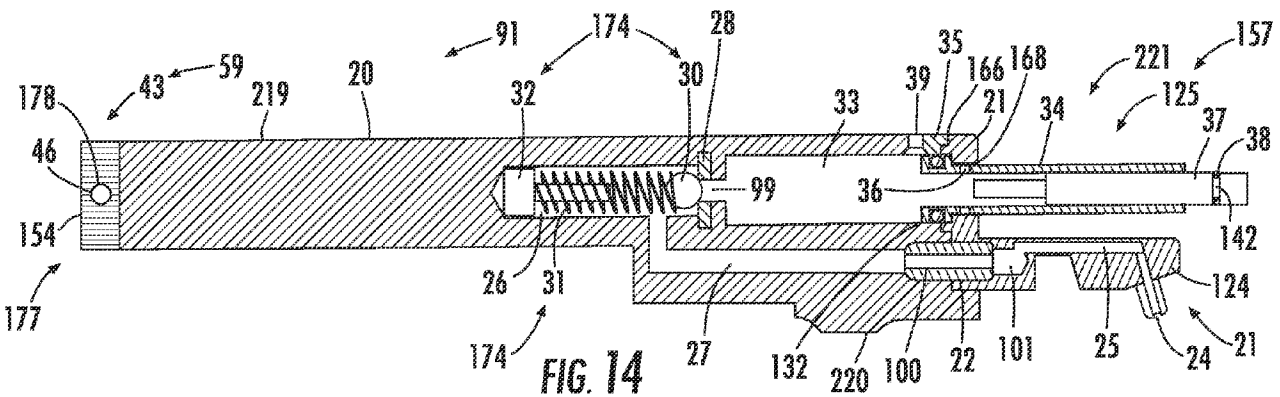
FIG. 14 is a schematic side elevation view of the fifth embodiment of the barrel unit shown in FIG. 11 and FIG. 12.

A sixth embodiment of the barrel unit 91 is shown in FIG. 14 where the barrel unit 91 is has a multiple-piece design to allow the barrel unit 91 to be received in a frame 11 that will not accommodate a one-piece barrel unit 91. In this embodiment of the present invention, the barrel unit 91 comprises a barrel 20, a compressed gas valve means 157, a compressed gas valve retaining means 221 and the firing mechanism actuated laser beam pulse emitting means 59. The compressed gas valve means 157 further comprises a compressed valve assembly 125. The compressed gas valve retaining means 221 further comprises a barrel extender seal 22 and a barrel extender 21.

The barrel 20 being made from metal or metal alloy having a predetermined shape to allow the barrel 20 to be received in the frame 11 and having a laser module cavity 42, a first gas chamber 26, a gas chamber channel 99, a compressed gas valve cavity 33, a barrel channel 27, and a first barrel extender seal chamber 100. The compressed gas valve cavity 33 is situated in the barrel 20 such that one end is adjacent to and in fluid communication with the gas chamber channel 99 and such that the opposite end is located at the second barrel end 95. The compressed gas valve cavity 33 having a cylindrical shape with a predetermined inside diameter and having a bore vent 39 and a compressed gas valve cavity notch 166. The bore vent 39 is an opening in the compressed gas valve cavity 33 having a predetermined diameter in a predetermined location of the compressed gas valve cavity 33 such that the bore vent 29 provides a path to vent compressed gas from the compressed gas valve cavity 33 to the exterior of the barrel 20. The compressed gas valve cavity notch 166 is situated at the second barrel end 95 having a circular shape in a predetermined location with a predetermined depth and a predetermined width. As shown in FIG. 14, the gas chamber channel 99 is situated in the barrel 20 such that one end is adjacent to and in fluid communication with the first gas chamber 26 and such that the opposite end is adjacent to and in fluid communication with the compressed gas valve cavity 33, the gas chamber channel 99 having a cylindrical shape with a predetermined inside diameter such that the predetermined inside diameter of the gas chamber channel 99 is substantially less than the predetermined inside diameter of the compressed gas valve cavity 33. As shown in FIG. 14, the first gas chamber 26 is situated in the barrel 20 between the laser module cavity 42 and the gas chamber channel 99 such that the first gas chamber 26 is adjacent to and in fluid communication with the gas chamber channel 99, the first gas chamber 26 having a cylindrical shape with a predetermined length of a predetermined inside diameter such that the predetermined inside diameter of the predetermined length of the first gas chamber 26 is substantially larger than the predetermined inside diameter of the gas chamber channel 99 and with a remaining length of a predetermined inside diameter such that the predetermined inside diameter of the remaining length of the first gas chamber 26 is substantially more than the predetermined inside diameter of the predetermined length of the first gas chamber 26. As shown in FIG. 14, the barrel channel 27 having a predetermined shape in a predetermined location in the barrel 20 such that one end of the barrel channel 27 is situated at a predetermined location in the first gas chamber 26 and the other end of the barrel channel 27 is situated at one end of the first barrel extender seal chamber 100. The first barrel extender seal chamber 100 having a cylindrical shape with a predetermined length of a predetermined outside diameter in a predetermined location in the barrel 20 where one end of the first barrel extender seal chamber 100 is in fluid communication with the barrel channel 27 and the other end of the first barrel extender seal chamber 100 is situated at the exterior of the barrel 20.

The barrel extender seal 22 being made from a polymer material having a cylindrical shape of a predetermined length with a predetermined outside diameter that is substantially the same as the predetermined outside diameter of the first barrel extender seal chamber 100 such that one end of the barrel extender seal 22 is received in the first barrel extender seal chamber 100 to seal the first extender seal chamber 100 to retain the compressed gas and having an opening in the barrel extender seal 22 situated in the center of the barrel extender seal 22 with a predetermined inside diameter of the opening such that the predetermined inside diameter of the opening in the barrel extender seal 22 is substantially the same size as the barrel channel 27.

As shown in FIG. 14, the barrel extender 21 comprising a barrel extender base 124, a barrel extender piston opening 168, a barrel extender channel 25, a second barrel extender seal chamber 101 and a mating pin 24. The barrel extender base 124 being made from metal or metal alloy material having a predetermined shape to allow the barrel extender base 124 to be received in the frame 11 and to allow the barrel extender base 124 to be received in the compressed gas valve cavity notch 166 to connect the barrel extender base 124 to the second barrel end 95, the barrel extender base 124 being situated in a predetermined location which is substantially against the second barrel end 95 and beneath the compressed gas valve cavity 33 such that the barrel extender 21 extends longitudinally beyond the second barrel end 95. The barrel extender base 124 cooperates with the locking block 19 of the frame to removably connect the second barrel extender seal chamber 101, the barrel extender seal 22, and the first barrel extender seal chamber 100 together. The barrel extender piston opening 168 being a circular opening with a predetermined diameter situated in the barrel extender base 124 that is located at the second barrel end 95 such that the barrel extender piston opening 168 is substantially is in the center of the predetermined diameter of the compressed gas valve cavity 33 such that the barrel extender piston opening 168 receives the remaining exterior length of the piston 34 within the barrel extender piston opening 168 where the piston opening 168 in the barrel extender 21 performs the same function in this embodiment of the invention as the bore cap 40 performed in the preferred embodiment, which is to retain the piston 34 in the compressed gas valve cavity 33 and to guide the piston 34 as is moves within the compressed gas valve cavity 33. The barrel extender channel 25 having a predetermined location in the barrel extender base 124 with a predetermined shape to provide fluid communication between a predetermined location on the exterior of the barrel extender base 124 to one end of the second barrel extender seal chamber 101. The mating pin 24 being made from metal or metal alloy or polymer material and being substantially cylindrical in shape with a predetermined length of a predetermined outside diameter, the mating pin 24 having a mating pin first end 97 where the mating pin first end 97 is attached to the barrel extender base 124 such that the mating pin 24 extends outward from the barrel extender base 124 at a predetermined angle, having a mating pin second end 98 with a predetermined shape that is substantially a sine wave shaped curvature where the sine wave has a predetermined height between the top of the sine wave and the bottom of the sine wave and a predetermined distance between the top of the sine wave and the bottom of the sine wave and has a predetermined radius of the curvature of the mating pin second end 98 and having a mating pin orifice 96 located in the center of the mating pin 24 with a predetermined outside diameter such that the mating pin orifice 96 and the barrel extender channel 25 cooperate to provide fluid communication from the mating pin second end 98 to the second barrel extender seal chamber 101 to allow compressed gas to flow from the mating pin orifice 95 to the second barrel extender seal chamber 101. The second barrel extender seal chamber 101 having a cylindrical shape with a predetermined length of a predetermined outside diameter in a predetermined location in the barrel extender 21 where one end of the second barrel extender seal chamber 101 is in fluid communication with the barrel extender channel 25 and the other end of the second barrel extender seal chamber 101 is situated at the exterior of the barrel extender 21 such that the other end of the barrel extender seal 22 is received in the second barrel extender seal chamber 101 to seal the second extender seal chamber 101 to retain the compressed gas, whereby the mating pin 24, the barrel extender channel 25, the second barrel extender seal chamber 101, the barrel extender seal 22, the first barrel extender seal chamber 100, and the barrel channel 27 cooperate to provide fluid communication between the mating pin second end 98 to the first gas chamber 26 to allow compressed gas to flow from the mating pin orifice 95 to the first gas chamber 26.

Figure 15:
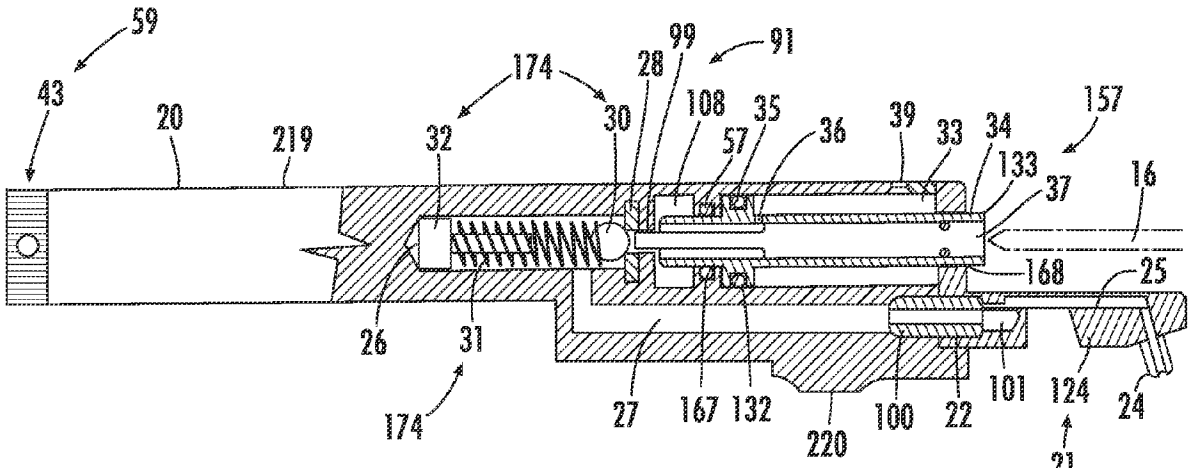
FIG. 15 is a schematic side elevation view of a seventh embodiment of the barrel unit wherein the multiple piece barrel unit has a compressed gas valve means that utilizes a stepped piston where the stepped piston is shown in the position it would be in when slide is in its rest position.
Figure 16:
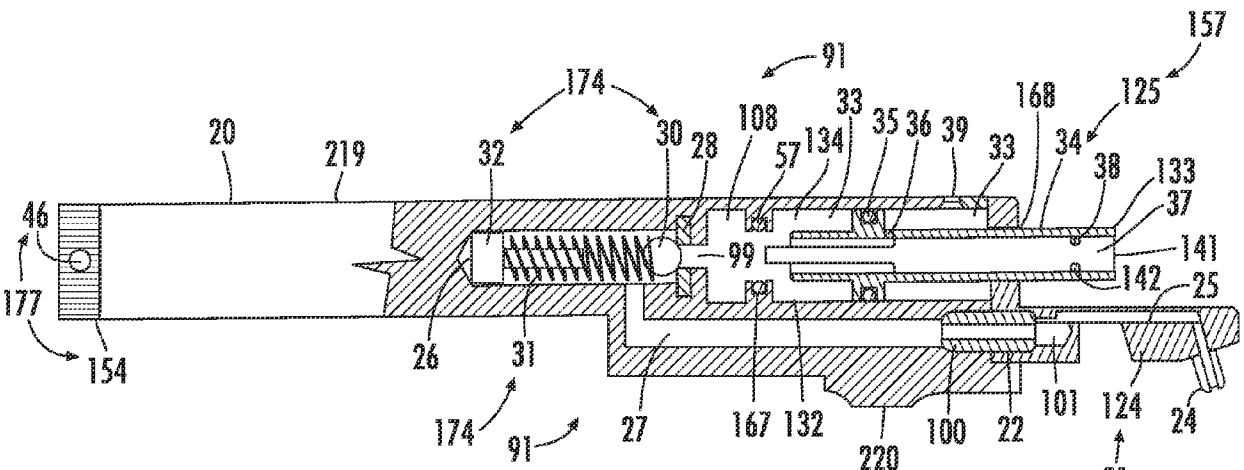
FIG. 16 is a schematic side elevation view of a seventh embodiment of the barrel unit as shown in FIG. 15 wherein the multiple piece barrel unit has a compressed gas valve means that utilizes a stepped piston where the stepped piston is shown in the position it would be in when slide is in its open position.

A seventh embodiment of the barrel unit 91 is shown in FIG. 15 and FIG. 16 where the barrel unit 91 has a multiple piece design to allow the barrel unit 91 to be received in a frame 11 that will not accommodate a one-piece barrel unit 91, where the piston 34 is extended at the second piston end 134 and where the striker 37 has a two section design as presented in the fourth embodiment of the present invention. In this embodiment of the present invention, the barrel unit 91 comprises a barrel 20, a compressed gas valve means 157, a compressed gas valve retaining means 221 and the firing mechanism actuated laser beam pulse emitting means 59. The compressed gas valve means 157 further comprises a compressed valve assembly 125. The compressed gas valve retaining means 221 further comprises a barrel extender seal 22 and a barrel extender 21.

The barrel 20 having a laser module cavity 42, a first gas chamber 26, a gas chamber channel 99, a second gas chamber 108, a step piston seal 57, a compressed gas valve cavity 33, a barrel channel 27 and a first barrel extender seal chamber 100. The compressed gas valve cavity 33 is situated at the second barrel end 95 having a cylindrical shape with a predetermined inside diameter and having a bore vent 39. The bore vent 39 is an opening in the compressed gas valve cavity 33 having a predetermined diameter in a predetermined location of the compressed gas valve cavity 33 such that the bore vent 39 provides a path to vent compressed gas from the compressed gas valve cavity 33 to the exterior of the barrel 20. As shown in FIG. 15 and FIG. 16, the second gas chamber 108 is situated in the barrel 20 adjacent to the compressed gas valve cavity 33 such that the second gas chamber 108 is in fluid communication with the compressed gas valve cavity 33, the second gas chamber 108 having a cylindrical shape with a predetermined length of a predetermined inside diameter, with a remaining length of a predetermined inside diameter such that the remaining length has a predetermined inside diameter that is less than the predetermined inside diameter of the predetermined length and with a step piston groove 167 such that the step piston groove 167 is situated in a predetermined location in the remaining length of the second gas chamber 108 with a predetermined depth and a predetermined width. As shown in FIG. 15 and FIG. 16, the step piston seal 57 being made from polymer material having the shape of an o-ring with a predetermined inside diameter and a predetermined outside diameter to allow the step piston seal 58 to be received in the step piston groove 167. As shown in FIG. 15 and FIG. 16, the gas chamber channel 99 is situated adjacent to the second gas chamber 108 such that the gas chamber channel 99 is in fluid communication with the second gas chamber 108, the gas chamber channel 99 having a cylindrical shape with a predetermined inside diameter such that the predetermined inside diameter of the gas chamber channel 99 is substantially less than the predetermined inside diameter of the predetermined length of the second gas chamber 108. As shown in FIG. 15 and FIG. 16, the first gas chamber 26 is situated in the barrel 20 between the laser module cavity 42 and the gas chamber channel 99 such that the first gas chamber 26 is adjacent to and in fluid communication with the gas chamber channel 99, the first gas chamber 26 having a cylindrical shape with a predetermined length of a predetermined inside diameter such that the predetermined inside diameter of the predetermined length of the first gas chamber 26 is substantially larger than the predetermined inside diameter of the gas chamber channel 99 and with a remaining length of a predetermined inside diameter such that the predetermined inside diameter of the remaining, length of the first gas chamber 26 is substantially larger than the predetermined inside diameter of the predetermined length of the first gas chamber 26. As shown in FIG. 15 and FIG. 16, the barrel channel 27 having a predetermined shape in a predetermined location in the barrel 20 such that one end of the barrel channel 27 is situated at a predetermined location in the first gas chamber 26 and the other end of the barrel channel 27 is situated at one end of the first barrel extender seal chamber 100. The first barrel extender seal chamber 100 having a cylindrical shape with a predetermined length of a predetermined outside diameter in a predetermined location in the barrel 20 where one end of the first barrel extender seal chamber 100 is in fluid communication with the barrel channel 27 and the other end of the first barrel extender seal chamber 100 is situated at the exterior of the barrel 20.

The barrel extender seal 22 being made from a polymer material having a cylindrical shape of a predetermined length with a predetermined outside diameter that is substantially the same as the predetermined outside diameter of the first barrel extender seal chamber 100 such that one end of the barrel extender seal 22 is received in the first barrel extender seal chamber 100 to seal the first extender seal chamber 100 to retain the compressed gas and having an opening in the barrel extender seal 22 situated in the center of the barrel extender seal 22 with a predetermined inside diameter of the opening such that the predetermined inside diameter of the opening in the barrel extender seal 22 is substantially the same size as the barrel channel 27.

As shown in FIG. 15 and FIG. 16, the barrel extender 21 comprising a barrel extender base 124, a barrel extender piston opening 168, a barrel extender channel 25, a second barrel extender seal chamber 101 and a mating pin 24. The barrel extender base 124 being made from metal or metal alloy material having a predetermined shape to allow the barrel extender base 124 to be received in the frame 11 and to allow the barrel extender base 124 to be received adjacent to the compressed gas valve cavity 33 to connect the barrel extender base 124 to the second barrel end 95, the barrel extender base 124 being situated in a predetermined location which is substantially against the second barrel end 95 and beneath the compressed gas valve cavity 33 such that the barrel extender 21 extends longitudinally beyond the second barrel end 95. The barrel extender base 124 cooperates with the locking block 19 of the frame to removably connect the second barrel extender seal chamber 101, the barrel extender seal 22, and the first barrel extender seal chamber 100 together. The barrel extender piston opening 168 being a circular opening with a predetermined diameter situated in the barrel extender base 124 that is located at the second barrel end 95 such that the barrel extender piston opening 168 is substantially in the center of the predetermined diameter of the compressed gas valve cavity 33 such that the barrel extender piston opening 168 receives the remaining exterior length of the piston 34 within the barrel extender piston opening 168 where the barrel extender piston opening 168 in the barrel extender 21 performs the same function in this embodiment of the invention as the bore cap 40 performed in the preferred embodiment, which is to retain the piston 34 in the compressed gas valve cavity 33 and to guide the piston 34 as is moves within the compressed gas valve cavity 33. The barrel extender channel 25 having a predetermined location in the barrel extender base 124 with a predetermined shape to provide fluid communication between a predetermined location on the exterior of the barrel extender base 124 to one end of the second barrel extender seal chamber 101. The mating pin 24 being made from metal or metal alloy or polymer material and being substantially cylindrical in shape with a predetermined length of a predetermined outside diameter, the mating pin 24 having a mating pin first end 97 where the mating pin first end 97 is attached to the barrel extender base 124 such that the mating pin 24 extends outward from the barrel extender base 124 at a predetermined angle, having a mating pin second end 98 with a predetermined shape that is substantially a sine wave shaped curvature where the sine wave has a predetermined height between the top of the sine wave and the bottom of the sine wave and a predetermined distance between the top of the sine wave and the bottom of the sine wave and has a predetermined radius of the curvature of the mating pin second end 98 and having a mating pin orifice 96 located in the center of the mating pin 24 with a predetermined outside diameter such that the mating pin orifice 96 and the barrel extender channel 25 cooperate to provide fluid communication from the mating pin second end 98 to the second barrel extender seal chamber 101 to allow compressed gas to flow from the mating pin orifice 95 to the second barrel extender seal chamber 101. The second barrel extender seal chamber 101 having a cylindrical shape with a predetermined length of a predetermined outside diameter in a predetermined location in the barrel extender 21 where one end of the second barrel extender seal chamber 101 is in fluid communication with the barrel extender channel 25 and the other end of the second barrel extender seal chamber 101 is situated at the exterior of the barrel extender 21 such that the other end of the barrel extender seal 22 is received in the second barrel extender seal chamber 101 to seal the second extender seal chamber 101 to retain the compressed gas, whereby the mating pin 24, the barrel extender channel 25, the second barrel extender seal chamber 101, the barrel extender seal 22, the first barrel extender seal chamber 100, and the barrel channel 27 cooperate to provide fluid communication between the mating pin second end 98 to the first gas chamber 26 to allow compressed gas to flow from the mating pin orifice 95 to the first gas chamber 26.

As shown in FIG. 15 and FIG. 16, the piston 34 being a stepped piston made from metal or metal alloy or polymer material having a cylindrical shape having a first piston end 133 and a second piston end 134. The piston 34 having a first piston section, a second piston section and a third piston section. As shown if FIG. 16, the first piston section is situated such that one end of the first piston section is the first piston end 133. The second piston section is situated such that the other end of the first piston section is connected to one end of the second piston section. The third piston section is situated such that the other end of the second piston section is connected to one end of the third piston section. The other end of the third piston section is situated such that the other end of the third piston section is the second piston end 134. The first piston section of the piston 34 having a predetermined exterior length with a predetermined outside diameter, starting at the piston first end 133, where the predetermined outside diameter is substantially the same as the predetermined diameter of the barrel extender piston opening 168 such that the first piston section of the piston 34, at the first piston end 133, is slidably received in the barrel extender piston opening 168 whereby the barrel extender piston opening 168 retains the piston 34 within the compressed gas valve cavity 33 and the second gas chamber 108 and guides the piston 34 as it moves within the compressed gas valve cavity 33 and the second gas chamber 108. The second piston section of the piston 34 having a predetermined exterior length with a predetermined outside diameter where the predetermined outside diameter is substantially the same as the internal diameter of the compressed gas valve cavity 33 such that the second piston section of the piston 34 is received in the compressed gas valve cavity 33 and is substantially larger than the barrel extender piston opening 168 such that the second piston section of the piston 34 and the barrel extender piston opening 168 cooperate to limit the travel of piston 34 toward the second barrel end 95 and having a piston seal groove 132 being situated in a predetermined location in the second piston section of the piston 34 where the piston seal groove 132 having a predetermined width and a predetermined depth. The third piston section of the piston 34 having a predetermined exterior length, starting at the second piston end 134, with a predetermined outside diameter where the predetermined outside diameter is substantially less than less than the predetermined inside diameter of the remaining length of the second gas chamber 108 and is substantially the same as the inside diameter of the step piston seal 57 such that the third piston section of the piston 34 is received into the second gas chamber 108 and is received in the step piston seal 108 whereby the third piston section of the piston 34 cooperate with the step piston seal 108 to prevent compressed gas from passing between the exterior of the piston 34 and the interior of the step piston seal 108.

The piston seal 35 being made from polymer material having the shape of an o-ring with a predetermined inside diameter and a predetermined outside diameter to allow the piston seal 35 to be received in the piston groove 132 such that the predetermined diameter of the predetermined length of the piston 34 places the piston seal 35 in substantial contact with the interior surface of the compressed valve cavity 33, such that the compressed gas is prevented from passing between the exterior surface of the piston 34, and the interior surface of the compressed valve cavity 33.

As shown in FIG. 15 and FIG. 16, the combination of the first gas chamber 26, the second gas chamber 108, the gas chamber channel 99, the piston 34, the piston seal 35, the step piston seal 57, the compressed gas valve sealing means 174, the barrel seal 28 and the striker 37 cooperate to delay the major part of the recoil of the weapon simulator 10 for a few milliseconds after the firing mechanism actuated laser beam pulse emitting means 59 of the weapon simulator 10 has been activated by the firing mechanism 122 where this delay of the recoil allows the laser beam from the firing mechanism actuated laser beam pulse emitting means 59 to remain on the target as long as possible with minimal deviation. The delay of the recoil is the result of the compress gas, released from the first gas chamber 26 by the striker 37, acting on the smaller area of the second piston end 134 of the piston 34 producing a small recoil force for a predetermine period of time as shown in FIG. 15. As the compressed gas pushes the piston 34 and the striker 37 toward the second barrel end 95 and pass the second gas chamber 108, the compressed gas acts on the larger area of both the third piston section and the second piston section of the piston 34 producing a normal recoil force until the piston 34 and striker 37 reaches the second valve assembly position as shown in FIG. 16.

Figure 17:
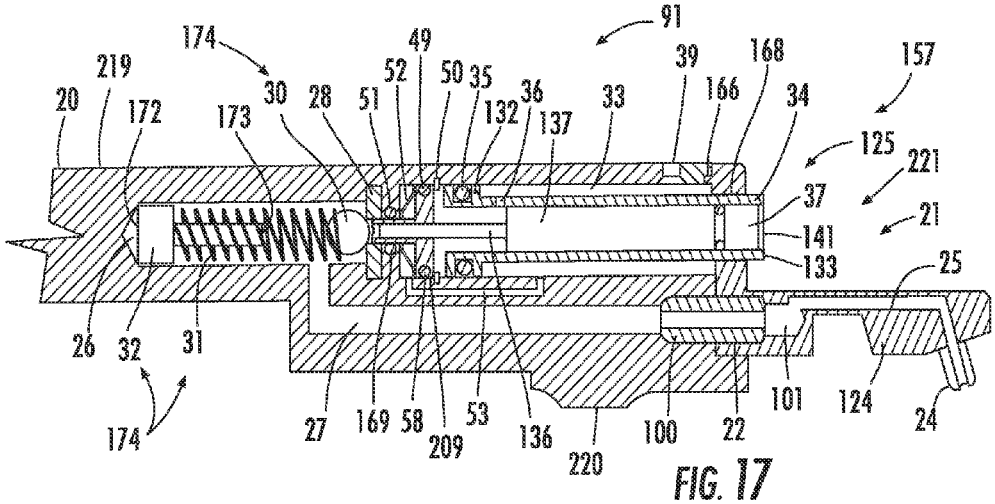
FIG. 17 is a schematic side elevation view of a eighth embodiment of the barrel unit wherein the multiple piece barrel unit has a compressed gas valve means that utilizes a latching valve where the latching valve is shown in the position it would be in when slide is in its rest position.
Figure 18:
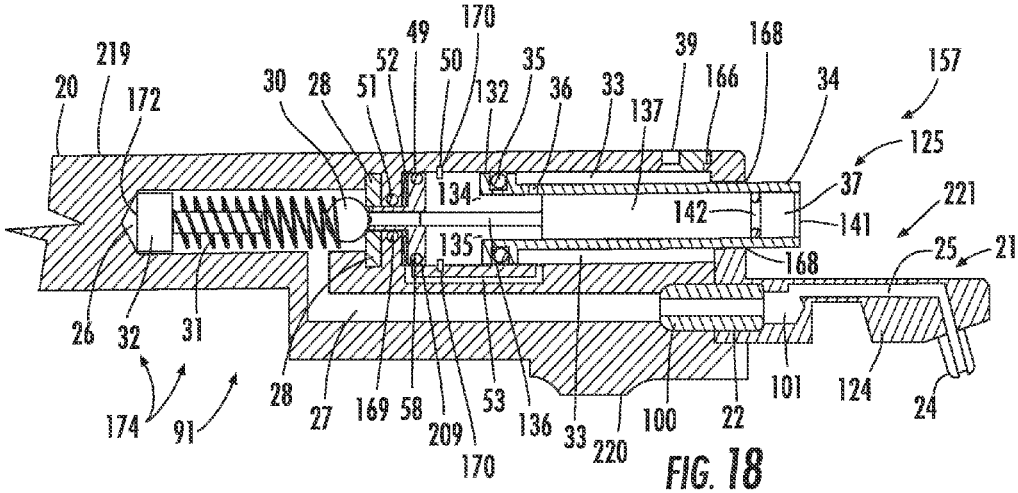
FIG. 18 is a schematic side elevation view of the eighth embodiment of the barrel unit as shown in FIG. 17 wherein the multiple piece barrel unit has a compressed gas valve, means that utilizes a latching valve where the latching valve is shown in position when the slide is between its rest position and its open position.
Figure 19:
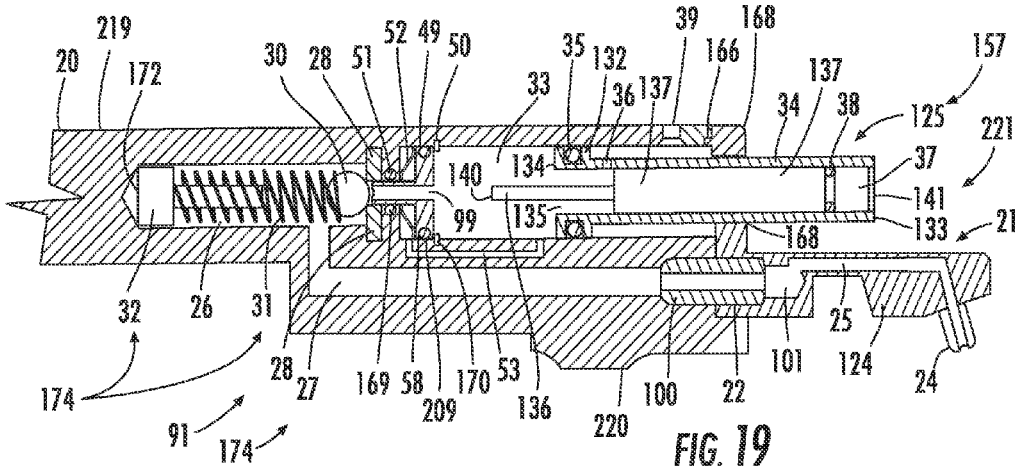
FIG. 19 is a schematic side elevation view of the eighth embodiment of the barrel unit as shown in FIG. 17 and FIG. 18 wherein the multiple piece barrel unit has a compressed gas valve means that utilizes a latching valve where the latching valve is shown in the position it would be in when slide is in its open position.

An eighth embodiment of the barrel unit 91 is shown in FIG. 17, FIG. 18 and FIG. 19 where the barrel unit 91 has a multiple-piece design to allow the barrel unit 91 to be received in a frame 11 that will not accommodate a one-piece barrel unit 91. In this embodiment of the present invention, the barrel unit 91 comprises a barrel 20, a barrel extender seal 22, a barrel extender 21, a compressed gas valve assembly 125 and the firing mechanism actuated laser beam pulse emitting means 59.

The barrel 20 being made from metal or metal alloy having a predetermined shape to allow the barrel 20 to be received in the frame 11 and having a laser module cavity 42, a first gas chamber 26, a gas chamber channel 99, an unlatch channel 53, a compressed gas valve cavity 33, a barrel channel 27 and a first barrel extender seal chamber 100. The laser module cavity 42 is situated in the barrel 20 at the first barrel end 94 having a predetermined shape such that the laser module cavity 42 receives the firing mechanism actuated laser beam pulse emitting means 59. The first gas chamber 26 is situated in the barrel 20 between the laser module cavity 42 and the gas chamber channel 99 such that the first gas chamber 26 is adjacent to and in fluid communication with the gas chamber channel 99. The first gas chamber 26 having a cylindrical shape with a predetermined length of a predetermined inside diameter and with a remaining length of a predetermined inside diameter such that the predetermined inside diameter of the remaining length of the first gas chamber 26 is larger than the predetermined inside diameter of the predetermined length of the first gas chamber 26. As shown in FIG. 17, FIG. 18 and FIG. 19, the gas chamber channel 99 is situated in the barrel 20 such that one end is adjacent to and in fluid communication with the remaining length of the first gas chamber 26 and such that the opposite end is adjacent to and in fluid communication with the compressed gas valve cavity 33. The gas chamber channel 99 having a cylindrical shape with a predetermined inside diameter such that the predetermined inside diameter of the gas chamber channel 99 is substantially less than the predetermined inside diameter of the first gas chamber 26 predetermined length and is substantially less than the predetermined inside diameter of the compressed gas valve cavity 33. The gas chamber channel 99 has a first latch seal cavity 169 situated in a predetermined location in the interior surface of the gas chamber channel 99 where the first latch seal cavity has a predetermined shape. The compressed gas valve cavity 33 is situated in the barrel 20 such that one end is adjacent to and in fluid communication with the gas chamber channel 99 and such that the opposite end is located at the second barrel end 95. The compressed gas valve cavity 33 having a cylindrical shape with a predetermined inside diameter and having a bore vent 39, a latch retainer groove 170 and a compressed gas valve cavity notch 166. The bore vent 39 is an opening in the compressed gas valve cavity 33 having a predetermined diameter in a predetermined location of the compressed gas valve cavity 33 such that the bore vent 39 provides a path to vent compressed gas from the compressed gas valve cavity 33 to the exterior of the barrel 20. The latch retainer groove 170 is situated in a predetermined location along the interior of the compressed gas valve cavity 33 having a predetermined depth and a predetermined width. The compressed gas valve cavity notch 166 is situated at the second barrel end 95 having a circular shape in a predetermined location with a predetermined depth and a predetermined width. As shown in FIG. 17, FIG. 18 and FIG. 19, the unlatch channel 53 is situated in a predetermined location in the barrel 20 such that both ends of the unlatch channel 53 exit into the compressed gas valve cavity 33 to provide compressed gas a predetermined path within the barrel 20 so that compressed gas is allowed to flow between predetermined locations in the compressed gas valve cavity 33 to allow the present invention to use a low pressure source of compressed gas. As shown in FIG. 17, FIG. 18 and FIG. 19, the barrel channel 27 having a predetermined shape in a predetermined location in the barrel 20 such that one end of the barrel channel 27 is situated at a predetermined location in the first gas chamber 26 and the other end of the barrel channel 27 is situated at one end of the first barrel extender seal chamber 100. The first barrel extender seal chamber 100 having a cylindrical shape with a predetermined length of a predetermined outside diameter in a predetermined location in the barrel 20 where one end of the first barrel extender seal chamber 100 is in fluid communication with the barrel channel 27 and the other end of the first barrel extender seal chamber 100 is situated at the exterior of the barrel 20.

The barrel extender seal 22 being made from a polymer material having a cylindrical shape of a predetermined length with a predetermined outside diameter that is substantially the same as the predetermined outside diameter of the first barrel extender seal chamber 100 such that one end of the barrel extender seal 22 is received in the first barrel extender seal chamber 100 to seal the first extender seal chamber 100 to retain the compressed gas and having an opening in the barrel extender seal 22 situated in the center of the barrel extender seal 22 with a predetermined inside diameter of the opening such that the predetermined inside diameter of the barrel extender seal 22 is substantially the same size as the barrel channel 27.

As shown in FIG. 17, FIG. 18 and FIG. 19, the barrel extender 21 comprising a barrel extender base 124, a barrel extender piston opening 168, a barrel extender channel 25, a second barrel extender seal chamber 101 and a mating pin 24. The barrel extender base 124 being made from metal or metal alloy material having a predetermined shape to allow the barrel extender base 124 to be received in the frame 11 and to allow the barrel extender base 124 to be received in the compressed gas valve cavity notch 166 to connect the barrel extender base 124 to the second barrel end 95, the barrel extender base 124 being situated in a predetermined location which is substantially against the second barrel end 95 and beneath the compressed gas valve cavity 33 such that the barrel extender 21 extends longitudinally beyond the second barrel end 95. The barrel extender base 124 cooperates with the locking block 19 of the frame to removably connect the second barrel extender seal chamber 101, the barrel extender seal 22, and the first barrel extender seal chamber 100 together. The barrel extender piston opening 168 being a circular opening with a predetermined diameter situated in the barrel extender base 124, that is located at the second barrel end 95, such that the barrel extender piston opening 168 is substantially in the center of the predetermined diameter of the compressed gas valve cavity 33 such that the barrel extender piston opening 168 receives the remaining exterior length of the piston 34 within the barrel extender piston opening 168 where the barrel extender piston opening 168 in the barrel extender 21 performs the same function in this embodiment of the invention as the bore cap 40 performed in the preferred embodiment, which is to retain the piston 34 in the compressed gas valve cavity 33 and to guide the piston 34 as is moves within the compressed gas valve cavity 33. The barrel extender channel 25 having a predetermined location in the barrel extender base 124 with a predetermined shape to provide fluid communication between a predetermined location on the exterior of the barrel extender base 124 to one end of the second barrel extender seal chamber 101. The mating pin 24 being made from metal or metal alloy or polymer material and being substantially cylindrical in shape with a predetermined length of a predetermined outside diameter, the mating pin 24 having a mating pin first end 97 where the mating pin first end 97 is attached to the barrel extender base 124 such that the mating pin 24 extends outward from the barrel extender base 124 at a predetermined angle, having a mating pin second end 98 with a predetermined shape that is substantially a sine wave shaped curvature where the sine wave has a predetermined height between the top of the sine wave and the bottom of the sine wave and a predetermined distance between the top of the sine wave and the bottom of the sine wave and has a predetermined radius of the curvature of the mating pin second end 98 and having a mating pin orifice 96 located in the center of the mating pin 24 with a predetermined outside diameter such that the mating pin orifice 96 and the barrel extender channel 25 cooperate to provide fluid communication from the mating pin second end 98 to the second barrel extender seal chamber 101 to allow compressed gas to flow from the mating pin orifice 95 to the second barrel extender seal chamber 101. The second barrel extender seal chamber 101 having a cylindrical shape with a predetermined length of a predetermined outside diameter in a predetermined location in the barrel extender 21 where one end of the second barrel extender seal chamber 101 is in fluid communication with the barrel extender channel 25 and the other end of the second barrel extender seal chamber 101 is situated at the exterior of the barrel extender 21 such that the other end of the barrel extender seal 22 is received in the second barrel extender seal chamber 101 to seal the second extender seal chamber 101 to retain the compressed gas, whereby the mating pin 24, the barrel extender channel 25, the second barrel extender seal chamber 101, the barrel extender seal 22, the first barrel extender seal chamber 100, and the barrel channel 27 cooperate to provide fluid communication between the mating pin second end 98 to the first gas chamber 26 to allow compressed gas to flow from the mating pin orifice 95 to the first gas chamber 26.

As shown in FIG. 17, FIG. 18 & FIG. 19, this embodiment of the compressed gas valve means 157 provides for a latch arrangement that is retained in the compressed gas valve cavity 33 that is particularly useful when the compressed gas is provided at medium pressure or at low pressure. The compressed gas valve means 157 comprises a compressed gas valve assembly 125. As seen in FIG. 17, FIG. 18 and FIG. 18, the compressed gas valve assembly 125 comprises a compressed gas valve sealing means 174, a barrel seal 28, a latch 49, a first latch seal 51, a latch retainer 50, a latch spring 52, a second latch seal 58, a piston 34, a piston seal 35, a striker 37 and a striker seal 38. The compressed gas valve sealing means 174 cooperates with the barrel seal 28 to contain the compressed gas within the first gas chamber 26 until the firing pin 16 strikes the striker 37 whereby the force from the firing pin 16 causes the striker 37 to push the compressed gas valve sealing means 174 away from the barrel seal 28 to create a path for the compressed gas to flow into the compressed gas valve assembly 125 until the pressure from the compressed gas pushes the piston 34 toward the second barrel end 95, which also pushes the striker toward the barrel second end 95, so that the compressed valve sealing means 174 moves toward the barrel seal 28 until the compressed valve sealing means 174 comes in contact with the barrel seal 28 to close the path of the compressed gas and contain the compressed gas in the first gas chamber 26.

As shown in FIG. 17, FIG. 18 and FIG. 19, this embodiment of the compressed gas valve sealing means 174 comprises a spacer 32, a first barrel spring 31 and a barrel ball 30. The spacer 32 has a first spacer end 172 and a second spacer end 173. The spacer 32 being made from metal or metal alloy or polymer material having a cylindrical shape with a predetermined exterior length of a predetermined outside diameter, starting at the first spacer end 172, that is substantially the same as the predetermined inside diameter of the first gas chamber 26 such that the spacer 32 is received in the first gas chamber 26 where the first spacer end 172 is the closest to the laser module cavity 42 and with the remaining exterior length of the spacer 32 having a predetermined outside diameter that is less than the predetermined diameter of the predetermined length of the spacer 32 such that the remaining exterior length of the spacer 32 extends from the predetermined exterior length to the second spacer end 173. The first barrel spring 31 being made from metal or metal alloy material having a predetermined shape that is substantially a helix shape with a predetermined inside diameter of the first barrel spring 31 that is larger than the predetermined diameter of the remaining length of the spacer 32 and having a predetermined outside diameter of the first barrel spring 31 that is less than the predetermined inside diameter of the first gas chamber 26 such that the first barrel spring 31 is received onto remaining length of the spacer 32, beginning at the second spacer end 173, within the first gas chamber 26. The barrel ball 30 being made from metal or metal alloy or polymer material having a spherical shape with a predetermined diameter that is less than the predetermined inside diameter of the first gas chamber 26 such that the barrel ball 30 is received within the first gas chamber 26, at the end of the first gas chamber 26 adjacent to the gas chamber channel 99, and is in substantial contact with one end of the first barrel spring 31 such that the combination of the end of first gas chamber 26, the spacer 32 and the first barrel spring 31 cooperate to push on the barrel ball 30 in a predetermined horizontal direction where the predetermined horizontal direction is substantially toward the gas chamber channel 99 and the compressed gas valve cavity 33. The barrel seal 28 being received in the remaining length of the first gas chamber 26. The barrel seal 28 being washer-shaped is made from polymer material, the barrel seal 28 having a predetermined width, a predetermined outside diameter, and a predetermined diameter of the opening in the center of the barrel seal 28 such that the predetermined outside diameter is substantially the same as the predetermined inside diameter of the remaining length of the first gas chamber 26 so that the barrel seal 28 is received in the remaining length of the first gas chamber 26 adjacent to and in fluid communication with the gas chamber channel 99 and such that the predetermined diameter of the opening in the center of the barrel seal 28 is less than the predetermined diameter of the barrel ball 30. The barrel seal 28 cooperates with the spacer 32, the first barrel spring 31, and the barrel ball 30 to contain the compressed gas within the first gas chamber 26 until the firing pin 16 strikes the striker 37, whereby the force from the firing pin 16 causes the striker 37 to push the barrel ball 30 away from the barrel seal 28 to create a path for the compressed gas to flow thru the gas chamber channel 99 into the compressed gas valve assembly 125 until the pressure from the compressed gas pushes the piston 34 toward the second barrel end 95, which also pushes the striker toward the barrel second end 95, so that the first barrel spring 31 moves the barrel ball 30 toward the barrel seal 28 until the barrel ball 30 comes in contact with the barrel seal 28 to close the path of the compressed gas and contain the compressed gas in the first gas chamber 26 once again.

The latch 49 is received in a predetermine location in both the gas chamber channel 99 and the compressed gas valve cavity 33 such that the unlatching channel 53 exits into the compressed valve cavity 33 around the latch 49. This arrangement allows compressed gas to pass between the compressed gas valve cavity 33 and the latch 49 so the unlatching channel 53 can cooperate with the latch 49 to vent compressed gas between the latch 49 and the channel chamber 99 when the compressed gas is contained in the first gas chamber 26 where the compressed gas valve assembly 125 is situated at the first valve assembly position and to captured compressed gas between the latch 49 and the channel chamber 99 when the compressed gas is allowed to flow into the compressed gas valve cavity 33 where the compressed gas valve assembly 125 is being moved from the first valve assembly position to the second valve assembly position by the compressed gas. The latch 49 being made from metal, metal alloy or polymer material having a predetermined shape that is substantially cylindrical with a predetermined length of a predetermined outside diameter that is substantially the same as the predetermined inside diameter of the gas chamber channel 99 such that the predetermined length of the latch 49 can be received inside the gas chamber channel 99 and such that the end of the predetermined length of the latch 49 can conic into contact with the surface of the barrel ball 30, with a remaining length of a predetermined outside diameter that is substantially the same as the predetermined inside diameter of the compressed gas valve cavity 33 so that the remaining length of the latch 49 can be received inside the compressed gas valve cavity 33, with a circular opening situated through the center of the latch 49 to provide a flow path for compressed gas through the latch 49 and with a second latch seal groove 209 situated in the remaining length of the latch 49 along the exterior of the latch 49 where the second latch seal groove 209 has a predetermined shaped. The latch 49 in this embodiment of the invention has a plurality of semi-circle openings in the end of the predetermine length of the latch 49 that comes into contact with the barrel ball 30 to provide a flow path for the compressed gas when the latch 49 cooperates with the striker 37 to move the barrel ball 30 away from the barrel seal 28. The plurality of semi-circle openings in the predetermined length of the latch 49 having a predetermined size to permit a predetermined amount of compressed gas to flow between the first gas chamber 26 and the compressed gas valve cavity 33.

The first latch seal 51 being made from a polymer material having a predetermined shape to allow the first latch seal 51 to be received in the first latch seal cavity 169 in the gas chamber channel 99. As shown in FIG. 17, FIG. 18 & FIG. 19, in this embodiment of the invention, the first latch seal 51 is made from a polymer material having the shaped of an o-ring with a predetermined outside diameter where the predetermined outside diameter is the same as the shape of the first latch seal cavity 169 and with a predetermined inside diameter that is less than the predetermined outside diameter of the predetermined length such that the first latch seal 51 cooperates with exterior surface of the predetermined length of the latch 49 to prevent compressed gas from passing between the first latch seal 51 and the exterior surface of the predetermined length of the latch 49.

The second latch seal 58 being made from a polymer material having a predetermined shape to allow the second latch seal 58 to be received in the second latch seal groove 209 in the remaining length of the latch 49. As shown in FIG. 17, FIG. 18 & FIG. 19, in this embodiment of the invention, the second latch seal 58 is made from a polymer material having the shaped of an o-ring with a predetermined inside diameter where the predetermined inside diameter is the same as the predetermined shape of the second latch seal groove 209 and with a predetermined outside diameter that is more than the predetermined inside diameter of the compressed gas valve cavity 33 such that the second latch seal 58 cooperates with interior surface of the compressed gas valve cavity 33 to prevent compressed gas from passing between the second latch seal 58 and the interior surface of the compressed gas valve cavity 33.

The latch spring 52 made from metal or metal alloy material having a predetermined shape. In the embodiment shown in FIG. 17, FIG. 18 and FIG. 19, the latch spring 52 having a shape that is substantially a cone-shaped washer with a predetermine outside diameter of the latch spring 52 being less than the predetermined diameter of the remaining length of the latch 49 and with an opening in center of the latch spring 52 where the opening has a predetermined diameter that is more than the predetermined diameter of the predetermined length of the latch 49 such that the latch spring 52 is received onto the predetermined length of latch 49 that is not received inside the gas chamber channel 99 so that the latch spring 52 slopes toward and the comes in contact with the remaining length, of the latch 49 to allow the latch 49 to compress the latch spring 52 against the end of the compressed gas valve cavity 33 that is adjacent to the gas chamber channel 99. As an alternative, the latch spring 52 can be a wavy shaped washer.

The latch retainer 50 made from metal, metal alloy or polymer material having a predetermined shape. In the embodiment shown in FIG. 17, FIG. 18 and FIG. 19, the latch retainer 50 having a shape that is substantially a washer with a predetermine outside diameter of the latch retainer 50 being substantially the same as the predetermined depth of the latch retainer groove 170 so that the latch retainer 50 is received in the latch retainer groove 170 in the compressed gas valve cavity 33 and with a predetermined inside diameter that is more than the predetermined outside diameter of the remaining length of the latch 49 so that the latch retainer 50 retains the latch 49 to a predetermined location in the compressed gas valve cavity 33 so that one end of the unlatching channel 53 exits into the predetermined length of the latch 49.

As shown in FIG. 17, FIG. 18 and FIG. 19, the piston 34 has a first piston end 133 and a second piston end 134. The piston 34 being made from metal or metal alloy or polymer material having a cylindrical shape with a predetermined exterior length, at the second piston end 134, of a predetermined outside diameter of the piston 34 that is substantially the same as the predetermined inside diameter of compressed gas valve cavity 33 and is substantially larger than the predetermined diameter of the circular opening situated in the barrel extender base 124 to allow the second piston end 134 to be received in the compressed gas valve cavity 33 adjacent to the barrel extender 21 but is prevented from passing through the circular opening situated in the barrel extender base 124; with a remaining exterior length with a predetermined outside diameter of the piston 34 where the predetermined outside diameter of the piston 34 is substantially the same as the predetermined diameter of the circular opening situated in the barrel extender base 124, which is less than the inside diameter of the compressed gas valve cavity 33 and is less than the predetermined outside diameter of the predetermined exterior length of the piston 34, to form an L-shaped ledge along the exterior of the piston 34 that extends from the predetermined exterior length of the piston 34 to the first piston end 133 such that the predetermined exterior length of the piston 34 and the interior of the compressed gas valve cavity 33 are substantially close to each other so that the piston 34 is received inside the compressed gas valve cavity 33; with a piston opening 135 with the piston opening 135 being a circular opening situated in the center of the piston 34 with a predetermined diameter; with a piston seal groove 132 being situated in a predetermined location, substantially close to the second piston end 134, in the predetermined exterior length of the piston 34 with a predetermined width and a predetermined depth; and with a piston vent 36 where the piston vent 36 being an opening with a predetermined shape situated in a predetermined location in the remaining exterior length of the piston 34 that is substantially closer to the second piston end 134 than to the first piston end 133 such that the piston vent 36 provides fluid communication between the piston opening 135 and the exterior of the piston 34 whereby the piston vent 36 vents the compressed gas from the inside of the piston 34 to the outside of the piston 34 into the compressed gas valve cavity 33 and whereby the remaining exterior length of the piston 34, at the first piston end 133, is slidably received in the circular opening situated in the center of the barrel extender base 124 where the circular opening in the barrel extender base 124 retains the piston 34 in the compressed gas valve cavity 33 and guides the piston 34 as it moves within the compressed gas valve cavity 33 and where the predetermined diameter of the predetermined exterior length of the piston 34 limit the piston's 34 travel toward the second barrel end 95 when the predetermined exterior length of the piston 34 is received in the circular cavity in the barrel extender base 124.

As shown in FIG. 17, FIG. 18 and FIG. 19, in this embodiment the piston seal 35 being made from polymer material having the shape of an o-ring with a predetermined inside diameter and a predetermined outside diameter to allow the piston seal 35 to be received in the piston groove 132 such that the predetermined diameter of the predetermined length of the piston 34, at the second piston end 134, places the piston seal 35 in substantial contact with the interior surface of the compressed gas valve cavity 33 to seal the piston 34, at the second piston end 134, such that the compressed gas is prevented from passing between the exterior surface of the piston 34, at the second piston end 134, and the interior surface of the compressed gas valve cavity 33.

As shown in FIG. 17, FIG. 18 and FIG. 19, the striker 37 being made from metal or metal alloy or polymer material having a cylindrical shape with a first striker end 140 and a second striker end 141. The striker 37 comprising a first striker section 136, a second striker section 137 and a striker groove 142. As shown if FIG. 19, the first striker section 136 is situated such that one end of the first striker section 136 is the first striker end 140. The second striker section 137 is situated such that the other end of the first striker section 136 is connected to one end of the second section 137 and such that the other end of the second striker section 137 being the second striker end 141. The striker groove 142 being situated at a predetermined location in the exterior surface of the second striker section 137 with a predetermined width and a predetermined depth. The first striker section 136 having a predetermined length of a predetermined diameter that is less than the predetermined diameter of the opening in the latch 49 such that the first striker section 136 can be received inside the opening in the latch 49 and such that the first striker section 136 can pass through the opening in the barrel seal 28 to allow the first striker end 140 to come into contact with the barrel ball 30 whereby the first striker end 140 pushes the barrel ball 30 along the predetermined horizontal plane to direct the barrel ball 30 toward the first barrel end 94 and away from the barrel seal 28 such that the barrel ball 30 compresses the first barrel spring 31 and such that fluid communication between the first gas chamber 26, the gas chamber channel 99 and compressed gas valve cavity 33 is created to allow the compressed gas to flow from the first gas chamber 26 to the compressed gas valve cavity 33 through the opening in the barrel seal 28 and the opening in the latch 49. The second striker section 137 having a predetermined length of a predetermined diameter such that the predetermined diameter is substantially the same the inside diameter of the piston opening 135 to allow the striker 37 to be received inside the piston opening 135. The striker groove 142 being a channel shaped opening situated in a predetermined location in the exterior surface of the second striker section 137 having a predetermined depth and a predetermined width.

As shown in FIG. 17, FIG. 18 and FIG. 19, the striker seal being made from polymer material having the shape of an o-ring with a predetermined inside diameter and a predetermined outside diameter with the striker seal 38 being received in the striker groove 142 such that the predetermined diameter of the second striker section 137 places the striker seal 38 in substantial contact with the interior surface of the piston opening 135 to seal the striker 37, at the first piston end 133 and at the second striker end 141, to prevent compressed gas from passing between the exterior surface of the striker 37 and the interior surface of the piston opening 135.

As shown in FIG. 19, the spacer 32, the first barrel spring 31 and the barrel ball 30 in combination with the barrel seal 28, the latch 49, the first latch seal 51, the second latch seal 58, the latch spring 52, the latch retainer 50, the unlatch channel 53, the piston 34, the piston seal 35, the striker 37 and the striker seal 38 to cooperate to retain compressed gas at a predetermined pressure in the first gas chamber 26, to cooperate with the firing pin 16 to open the flow path for the compressed gas from the first gas chamber 26 to the compressed gas valve cavity so that the pressure of the compressed gas can interact with the latch 49 to compress the latch spring 52 and with the piston 34 and the striker 37 to push the piston and striker from the first valve assembly position to the second valve assembly position which is past the other exit of the unlatch channel 53 so that compressed gas is allowed to flow from the compressed gas valve cavity 33 to the predetermined length of the latch 49 and to cooperate to close the flow path of the compressed gas so that the compressed gas is once again retained in the first gas chamber 26 and the compressed gas received in the compressed gas valve cavity 33 is vented thru the bore vent 39 so that the means for actuating the slide 162 can move the piston 34 and the striker 37 from the second valve assembly position to the first valve assembly position.

Figure 22:
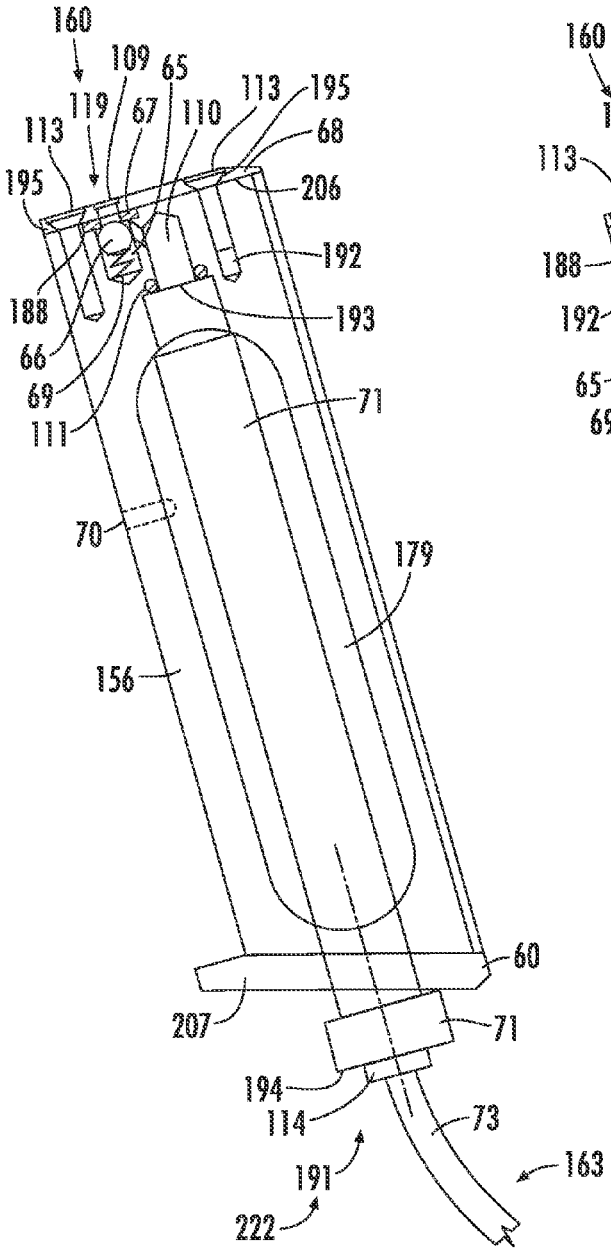
FIG. 22 is a schematic side elevation view of a second embodiment of the simulation magazine unit wherein the simulation magazine unit is adapted to provide a hose connection so that the source of gas supply can be a remote compressed gas supply.

A second embodiment of the simulation magazine unit 60 is shown in FIG. 22 where the compressed gas source means 163 is a remote supply of compressed gas tethered to the weapon simulator 10 by a hose 73. This embodiment allows for a continuous source of compressed gas that can be any of a number of gases, for example CO2, air or nitrogen, that can be provided at various pressures, for example 6.9 bars (100 psi). In this embodiment, the simulation magazine unit 60 comprises a magazine frame 156, a magazine valve assembly 119, a means for receiving the compressed gas from source 222 and a compressed gas source means 163 where the means for receiving the compressed gas from source 222 comprises a gas connection means 191 and where the compressed gas source means 163 comprises a remote supply of compressed gas connected the gas connection means 191. In this embodiment, the gas connection means comprises a hose 73 and at least one hose connector 114 where one end of the hose 73 is connected to the source of compressed gas and the other end of the hose 73 is connected to the hose connector 114 with predetermined threads situated along the exterior of the hose connector. The magazine valve assembly 119 and the gas connection means 191 are received in the magazine frame 156 so that the combination of the magazine frame 156, the magazine valve assembly 119 and the gas connection means 191 can be inserted and removed from the frame 11 as a single unit as a replacement for the original magazine. The remote supply of compressed gas being connected to the magazine frame 156 by the gas connection means 191 prior to the magazine frame 156 being inserted into the frame 11 whereby the combination of the remote supply of compressed gas and the gas connection means 191 cooperate to provide the source of compressed gas to power the weapon simulator 10. The gas connection means 191 connects the remote supply of compressed gas with the magazine valve assembly 119 so that compressed gas from the remote supply of compressed gas is allowed to flow into the magazine valve assembly 119 where the pressure of the compressed gas it is contained by the magazine valve assembly 119. When the magazine frame 156, with the remote supply of compressed gas is connected to the magazine frame 156 by the gas connection means 191, is inserted into the frame 11, the magazine valve assembly 119 sealably mates with the barrel 20 at the mating pin 24 to allow the compressed gas to flow from the magazine valve assembly 119 into the compressed gas valve means 157. As shown in FIG. 22, this embodiment for the magazine frame 156 being made from metal or metal alloy having a magazine frame top 206 and a magazine frame bottom 207 where the magazine frame top 206 with a predetermined shape to allow the magazine frame top 206 to be inserted first into the frame 11 such that the magazine frame top 206 mates with the barrel 20 and the magazine frame bottom 207 with a predetermined shape such that the magazine frame bottom 207 is flush with the frame 11 when the magazine frame 156 is fully received in the frame 11. The magazine frame 156 having a predetermined shape that is substantially rectangular so that the magazine frame 156 can be inserted into the frame 11 of the weapon simulator 10. As shown in FIG. 22, the magazine frame 156 having a magazine catch slot 70, a plurality of magazine valve seal keeper threaded openings 192, a magazine valve cavity 65, a magazine gas chamber 110, a gas supply opening 179, a magazine gas chamber seal 111 and a hose coupler 71. The magazine slot 70 having a predetermined shape that is situated in a predetermined location in the magazine frame 156 such that the magazine slot 70 cooperates with the magazine catch 13 to removably retain the simulation magazine unit 60 to in the frame 11. The plurality of magazine valve seal keeper threaded openings 192 having a predetermined inside diameter and are situated in predetermined locations in the magazine frame top 206 with a plurality of threads situated along the interior of the plurality of magazine valve seal keeper threaded openings 192. The magazine valve cavity 65 having a predetermined shape and is situated in a predetermined location in the magazine frame 156. In the preferred embodiment, the magazine valve cavity 65 being substantially cylindrical in shape with a predetermined exterior length of a predetermined inside diameter such that the predetermined exterior length of the magazine valve cavity 65 begins at the magazine frame top 206 and with a remaining exterior length of a predetermined inside diameter that is less than the predetermined diameter of the predetermined exterior length of the magazine valve cavity 65. The magazine gas chamber 110 having a predetermined shape with a predetermined inside dimension that is situated in a predetermined location in the magazine frame 156 such that one end of the magazine gas chamber 110 is in fluid communication with the magazine valve cavity 65 and the other end is in fluid communication with the hose coupler 71. In the preferred embodiment of the magazine gas chamber 110 as shown in FIG. 20, the magazine gas chamber 110 receives the hose coupler 71 at one end and enters the side of the magazine valve cavity 65 with a predetermined opening of a predetermined dimension at the end that is opposite from the end that receives the hose coupler 71. As shown in FIG. 22, the gas supply opening 179 having a predetermined shape that is situated in a predetermined location in the magazine frame 156 that is substantially in the center of the magazine frame 156 such that the hose coupler 71 passes through the gas supply opening 179. As shown in FIG. 22, the hose coupler 71 being made from metal or metal alloy material having a hose coupler first end 193 and a hose coupler second end 194. The hose coupler 71 having a substantially tubular shape with a predetermined outside diameter that varies between the hose coupler first end 193 and the hose coupler second end 194. The hose coupler first end 193 is received in the magazine gas chamber 110. The hose coupler second end 194 extends out the magazine frame bottom 207 having a threaded opening of a predetermined diameter to receive and mate with the threads on the exterior of the hose connector 114 that is attached to the hose 73 from the remote supply of compressed gas whereby the hose coupler second end 194, the hose connector 114 and the hose 73 cooperate to attach the simulation magazine unit 60 to the remote supply of compressed gas. As shown in FIG. 22, the magazine gas chamber seal 111 being made from polymer material having the shape of an o-ring with a predetermined outside diameter that is more than the predetermined dimension of the magazine gas chamber 110 and an opening with a predetermined inside diameter that is less than the predetermined outside diameter of the hose coupler first end 193 where the hose coupler first end 193 being received in the magazine gas chamber 110 such that the magazine gas chamber seal 111 cooperates with the magazine gas chamber 110 and the hose coupler first end 193 to prevent compressed gas from leaking around the connection between the magazine gas chamber 110 and the hose coupler first end 193. Shown in FIG. 22 is the magazine valve assembly 119 being received in the magazine valve cavity 65. As shown in FIG. 22, the magazine valve assembly 119 comprises a magazine valve seal keeper 68, a plurality of magazine valve seal keeper screws 113, a magazine valve seal 67, a magazine valve ball 66 and a magazine valve spring 69. The magazine valve spring 69 is optional and not required in all cases. The magazine valve seal keeper 68 being made from metal or metal alloy with a magazine valve seal keeper first side 185 and a magazine valve seal keeper second side 186. In this embodiment, the magazine valve seal keeper 68 having a predetermined shape such that the magazine valve seal keeper second side 186 is adjacent to the magazine frame top 206 so that the magazine valve seal keeper 68 covers magazine frame top 206, having a plurality of magazine valve seal keeper screw openings 195 with a predetermined shape that is substantially a countersink shape with the larger part of the countersink shape being situated in the magazine valve seal keeper first side 185 and having a magazine valve mating receptacle 109 with a predetermined shape situated in a predetermined location in the magazine valve seal keeper 68 where the predetermined shape in the this embodiment is a countersink shape with the largest diameter of the magazine valve mating receptacle 109 is situated at the magazine valve seal keeper first side 185 and where the smallest diameter of the countersink shape of the magazine valve mating receptacle 109 is situated at the magazine valve seal keeper second side 186 such that the smallest diameter of the magazine valve mating receptacle 109 is substantially the same as the predetermined outside diameter of the mating pin 24 and where the predetermined location in the this embodiment is such that the mating pin 24 is received the magazine valve mating receptacle 109 when the magazine frame 156 is received in the frame 11 of the weapon simulator 10. In this embodiment, the magazine valve seal keeper 68 is retained on the magazine frame 156 by a plurality of magazine valve seal keeper screws 113. The plurality of magazine valve seal keeper screws 113 being made from metal or metal alloy material and having a predetermined shape that is substantially that of a countersink screw where the plurality of magazine valve seal keeper screws 113 are being received in the plurality of magazine valve seal keeper openings 195 in the magazine valve seal keeper 68 and in the plurality of magazine seal keeper threaded openings 192 in the magazine frame top 206 of the magazine frame 156 to attach the magazine seal keeper 68 to the magazine frame 156. As shown if FIG. 22, the magazine valve seal 67 being made from polymer material having a magazine valve seal first side 187 and a magazine valve seal second side 188 with a predetermined shape that is substantially the shape of a washer with a predetermined outside diameter that is substantially the same as the predetermined inside diameter of the predetermined length of the magazine valve cavity 65 where the magazine valve seal 67 being received in the predetermined length of the magazine valve cavity 65 such that the magazine valve seal first side 187 is adjacent to the magazine valve seal keeper second side 186 so that the magazine valve seal keeper 68 retains the magazine valve seal 67 within the magazine valve cavity 65 and with an opening in the center of the magazine valve seal 67 with a predetermined inside diameter that is less than the predetermined outside diameter of the mating pin 24 where the mating pin 24 is received in the opening in the center of the magazine valve seal 67 such that the magazine valve seal 67 seals around the outside of the mating pin 24 to prevent compressed gas from escaping around the outside of the mating pin 24 when the mating pin 24 is received in the magazine valve mating receptacle 109. The magazine valve ball 66 being made from metal or metal alloy or polymer material having a spherical shape with a predetermined diameter that is less than the predetermined inside dimensions of the magazine valve cavity 65 where the magazine valve ball 66 being received within the magazine valve cavity 65 and that is more than the predetermined inside diameter of the opening in the center of the magazine valve seal 67 such that the magazine valve ball 66 is adjacent to and in contact with the magazine valve seal second side 188. The magazine valve spring 69 being made from metal or metal alloy material having a predetermined shape that is substantially a helix shape with a predetermined inside diameter that is less than the predetermined diameter of the magazine valve ball 66 and having a predetermined outside diameter of the magazine valve spring 69 that is less than the predetermined inside diameter of the magazine valve cavity 65 such that the magazine valve spring 69 is received in the remaining external length of the magazine valve cavity 65 and is in substantial contact with one end of the magazine valve spring 69 such that the combination of the end of the magazine valve cavity 65 and the magazine valve spring 69 cooperate to push on the magazine valve ball 66 in a predetermined direction where the predetermined direction is substantially toward the magazine valve seal 67.

Figure 23:
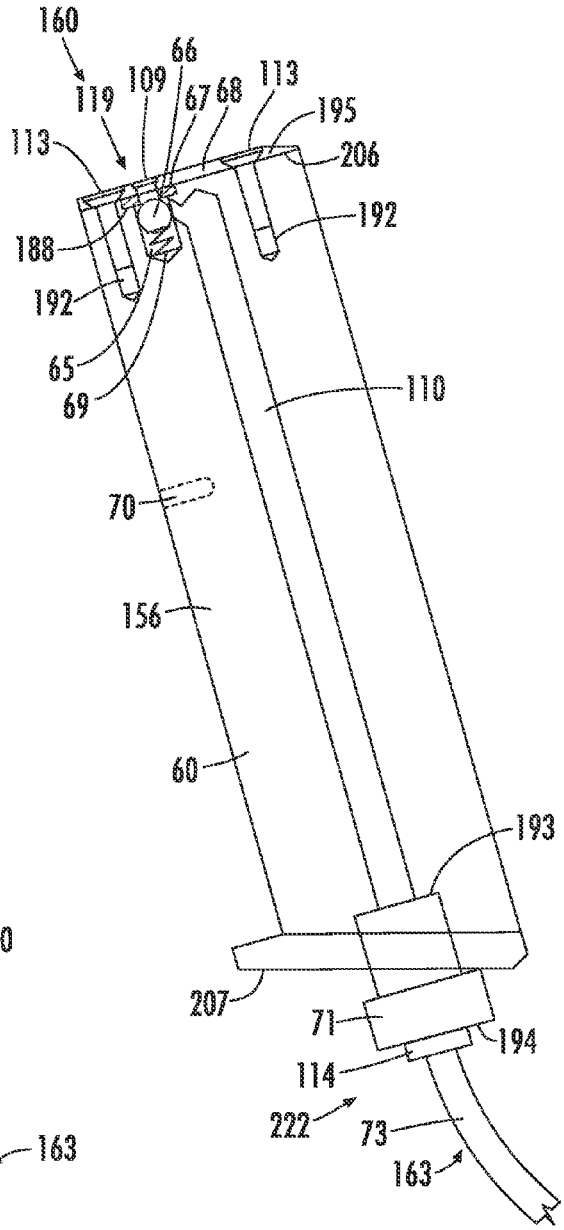
FIG. 23 is a schematic side elevation view of a third embodiment of the simulation magazine unit wherein the simulation magazine unit is adapted to provide a hose connection so that the source of gas supply can be a remote compressed gas supply.

A third embodiment of the simulation magazine unit 60 is shown in FIG. 23, where the supply gas opening 179 in the magazine frame 156 and the magazine gas chamber seal 111 have been eliminated. In this embodiment, the magazine gas chamber 110 is extended in the solid magazine frame 156 to a predetermined location near the bottom of the magazine frame 156 and the hose coupler 71 is situated in the magazine frame 156 so that the hose coupler 71 is in fluid communication with the magazine gas chamber 110. The remaining functionality found in the second embodiment of the simulation magazine unit 60 is retained in this embodiment of the simulation magazine unit 60.

A fourth embodiment of the simulation magazine unit 60 is shown in FIG. 24 where the compressed gas source means 163 that provides the energy to operate the weapon simulator 10 is a remote source of high pressure gas that is received and retained in the simulation magazine unit 60. The simulation magazine unit 60 comprises a magazine frame 156, a magazine valve assembly 119, a means for receiving the compressed gas from source 222 and a compressed gas source means 163 where the means for receiving the compressed gas from source 222 comprises a high pressure gas filling means 116. In this embodiment, the compressed gas is preferably CO2 compressed to pressures of around 68.9 bars (1000 psi), that will provide between fifteen (15) to thirty (30) simulated rounds of operating the slide mechanism 123. The compressed gas source means 163 utilized with this embodiment of the simulation magazine unit 60 is a remote supply of high pressure gas that is temporarily connected to the simulation magazine unit 60 through the high pressure gas filling means 116 such that the compressed gas flow from the remote source of high pressure compressed gas through the high pressure gas filling means 116 into the simulation magazine unit 60 where the compressed gas is retained. The high pressure gas filling means 116 comprises a hose 73, a pair of hose connectors 114 and a high pressure gas filling connector 115 to fill compressed gas into the simulation magazine unit 60. The hose 73 having a first hose end and a second hose end. The pair of hose connectors 114 being received on the first hose end and the second hose end such that the first hose end with the hose connector 114 is connected to the remote source of high pressure compressed gas. The high pressure gas filling connector 115 being made from metal or metal alloy or polymer having a predetermined shape such that the high pressure gas filling connector receives the other of the pair of hose connectors 114 in a predetermined location to connect the second hose end to the high pressure filling connector, having a fill nipple 74 and having an opening that provides fluid communication between the hose connector 114 to the fill nipple 74. As shown in FIG. 24, the fill nipple 74 being made from metal or metal alloy or polymer material and being substantially cylindrical in shape with a predetermined length of a predetermined outside diameter, the fill nipple 74 having a fill nipple first end 200 where the fill nipple first end 200 is attached to the high pressure gas fill connector 114 such that the fill nipple 74 extends outward from the high pressure gas fill connector 114 at a predetermined angle where the predetermined angle is substantially a 90 degree angle, having a fill nipple second end 201 with a predetermined shape that is substantially a sine wave shaped curvature where the sine wave has a predetermined height between the top of the sine wave and the bottom of the sine wave and a predetermined distance between the top of the sine wave and the bottom of the sine wave and has a predetermined radius of the curvature of the fill nipple second end 201 and having a fill nipple orifice 202 located in the center of the fill nipple 74 with a predetermined outside diameter such that the fill nipple orifice 202 and the opening in the high pressure gas fill connector 114 cooperate to provide fluid communication from the remote source of high pressure compressed gas to the fill nipple second end 201 such that the hose 73, the pair of hose connectors 114 and the high pressure gas filling connector cooperate to allow compressed gas flows from the remote source of high pressure compressed gas through the fill nipple orifice 202 at the fill nipple second end 201.

As shown in FIG. 24, this embodiment of the simulation magazine unit 60 comprises a magazine frame 156, a high pressure gas storage means 118, a magazine valve assembly 119, a shot counting means 196, a slide catch means 197, a remote communication means 198 and a magazine power means 199. The high pressure gas storage means 118, the magazine valve assembly 119, the shot counting means 196, the slide catch means 197, the remote communication means 198 and the magazine power means 199 are received in the magazine frame 156 so that the combination of the magazine frame 156, the high pressure gas storage means 118, the magazine valve assembly 119, the shot counting means 196, the slide catch means 197, the remote communication means 198 and the magazine power means 199 can be inserted and removed from the frame 11 as a single unit as a replacement for the original magazine.

When the magazine frame 156, with the high pressure gas storage means 118 filled with compressed gas, is inserted into the frame 11, the magazine valve assembly 119 sealably mates with the barrel 20 of the barrel unit 91 at the mating pin 24 to allow the compressed gas to flow from the high pressure gas storage means 118 into the compressed gas valve means 157. As shown in FIG. 24, this embodiment for the magazine frame 156 is made from metal or metal alloy having a magazine frame top 206 and a magazine frame bottom 207 where the magazine frame top 206 having a predetermined shape to allow the magazine frame top 206 to be inserted first into the frame 11 such that the magazine frame top 206 mates with the barrel 20 and the magazine frame bottom 207 having a predetermined shape such that the magazine frame bottom 207 is flush with the frame 11 when the magazine frame 156 is fully received in the frame 11. The magazine frame 156 having a predetermined shape that is substantially rectangular so that the magazine frame 156 can be inserted into the frame 11 of the weapon simulator 10, having a magazine catch slot 70 and having a plurality of openings in the magazine frame 156 to receive the high pressure gas storage means 118, the magazine valve assembly 119, the shot counting means 196, the slide catch means 197, the remote communication means 198 and the magazine power means 199. The magazine slot 70 having a predetermined shape that is situated in a predetermined location in the magazine frame 156 such that the magazine slot 70 cooperates with the magazine catch 13 to removably retain the simulation magazine unit 60 to in the frame 11. As shown in FIG. 24, the high pressure gas storage means 118 in this embodiment comprises a high pressure gas housing 120 being made from metal or metal alloy material having a predetermined shape such that the high pressure gas housing 120 being situated in a predetermined location in the magazine frame 156. The high pressure gas housing 120 having a high pressure gas chamber 62, a high pressure gas channel 117, a magazine valve cavity 65 and a plurality of high pressure gas housing body threads 203. The high pressure gas chamber 62 having a predetermined shape and is situated in a predetermined location in the high pressure gas housing 120. As shown in FIG. 24, in the preferred embodiment the high pressure gas chamber 62 being rectangular in shape with a predetermined inside dimensions to provide a predetermined volume for storage of high pressure gas in the high pressure gas housing 120. The high pressure gas channel 117 having a predetermined shape that is substantially cylindrical with a predetermined inside diameter situated in a predetermined location in the high pressure gas housing 120 where one end of the high pressure gas channel 117 is in fluid communication with the high pressure gas chamber 62. The magazine valve cavity 65 having a predetermined shape and is situated in a predetermined location in the high pressure gas housing 120 such that one end of the magazine valve cavity 65 is adjacent to and in fluid communication with the end of the high pressure gas channel 117 that is opposite the end that is in fluid communication with the high pressure gas chamber 62 such that compressed gas flows between the high pressure gas chamber 62 and the magazine valve cavity 65 through the high pressure gas channel 117. In this embodiment, the magazine valve cavity 65 being substantially cylindrical in shape with a predetermined length of a predetermined inside diameter and with a remaining length of a predetermined inside diameter that is less than the predetermined diameter of the predetermined length of the magazine valve cavity 65 where the end of the magazine valve cavity 65, that is in fluid communication with the high pressure gas channel 117, is situated in the remaining length of the magazine valve cavity 65. The plurality of high pressure gas housing body threads 203 are situated in a predetermined location on the high pressure gas housing 120. In the embodiment shown in FIG. 24, the plurality of high pressure gas housing body threads 203 are situated along the exterior of the high pressure gas housing 120 that contains the magazine valve cavity 65 and the high pressure gas channel 117.

In the embodiment shown in FIG. 24, the magazine valve assembly 119 comprises a magazine valve seal keeper 68, a magazine valve seal 67, a magazine valve ball 66 and a magazine valve spring 69. The magazine valve seal keeper 68 being made from metal or metal alloy having a magazine valve seal keeper first side 185 and having a magazine valve seal keeper second side 186. The magazine valve seal keeper 68 having a predetermined shape that is substantially cylindrical in shape with a predetermined length of a predetermined outside diameter; having a magazine valve seal keeper cavity 204 situated in the magazine valve seal keeper second side 186 that is substantially cylindrical in shape with a predetermined inside diameter that is less than the predetermined diameter of the predetermined length of the magazine valve seal keeper 68, with a magazine valve seal keeper cavity bottom 205 and with a plurality of threads situated along the interior of the predetermined length of the magazine valve seal keeper cavity 204 such that the plurality of threads in the magazine valve seal keeper cavity 204 mate with the plurality of high pressure gas housing body threads 203 to attach the magazine valve seal keeper 68 to the exterior of the high pressure gas housing 120 so that the magazine valve seal keeper 68 is received onto the high pressure gas housing 120 where the magazine valve seal keeper first side 185 is flush with the magazine frame top 206; and having a magazine valve mating receptacle 109 with a predetermined shape situated in a predetermined location in the magazine valve seal keeper 68 such that the magazine valve mating receptacle 109 can receive the mating pin 24 where the predetermined shape in this embodiment is a cylindrical countersink shape with the largest diameter of the magazine valve mating receptacle 109 being situated at the magazine valve seal keeper first side 185 and where the smallest diameter of the magazine valve mating receptacle 109 being situated at the magazine valve seal keeper cavity bottom 205 and where the predetermined location in this embodiment is such that the center of the magazine valve mating receptacle 109 is aligned with the center of the magazine valve seal keeper 68 where the smallest diameter of the magazine valve mating receptacle 109 is substantially the same as the predetermined outside diameter of the mating pin 24 such that the mating pin 24 is received the magazine valve mating receptacle 109 when the magazine frame 156 is received in the frame 11 of the weapon simulator 10. As shown if FIG. 24, the magazine valve seal 67 being made from polymer material having a magazine valve seal first side 187 and a magazine valve seal second side 188 with a predetermined shape that is substantially the shape of a washer with a predetermined outside diameter that is substantially the same as the predetermined inside diameter of the predetermined length of the magazine valve cavity 65 where the magazine valve seal 67 being received in the predetermined length of the magazine valve cavity 65 such that the magazine valve seal first side 187 is adjacent to the magazine valve seal keeper cavity bottom 205 so that the magazine valve seal keeper 68 retains the magazine valve seal 67 within the magazine valve cavity 65 and with an opening in the center of the magazine valve seal 67 with a predetermined inside diameter that is less than the predetermined outside diameter of the mating pin 24 where the mating pin 24 is received in the opening in the center of the magazine valve seal 67 such that the magazine valve seal 67 seals around the outside of the mating pin 24 to prevent compressed gas from escaping around the outside of the mating pin 24 when the mating pin 24 is received in the magazine valve mating receptacle 109. The magazine valve ball 66 being made from metal or metal alloy or polymer material having a spherical shape with a predetermined diameter that is less than the predetermined inside diameter of the remaining length of the magazine valve cavity 65 where the magazine valve ball 66 being received within the remaining length the magazine valve cavity 65 and that is more than the predetermined inside diameter of the opening in the center of the magazine valve seal 67 such that the magazine valve ball 66 is adjacent to and in contact with the magazine valve seal second side 188. The magazine valve spring 69 being made from metal or metal alloy material having a predetermined shape that is substantially a helix shape with a predetermined inside diameter that is less than the predetermined diameter of the magazine valve ball 66 and having a predetermined outside diameter of the magazine valve spring 69 that is less than the predetermined inside diameter of the remaining length of the magazine valve cavity 65 such that the magazine valve spring 69 being received in the remaining length of the magazine valve cavity 65 adjacent to the high pressure gas channel 117 such that the combination of the end of magazine valve cavity 65 and the magazine valve spring 69 cooperates to push on the magazine valve ball 66 in a predetermined direction where the predetermined direction is substantially toward the magazine valve seal 67.

As shown in FIG. 24, this embodiment of the simulation magazine unit 60 having a shot counting means 196 that counts the number of shots fired by the weapon simulator 10 to provide a predetermined output when a predefined number of shots are counted by the shot counting means 196. Once the predefined numbers of shots have been counted by the shot counting means 196, the shot counting means 196 provides an input to the slide catch means 197 to cause the slide catch means 197 to interact with the slide latch 14 to catch the slide 12 in the open position. The remote communication means 198 contained in the simulation magazine unit 60 provides an interface with a remote supervisory system to transmit information from the weapon simulator 10 such as when the weapon simulator fires a shot and when the weapon simulator 10 has fired a predetermined number of shots and the slide is latched in the open position. The shot counting means 196, the slide catch means 197 and the remote communication means 198 are powered by the magazine power means 199 where the magazine power means 199 is rechargeable by an external charger. As shown in FIG. 24, one embodiment of the shot counting means 196 comprises a microprocessor 76, a magazine proximity switch 77, and a vibration sensor 79. The microprocessor 76 and the vibration sensor 79 are mounted to a circuit board 75 where the circuit board 75 is received in the magazine frame 156 in a predetermined location. The magazine proximity switch 77 situated in a predetermined location in the magazine frame 156 so that the magazine proximity switch 77 is actuated when the simulation magazine unit 60 is inserted into the frame 11 such that when the simulation magazine unit 60 is received in the frame 11 the magazine proximity switch 77 allows electricity from the magazine power means 199 to flow to the microprocessor 76 to activate the microprocessor 76. The vibration of the slide mechanism 123 moving the slide 12 from its rest position to the open position activates the vibration sensor 79 so that the vibration sensor 79 provides an input to the microprocessor 76 whereby the microprocessor 76 counts the input from the vibration sensor 79 as a shot fired by the weapon simulator 10. In an alternative embodiment, the vibration sensor 79 is replaced by a slide proximity switch 78 where the slide proximity switch 78 is situated in the magazine frame 156 such that the sensor part of the slide proximity switch 78 extends beyond the magazine frame top 206 to allow the slide proximity switch 78 to interact with the slide 12 such that the slide proximity switch 78 provides an input to the microprocessor 76 each time the slide 12 moves from its rest position to its open position then back to its rest position whereby the microprocessor 76 counts the input from the slide proximity switch 78 as a shot fired by the weapon simulator 10.

In the embodiment shown in FIG. 24, the slide catch means 197 comprises a gear motor 85, a transmission 86, a drive nut 87, a slide catch riser spring 89 and a slide catch riser 90. Once the microprocessor 76 has counted the predetermined number of shots, based upon the input of either the vibration sensor 79 or the slide proximity switch 78, then the microprocessor 76 activates the gear motor 85 where the gear motor 85 drives the transmission 86. The transmission 86 causes the drive nut 87; where the drive nut 87 having a predetermined outside dimension is received on the plurality of high pressure gas housing body threads 203; to rotate on the plurality of high gas housing body threads 203 to move the drive nut 87 toward the top of the magazine frame 156. The slide catch riser spring 89 is situated between the drive nut 87 and the slide catch riser 90. The slide catch riser spring 89 being made from metal or metal alloy material having a predetermined shape that is substantially a spiral shape with a predetermined inside diameter that is more than the plurality of high pressure gas housing body threads and having a predetermined outside diameter of the slide catch riser spring 89 that is less than the predetermined outside dimension of the drive nut 87 such that as the drive nut 87 is driven toward the top of the magazine frame 156 by the transmission 86 the drive nut 87 compresses the slide catch riser spring 89 against the slide catch riser 90. As the drive nut 87 cooperates with the slide catch riser spring 89 to put pressure on the slide catch riser 90 such that the slide catch riser 90 is pushed through the magazine frame top 206 so that the slide catch riser 90 interacts with the slide catch 14. When the slide mechanism 123 causes the slide 12 to move from its rest position to its open position, the slide catch riser 90 causes the slide catch 14 to catch the slide 12 in its open position in response to the predefined number of shots has been fired by the weapon simulator 10. By actuating the gear motor 85 in the opposite direction, the transmission moves the drive nut 87 away from the top of the magazine frame 156 which releases the tension from the slide catch riser spring 89 on the slide catch riser 90 such that the slide catch 14 can push the slide catch riser 90 back down into the magazine frame 156 and release the slide 12 to allow the slide 12 to return to its rest position.

The remote communication means 198 is received in the magazine frame 156 to provide an interface with a remote supervisory system to transmit information from the weapon simulator 10 such as when the weapon simulator fires a shot and when the weapon simulator 10 has fired a predetermined number of shots and the slide is latched in the open position to a remote supervisory control and data acquisition (SCADA) system. As shown in FIG. 24, remote communication means 198 in this embodiment comprises a radio transmitter module 81 and an antenna 82. Other configurations of the remote communication means 198 may be utilized to transmit information from the weapon simulator to the remote SCADA system. The radio transmitter module 81 receives inputs from the microprocessor 76 where the radio transmitter 81 converts the inputs from the microprocessor 76 into radio signals and transmits these radio signals over the antenna 82. The radio transmitter module 81 is electrically and physically connected to the circuit board 75 in a predetermined position so that the radio transmitter 81 receives an electrical input from the microprocessor 76 and electricity from the magazine power means 199 is allowed to flow to the radio transmitter module 81 to power the radio transmitter module 81.

The magazine power means 199 is received in the magazine frame 156 to provide electricity to the electrical components received in the simulation magazine unit 60. As shown in FIG. 24, the magazine power means 199 provides electrical power to the magazine proximity switch 77, the microprocessor 76, either the vibration sensor 79 or the slide proximity switch 78, the radio transmitter module 81 and the gear motor 85 and comprises a magazine battery 83, a power module 208, a light emitting diode 80 and a magazine battery charging plug 84. A remote battery charger that plugs in to a standard 120-volt receptacle has a male plug that is received in the magazine battery charging plug 84 to charge the magazine battery 83. The magazine battery charging plug 84 is received in a predetermined location the magazine frame bottom 207 such that the magazine battery charging plug 84 can receive the male plug from the remote battery charger. The magazine battery charging plug 84 is electrically connected to the magazine battery 83 such that it allows electrical current to flow from the remote charger through the magazine battery charging plug 84 into the magazine battery 83 to charge the magazine battery 83. The magazine battery 83 is received in the magazine frame 156 in a predetermined location and is electrically connected to the power module 208. The power module 208 is physically and electrically connected in a predetermined location on the circuit board 75 so that the power module 84 receives a predetermined level of electricity from the magazine battery 83 and allows predetermined level of electricity to flow to each electrical powered component in the simulation magazine unit 60. The light emitting diode 80 is electrically connected to the power module 208 to receive a predetermined level of electricity from the power module 208 so that the light emitting diode 80 provides a visual indication that the magazine battery 83 is providing an acceptable level of voltage whereby the shooter knows when the magazine battery 83 is not providing an acceptable level of voltage and needs to be connected to the remote battery charger to charge the magazine battery 83. The light emitting diode 80 is located in a predetermined location on the circuit board 75 so that it can be electrically connected to the power module 208 and in a predetermined location in the magazine frame 156 so that the light emitting diode 80 can be seen when the simulation magazine unit 60 is received in the frame 11.

Figure 25:
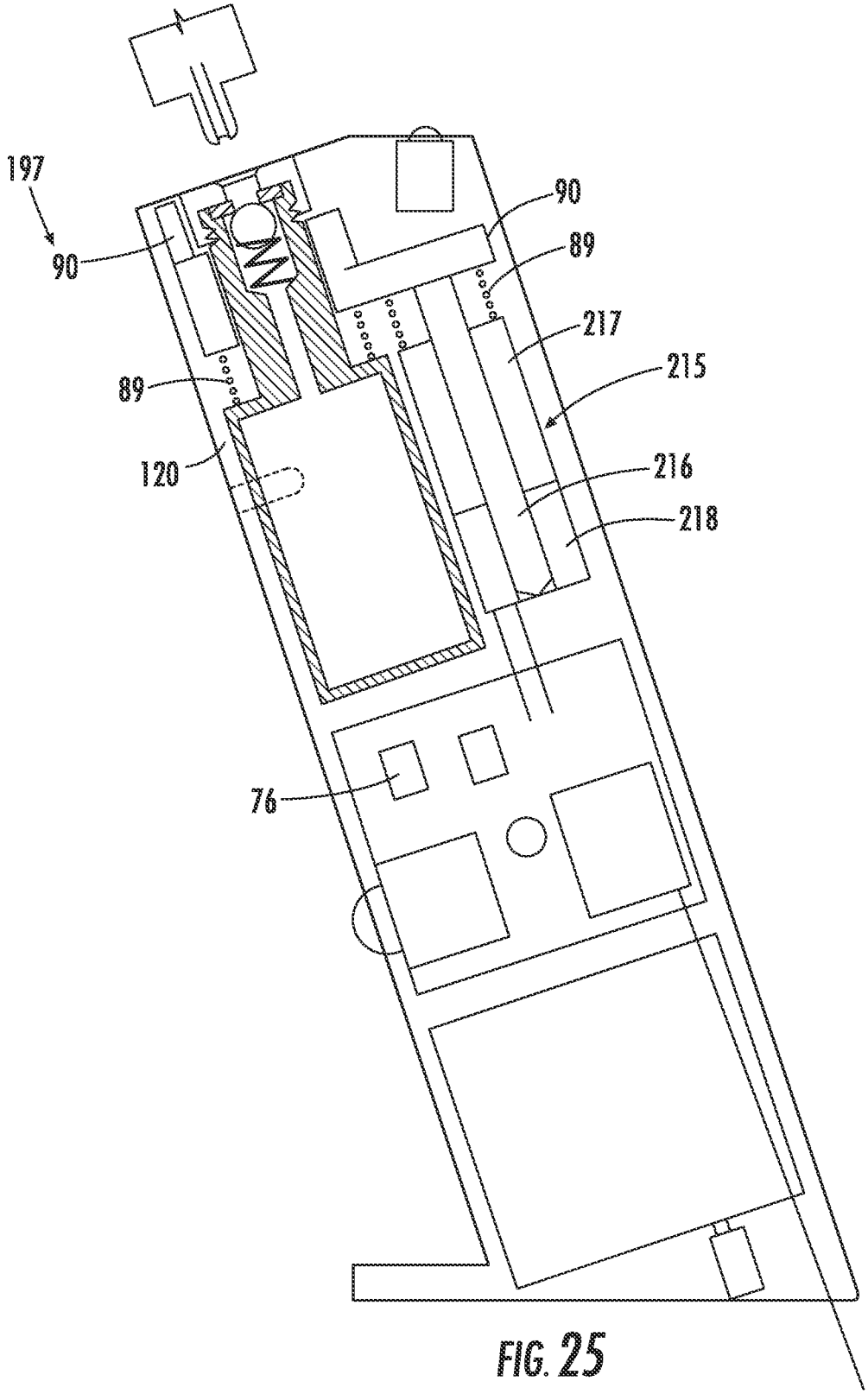
FIG. 25 is a schematic side elevation view of a fifth embodiment of the simulation magazine unit wherein the simulation magazine unit contains a highly compressed gas storage means that is refillable, a slide catch means, a remote communication means and a magazine power means that is rechargeable wherein the slide catch means contains a latching solenoid, a slide catch riser spring and a slide catch riser.

A fifth embodiment of the magazine unit 60 is shown in FIG. 25. This embodiment has the same features as the embodiment shown in FIG. 24, except the slide catch means 197 comprises a latching solenoid 215, a plurality of slide catch riser springs 89 and a slide catch riser 90. The latching solenoid 215 having a latching solenoid plunger 216, a latching solenoid coil 217 and at least one latching solenoid magnet 218. The latching solenoid plunger 216 has two stable positions, a captured position and a released position. The latching solenoid plunger 216 will remain in either of these positions without consuming any electrical power. The latching solenoid plunger 216 slidably moves between the captured position and the released position inside the latching solenoid coil 217. The captured position is where the latching solenoid plunger 216 is fully received inside the de-energized latching solenoid coil 217 and held in this location by the latching solenoid magnet 218. The released position is where the latching plunger 216 is fully extended outside of the latching solenoid coil 217. The latching solenoid plunger 216 is moved from the captured position to the released position when a short impulse of power is applied to the latching solenoid coil 217 that both neutralizes the plurality of latching solenoid magnets 218 and develops a magnetic force to allow the latching solenoid plunger 216 to be moved from being fully received inside the latching solenoid coil 217 to being fully extended outside the latching solenoid coil 217. The latching solenoid plunger 216 is moved from the released position to the captured position by manually pushing the latching solenoid plunger 216 from being fully extended outside the latching solenoid coil 217 to being fully received inside the latching solenoid coil 217 to allow the latching solenoid magnet 218 to hold the latching solenoid plunger 216 in the captured position. The end of the latching solenoid plunger 216 that extends outside of the latching solenoid coil 217 is coupled to the slide catch riser 90 such that the plurality of slide catch riser springs 89 are situated in a predetermined position between the latching solenoid 215 and the slide catch riser 90 and situated in a predetermined position between the high pressure gas housing 120 and the slide catch riser 90 where the catch riser springs 89 are compressed when the latching solenoid plunger 216 is in the captured position so as to place a predetermined amount of force on the combination of the slide catch riser 90 and the latching solenoid plunger 216 that is less than the force placed upon the latching solenoid plunger 216 by the latching solenoid magnet 218 so that the latching solenoid magnet 218 hold the latching solenoid plunger in the captured position and where the catch riser springs 89 aid the latching solenoid coil 217 to move the combination of the slide catch riser 90 and the latching solenoid plunger 216 to the released position when a pulse of electrical power is applied to the latching solenoid coil 217. In alternative embodiments, a single catch riser spring 89 can be situated between the slide catch riser 90 and the high pressure gas housing 120 or be situated between the slide catch riser 90 and the latching solenoid 215.

Once the microprocessor 76 has counted the predetermined number of shots, based upon the input of either the vibration sensor 79 or the slide proximity switch 78, then the microprocessor 76 provides a pulse of electrical power to the latching solenoid coil 217 that neutralizes the latching solenoid magnet 218 and develops a magnetic force, aided by the catch riser spring 89, to move the latching solenoid plunger 216 from its captured position to its released position. As the latching solenoid coil 217 cooperates with the slide catch riser spring 89 to put pressure on the combination of the latching solenoid plunger 216 and the slide catch riser 90 such that the slide catch riser 90 is pushed through the magazine frame top 206 so that the slide catch riser 90 interacts with the slide catch 14. When the slide mechanism 123 causes the slide 12 to move from its rest position to its open position, the slide catch riser 90 causes the slide catch 14 to catch the slide 12 in its open position in response to the predefined number of shots having been fired by the weapon simulator 10, just like a pistol would normally do when the last round is fired from it. Once the slide 12 has been held in its open position, the shooter has to remove the simulation magazine unit 60 and manually depress the slide catch riser 90 back down into the simulation magazine unit 60, which pushes the latching solenoid plunger 216 back to its captured position where the latching solenoid magnet 218 hold the combination of the latching solenoid plunger 216 and the slide catch riser 90 in place inside the simulation magazine unit 60 and compresses the catch riser spring 89. The shooter can then reinsert the simulation magazine unit 60 back into the weapon simulator 10 in order to release the slide 12 to allow the slide 12 to return to its rest position. This simulates real life shooting where the shooter would remove the emptied magazine and manually load rounds of ammunition into the magazine and reinsert the refilled magazine into the pistol. This embodiment extends the time before the magazine power means requires recharging due to using less power to activate the slide catch riser 90. In alternative embodiments, the placement of the latching solenoid 215 within the simulation magazine unit 60 can be in other predetermined locations than shown in FIG. 25. In order to accommodate the other predetermined locations of the latching solenoid 215 within the simulation magazine unit 60, the slide catch riser 90 has an alternate predetermined shape that allows the slide catch riser 90 to be coupled to the latch solenoid plunger 216 of the latching solenoid 215.

Whereas, the present invention has been described in relation to the drawings attached hereto, it should be understood that other and further modifications, apart from those shown or suggested herein, may be made within the spirit and scope of this invention.

What is claimed is:

1. An apparatus for non-permanent conversion of a semiautomatic pistol into a compressed gas powered weapon simulator for simulated shooting, comprising:

the semiautomatic pistol including a combination of actual firearm components and a plurality of simulated firing components including a simulated barrel unit and a simulated magazine unit;

the simulated magazine unit including a $CO_2$ reservoir, a magazine fluid passage interconnecting the reservoir with a magazine fluid exit, and a valve means for blocking fluid flow through the fluid exit;

the simulated barrel unit including a rigid extension portion having an extension fluid passage therethrough, the extension fluid passage having a terminal end partially engaged with the fluid exit of the magazine such that an irregularly shaped connector tip of the terminal end partially engages and maintains the valve positioned with the magazine fluid exit in a metered open position; and wherein the valve means in the magazine unit is a resiliently mounted ball valve and the connector tip includes an annular terminal end engaging the ball and having a non-sealing sine wave surface pattern contacting the ball and permitting a controlled flow quantity to be metered from the reservoir to the extension fluid passage.

2. The apparatus of claim 1 wherein the simulated barrel unit includes a removable barrel and the rigid extension portion is removably attached to the simulated barrel unit and includes the connector.

3. The apparatus of claim 1 wherein the $CO_2$ reservoir is formed in the magazine unit.

4. The apparatus of claim 1 wherein the $CO_2$ reservoir is a disposable member mounted in the magazine unit.

5. The apparatus of claim 4 wherein the disposable member includes a sealed outlet, and the magazine unit includes a puncture tip in fluid communication with the magazine fluid passage.

6. The apparatus of claim 5 wherein the disposable member is engaged with a position adjustment means for advancing the disposable member sealed outlet into engagement with the puncture tip whereby the sealed outlet is punctured and fluid in the disposable member is released into the magazine fluid passage.

7. The apparatus of claim 1 wherein the simulated magazine unit provides for a plurality of simulated shots to be fired from the pistol, the simulated shots being enabled by pressurized $CO_2$ in the reservoir, and further comprises electronic means for counting the plurality of shots, means for remotely communicating that a predetermined number of shots have been fired, and means for latching a slide of the associated pistol in an open position in response to the predetermined number of shots being fired.

8. The apparatus of claim 1 wherein the simulated barrel unit includes a laser alignment housing having a plurality of laser beam adjustment members and a friction ring.

9. An apparatus for non-permanent conversion of a semiautomatic pistol into a compressed gas powered weapon simulator for simulated shooting comprising:

the semiautomatic pistol including a combination of actual firearm components and a plurality of simulated firing components including a simulated barrel unit and a simulated magazine unit;

the simulated magazine unit including a $CO_2$ reservoir, a magazine fluid passage interconnecting the reservoir with a magazine fluid exit, and a valve means for blocking fluid flow through the fluid exit;

the simulated barrel unit including a rigid extension portion having an extension fluid passage therethrough, the extension fluid passage having a terminal end partially engaged with the fluid exit of the magazine such that an irregularly shaped connector tip of the terminal end partially engages and maintains the valve positioned with the magazine fluid exit in a metered open position;

the barrel unit including an expansion chamber, a seal at one end of the expansion chamber, a first end of a resilient member urging a ball into sealing engagement with the seal and a second end of the resilient member including a limiter means for limiting movement of the ball away from the seal and for governing tension of the resilient member; and whereby, in response to actuating simulated firing of the pistol, a striker urges the ball out of engagement with the seal permitting $CO_2$ to flow from the extension fluid passage to the expansion chamber and displace movement of a piston from the chamber for simulating firing of the pistol.

10. An apparatus for non-permanent conversion of a semiautomatic pistol into a compressed gas powered weapon simulator for simulated shooting, comprising:

the semiautomatic pistol including a combination of actual firearm components and a plurality of simulated firing components including a simulated barrel unit and a simulated magazine unit;

the simulated magazine unit including a pressurized gas reservoir, a magazine fluid passage interconnecting the reservoir with a magazine fluid exit, and ball valve means for blocking fluid flow through the fluid exit;

the magazine fluid exit including a magazine valve seal and a magazine valve seal keeper;

the simulated barrel unit including a rigid extension portion having an extension fluid passage therethrough, the extension fluid passage having a terminal end engaged with the magazine fluid exit and including a connector tip partially engaged with the ball valve such that the connector tip maintains the ball valve positioned with the magazine fluid exit in a metered open position; and wherein the simulated barrel unit is formed with a barrel and the rigid extension portion is removably attached to the simulated barrel unit and includes the connector.

11. The apparatus of claim 10 wherein the gas reservoir is formed in the magazine unit.

12. The apparatus of claim 10 wherein the gas reservoir is a disposable member mounted in the magazine unit.

13. The apparatus of claim 10 wherein the simulated magazine unit provides for a plurality of simulated shots to be fired from the pistol, the simulated shots being enabled by pressurized gas in the reservoir, and further comprises electronic means for counting the plurality of shots, means for remotely communicating that a predetermined number of shots have been fired, and means for latching a slide of the associated pistol in an open position in response to the predetermined number of shots being fired.

* * * * *